US011682269B2

(12) United States Patent
Lamle

(10) Patent No.: US 11,682,269 B2
(45) Date of Patent: Jun. 20, 2023

(54) INTUITION GAMBLING GAME SYSTEM AND METHOD

(71) Applicant: Stewart Lamle, Santa Monica, CA (US)

(72) Inventor: Stewart Lamle, Santa Monica, CA (US)

( * ) Notice: Subject to any disclaimer, the term of this patent is extended or adjusted under 35 U.S.C. 154(b) by 267 days.

(21) Appl. No.: 16/765,003

(22) PCT Filed: Sep. 24, 2019

(86) PCT No.: PCT/US2019/052700

§ 371 (c)(1),
(2) Date: May 18, 2020

(87) PCT Pub. No.: WO2021/025714

PCT Pub. Date: Feb. 11, 2021

(65) Prior Publication Data

US 2021/0090407 A1 Mar. 25, 2021

Related U.S. Application Data

(60) Provisional application No. 62/883,150, filed on Aug. 6, 2019.

(51) Int. Cl.
*G07F 17/32* (2006.01)

(52) U.S. Cl.
CPC ..... *G07F 17/3293* (2013.01); *G07F 17/3211* (2013.01); *G07F 17/3223* (2013.01)

(58) Field of Classification Search
CPC ..... G07F 17/3293; G07F 17/3211; G07F 17/3223
See application file for complete search history.

(56) References Cited

U.S. PATENT DOCUMENTS

| | | | | |
|---|---|---|---|---|
| 4,998,737 | A | 3/1991 | Lamle | |
| 5,048,833 | A | 9/1991 | Lamle | |
| 7,785,183 | B1 * | 8/2010 | Stockham | G07F 17/3258 463/13 |
| 2004/0038733 | A1 * | 2/2004 | Walker | G07F 17/3244 463/25 |
| 2004/0100020 | A1 * | 5/2004 | Miller | A63F 3/00157 273/148 R |
| 2007/0077984 | A1 * | 4/2007 | Aida | G07F 17/32 463/20 |

(Continued)

OTHER PUBLICATIONS

ISA/US, PCT/US19/52700, International Search Report and Opinion, dated Dec. 12, 2019.

(Continued)

*Primary Examiner* — Werner G Garner
(74) *Attorney, Agent, or Firm* — John H. Choi & Associates

(57) ABSTRACT

A system, method, and non-transitory medium employ a user computer including an input/output device for providing a graphical user interface (GUI) to the user; and a game server, interacting with the user computer, for displaying game screens on the GUI to conduct a game with representations of two two-sided cards having a pair of sides hidden from the user; wherein display of the hidden pair of sides of the two two-sided cards to the user by the game server determines a winning state.

8 Claims, 46 Drawing Sheets

(56) References Cited

U.S. PATENT DOCUMENTS

| | | | | |
|---|---|---|---|---|
| 2008/0070659 | A1* | 3/2008 | Naicker | G07F 17/32 463/12 |
| 2009/0239656 | A1* | 9/2009 | Meyerhofer | G07F 17/3241 463/25 |
| 2013/0196777 | A1* | 8/2013 | Hill | A63F 3/00643 463/42 |
| 2017/0249806 | A1 | 8/2017 | Lutnick et al. | |
| 2017/0301179 | A1 | 10/2017 | Palenzuela | |
| 2019/0147702 | A1* | 5/2019 | Malek | G07F 17/3255 463/25 |

OTHER PUBLICATIONS

Stewart Lamle, PCT/US19/52700, Amendment under Article 34, dated Jan. 31, 2020.
IPEA/US, PCT/US19/52700, International Preliminary Report on Patentability, dated Apr. 9, 2020.
U.S. Copyright Reg. No. TX0008133873, Apr. 29, 2015.

* cited by examiner

INTUITION GAMBLING GAME SYSTEM AND METHOD

CROSS-REFERENCE TO RELATED APPLICATION

This application claims priority to U.S. Provisional Application No. 62/883,150, filed on Aug. 6, 2019, which is incorporated by reference in its entirety.

FIELD

The present disclosure relates to games and in particular to intuitive games which facilitate the funding of charities and causes.

BACKGROUND

Games and the business of operating the games described herein are designed to solve a growing economic problem facing two huge industries: the casino industry including online gambling, and the charity and causes fundraising industry. Charities include 501(c)(3) and 501(c)(4) registered charities and similarly registered charities in other jurisdictions. Causes include fundraising that is not for a registered charity. It may be a very private cause, or it may be to raise funds to address public concerns. For example, tournaments can be used to raise funds, but the sponsor of a tournament is required to supply information about the charity or cause being sponsored. The sponsor recruits tournament players.

The economic problem arises from a global cultural shift that has the potential of costing each of these industries over $100 billion per year. Both industries have two related issues: 1) heavy reliance on the shrinking population of people over age 50 for the majority of their income, 2) lack of financial responsiveness of younger generations to the traditional range of services, marketing, and other appeals of these industries. Unless something is done to improve the marketing to younger generations, these industries are on the path to lose substantial potential income.

Regarding gambling, slot machines are fast and easy to play. It's a big business. Globally in 2017 approximately 1.8 million slot machines were in use in casinos, bars and other locations. In 2017 the 142,000 slot machines in Nevada produced 64% of the casino income, resulting in $11.6 billion in revenue. Slot machines are the largest gambling revenue producer for casinos, in most jurisdictions. The exception is Macau where players prefer Baccarat to slot machines. In 2017 88% of the revenue in Macau casinos came from Baccarat, while slot machines only produced 5% of casino revenue.

In baccarat, and in its variations, i.e. punto banco (or "North American baccarat"), baccarat chemin de fer (or "chemmy"), and baccarat banque there are three possible outcomes the "player" wins, the "tie" wins, or the "banker" wins. Players may bet on any of the outcomes. In baccarat, the objective of bets on "player" or "banker" is to have the highest total of the last digit of two cards, or the highest total with a mandatory third card. The rules for taking the third card are so complex that many baccarat players do not know the rules and rely on the croupier. In most casinos if a "tie" bet wins, the person who made the bet wins eight times the amount of the bet, and bets on "player" or "banker" remain in place. If a "player" bet wins the person who made the bet wins an amount equal to the bet, however if a "banker" bet wins the person who made the bet wins only 95% of the amount of the bet, and the casino or operator takes a 5% commission.

Since the vast majority of slot machine players are well over age 50, their numbers are shrinking every year, thus the revenue that these players can generate is likely to fall with each passing year. Most younger adults, currently age 18 to 50, grew up with computers, the Internet and cellphones. Many of them play games that are emotionally involving, in which the winning and losing is personal since it depends on the player's own actions. On their smartphones, game players use skill, intuition and luck to win. However, on a slot machine, the results are determined by the machine's algorithms, there's no accepted way players can use their intuition skills to foretell a result, or create a result, thus many players feel that pressing buttons on slot machines with no mental input to the outcome is boring regardless of the sights and sounds.

Traditional fundraising methods may not be able to raise the funds necessary to sustain the work of many charities and causes in the future. Last year, people over age 50 gave 90% of the funds given to charities by individuals. According to the Giving USA annual report on philanthropy for the year 2017, individual Americans gave $287 billion to charities in 2017. Although there are more people in the 18 to 50 age group than people 51+ in the United States, only 10% of charity revenues were given by people age 50 or younger.

Traditional methods used to raise funds for charities and causes are clearly less effective with people who grew up with computers, the Internet and cell phones, than with older generations.

Games used for gambling may include two-sided playing cards and electronic images of two-sided cards as described in U.S. Pat. Nos. 4,998,737 and 5,011,146, which are incorporated herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

One purpose of the present invention is to provide fast, easy to play games for casinos that gets players emotionally involved because the player's luck, intuitive skills, decisions and actions, not algorithms, determine whether the bets are winners or losers.

Another purpose of the present invention is to provide a new method of fundraising for charities and causes.

The present application describes a new method to raise funds for charities and causes.

The present invention utilizes the cloud power of networked computers and the pervasive reach of the Internet.

The games disclosed in the present application are games based on the concept that there is a rollercoaster of psychological enjoyment created by using intuitive skills to conjecture, by betting, on the outcome of turning over two two-sided cards, and seeing the result.

After the cards are turned over, one of the two cards will show the higher number, or both will show the same number. The higher number, or tie, wins!

Players are internally rewarded psychologically and externally by visual displays and sounds for the success of their intuitive skills. Players may also win points, Golden tickets, credits, money or equivalents for using their intuitive skills to guess correctly and win bets, and to lose bets when their decisions are not correct.

The present application discloses a system, method, and networked computer program for providing a fast and easy way to play intuition-involving gambling games in many formats, including smartphones, tablets, computers, casino table games, slot machine games and large audience participation games.

The present application also discloses a method by which players can compete in betting tournaments in which a portion of the winnings go to a designated charity or cause.

The present application further discloses a system, method, and network-based computer program for crowdfunding voluntary donations to finance preferred or selected charities and causes.

In one embodiment, the present invention is a system comprising: a user computer including an input/output device for providing a graphical user interface (GUI) to the user; and a game server, interacting with the user computer, for displaying game screens on the GUI to conduct a game with representations of two two-sided cards having a pair of sides hidden from the user; wherein display of the hidden pair of sides of the two two-sided cards to the user by the game server determines a winning state. A higher one of numerical values of the hidden pair of sides of the two two-sided cards determines the winning state. A tie of numerical values of the hidden pair of sides of the two two-sided cards determines the winning state. The user bets on one of the hidden pair of sides of two-sided cards to have the winning state. The user bets on a tie of values of the hidden pair of sides of the two-sided cards to have the winning state. The user selects a type of bet from the group consisting of a left card bet, a right card bet, a tie bet, a side bet, an exacta bet, and a lucky number bet. The user participates in a tournament involving the game, such that a predetermined portion of a winning bet in the tournament goes to at least one of a charity or cause.

Alternatively, instead of numerical value, the card may have other rank-ordered indices such as pictures of animals ranked according to their size.

In another embodiment, the present invention is a table for conducting a card game, comprising: a plurality of positions of players, each position having a left pad, a right pad, and a tie pad for receiving a bet on a selected one of the left pad, the right pad, and the tie pad; a left paddle for receiving a left two-sided card; and a right paddle for receiving a right two-sided card; wherein the left and right two-sided cards have a pair of sides hidden from the plurality of players; and wherein display of the hidden pair of sides of the two two-sided cards to the plurality of players determines a winning state. A card dealing slot is provided for a dealer to receive at least one of the left and right two-sided cards. A display presents a jackpot amount. The display presents a list of outcomes of the display of the hidden pair of the two-sided cards. An electronic device is provided with a display representing a left pad, a right pad, and a tie pad, with the electronic device receiving a bet on a selected one of the left pad, the right pad, and the tie pad. An account card reader reads a physical account card, or other input device, associated with one of the plurality of players. A receipt printer prints a physical receipt of bets and winnings of one of the plurality of players. An optical recognition video camera captures images of the left and right two-sided cards after the hidden pair of sides of the left and right two-sided cards are displayed. A discard slot is provided for discarding the displayed two-sided cards. A card reader reads and recognizes the discarded two-sided cards.

The relative amounts of the bets may be based on how the player intuitively feels about the likelihood of winning each bet, or by another form of intuitive analysis, The user may simultaneously bet on both cards and/or the tie, as well as a side bet, an exacta bet, and a lucky number bet, or any combination thereof. For example, the user may bet 40 on one card, 20 on the other card, and 10 on tie, a total of 70. If the 40 bet wins, the player bet a total of 70 and receives 80, a net win of 10. If the tie bet wins the player receives 90, a net win of 20. If the 20 bet wins, the player receives 40 for net loss of 30.

In a further embodiment, the present invention is a method comprising: providing a graphical user interface (GUI) to the user employing a user computer including an input/output device; interacting, by a game server, with the user computer; displaying game screens on the GUI; conducting a game with representations of two two-sided cards having a pair of sides hidden from the user; displaying the hidden pair of sides of the two two-sided cards to the user by the game server; determines a winning state; and in tournaments the game server allocates a portion of winnings of the user, associated with being a winner of the tournament, to at least one of a charity or cause. The method also includes sponsoring a tournament of the game played by a plurality of users.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
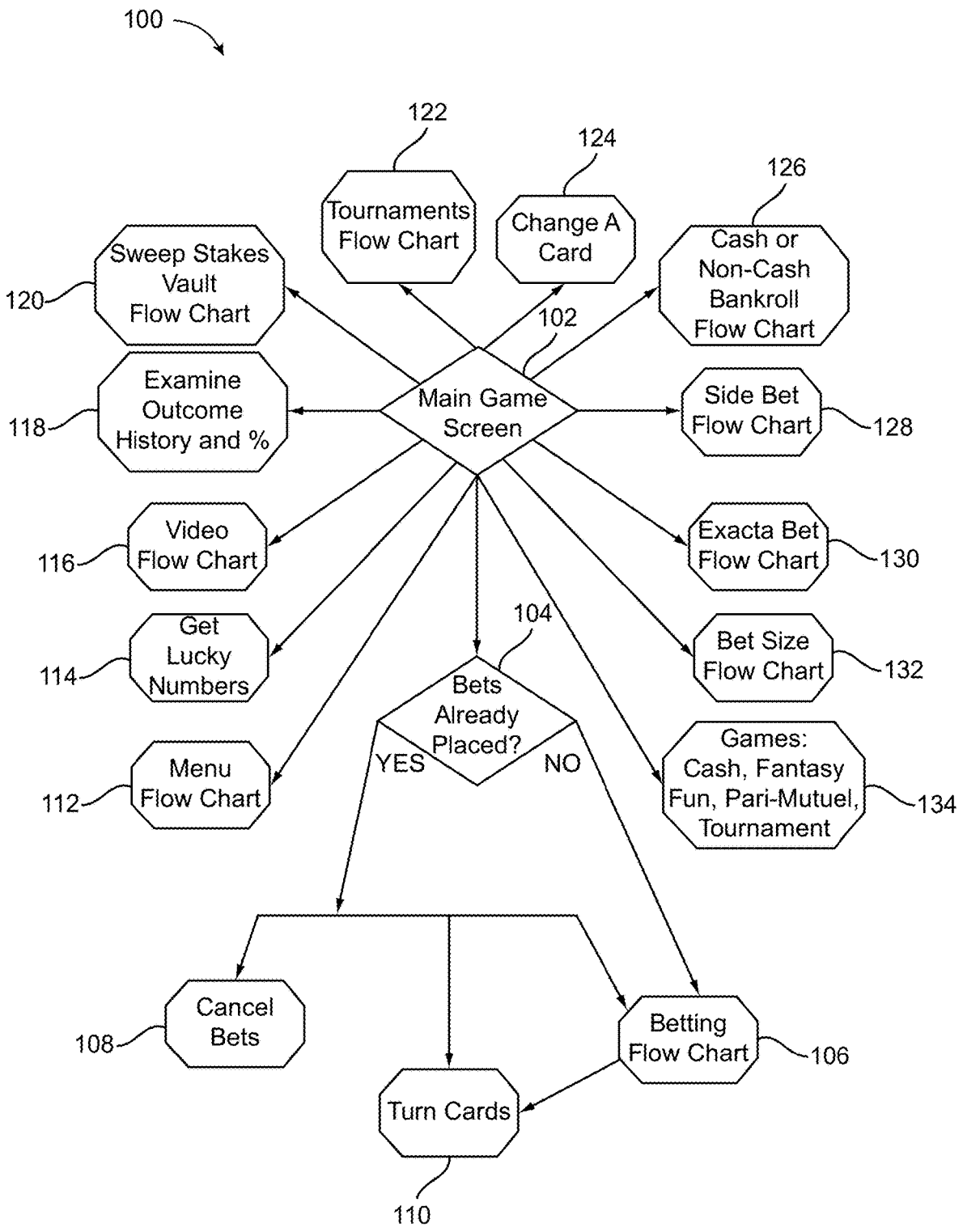
FIG. 1 illustrates a set of options available from a main game screen.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. The word "click" is intended to include actuate by tap, press, or flick, and the like by the player or the player's virtual or augmented avatar. Additionally, to assist in the description of the present invention, words such as top, bottom, side, upper, lower, front, rear, inner, outer, right and left may be used to describe the accompanying figures. The terminology includes the words above specifically mentioned, derivatives thereof, and words of similar import.

Figure 45:
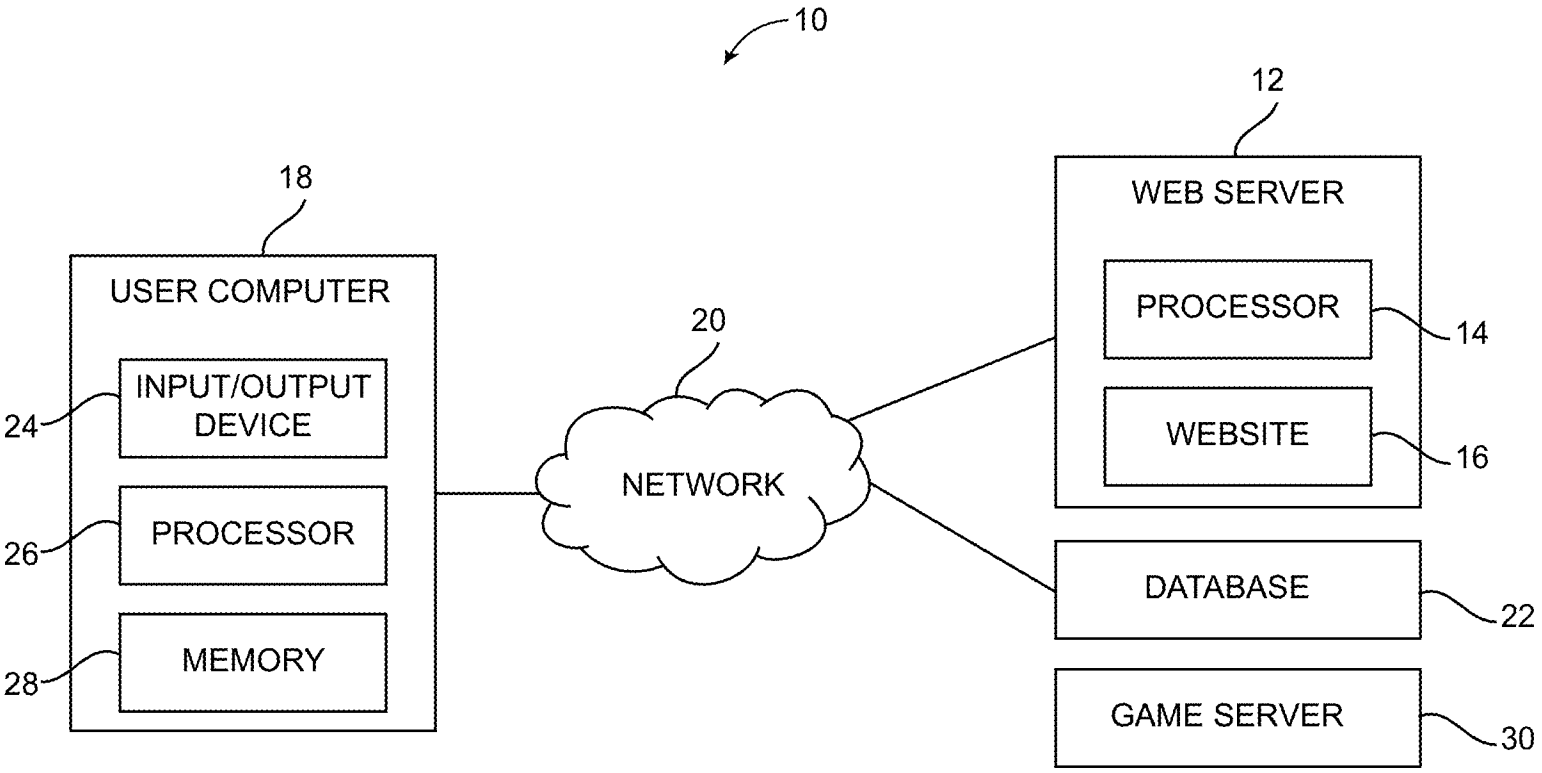
FIG. 45 illustrates a system of the present invention.

FIG. 45 illustrates a system 10 of the present invention for implementing games as described below. The system 10 has a web server 12 with a processor 14 and a website 16 which is accessible by a user computer 18 through a network 20, such as the Internet. Alternatively or in addition, the network 20 may be a cloud-based telecommunications system. The web server 12 and/or the user computer 18 may access a database 22 through the network 20. The user computer 18 has an input/output device 24, a processor 26, and a memory 28. The input/output device 24 includes a keyboard, a mouse, a touchscreen, a display, and other known input devices and output devices. For example, the touchscreen or display may display a graphical user interface (GUI) through which a user interacts with various interfaces described below. The system 10 also includes a game server 30 described below, which is communicates with the web server 12, the user computer 18, and/or the database 22.

The system 300 and method of operation of the present invention may be embodied as a software application operating on at least the game server 330 in conjunction with the user computer 18, with the software application written, for example, in the C# programming language and developed on the UNITY 3D development platform. The software application is compiled to operate on many known platforms and/or operating system including WINDOWS, macOS, HTML 5, and iPhone and ANDROID phones, for example, embodied as a smartphone functioning as the user computer 18. In addition, the software application may include instructions executed by a processor, such as the processor 14, the processor 26, and/or a processor operating the game server 30, with the software application possibly embodied on a non-transitory computer medium, such as the memory 28 or other known storage media.

By using the system 10 with the user computer 18, a user accesses the web server 12 and the game server 30 through the network 20 to engage in and play games which are intuition-based and which may be used to fund charities and causes. The game server 30 generates a game interface on a display and/or touchscreen of the input/output device 24, so that the user, as a player, can play the games. Examples of game interfaces are shown in FIGS. 36-42.

In particular, FIG. 1 illustrates a set 100 of options available from a main game screen, such as the step of displaying 102 the game screens shown in FIGS. 36-42. Referring to FIG. 1, the player can enter and/or modify bets, and the system 10 checks in step 104 if bets have already been placed. If not, the system 10 processes, in step 106, the betting flowchart 200 shown in FIG. 2. Otherwise, the system 10 allows the player to cancel bets in step 108, turn cards over in step 110 using the flowchart 300 shown in FIG. 3, or process the betting flowchart 200 in step 106.

Figure 4:
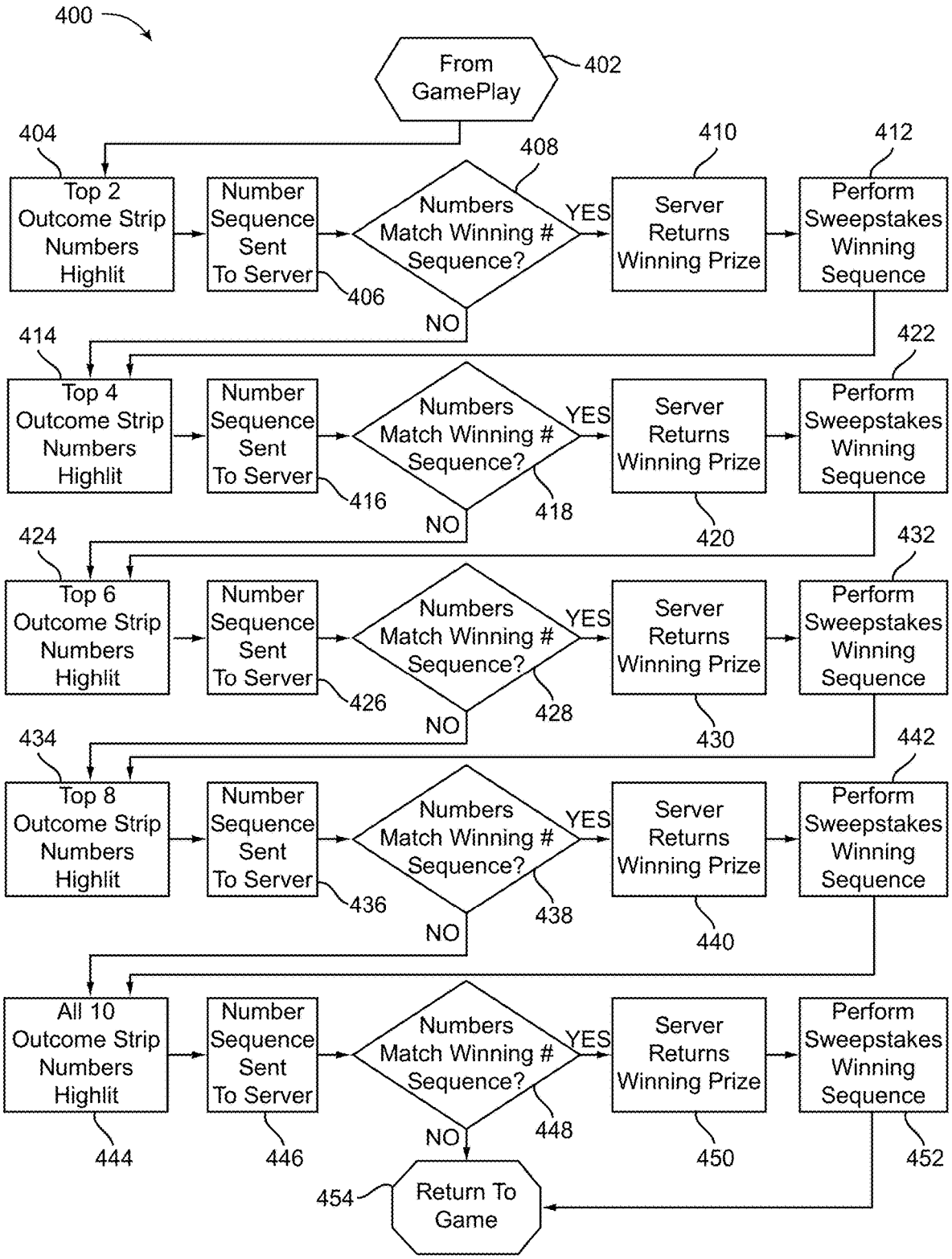
FIG. 4 illustrates a sweepstakes processing flowchart.
Figure 5:
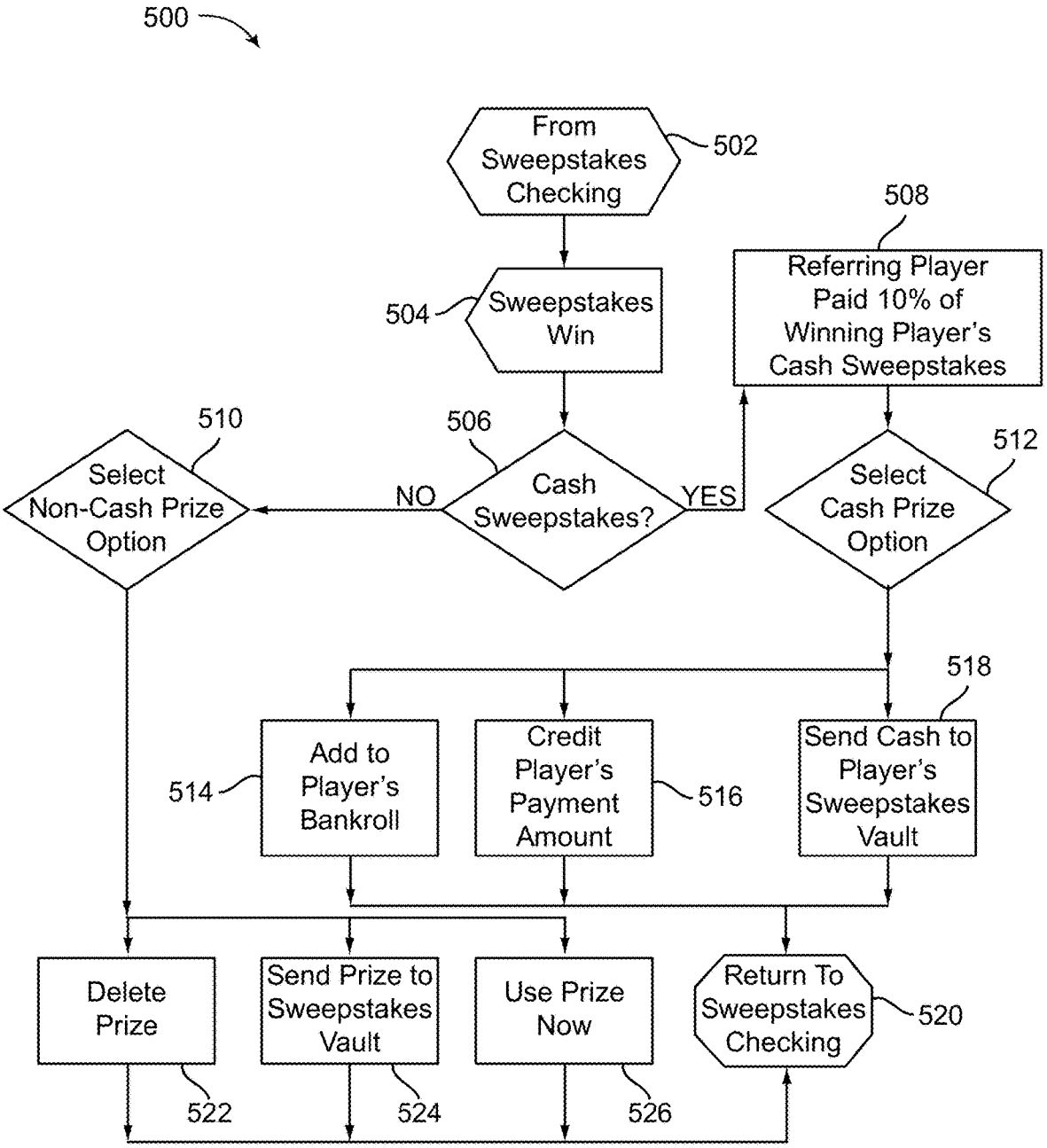
FIG. 5 illustrates a sweepstakes winning flowchart.
Figure 7:
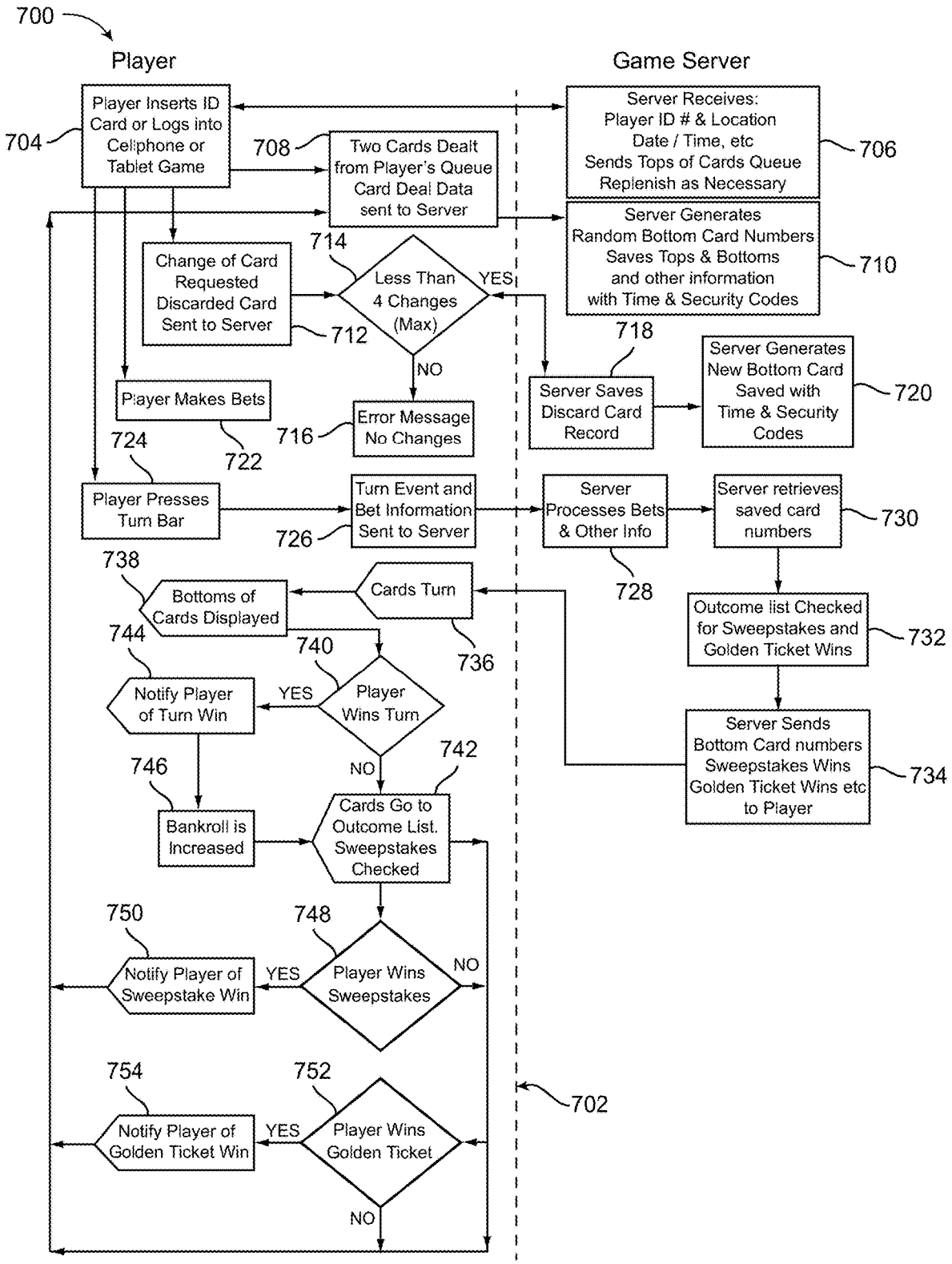
FIG. 7 illustrates a game data flowchart for random odds.
Figure 8:
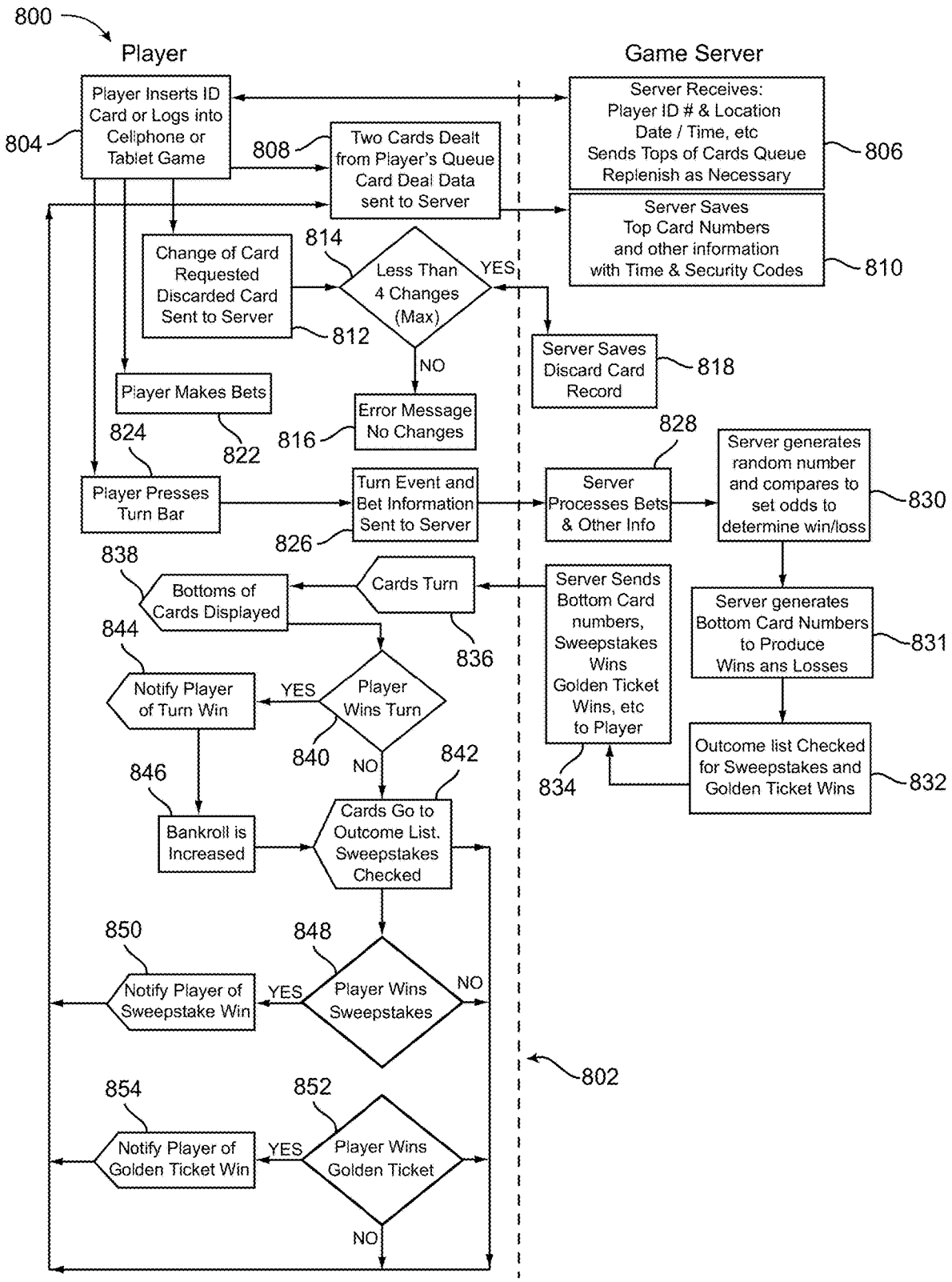
FIG. 8 illustrates a game data flowchart for set odds.
Figure 9:
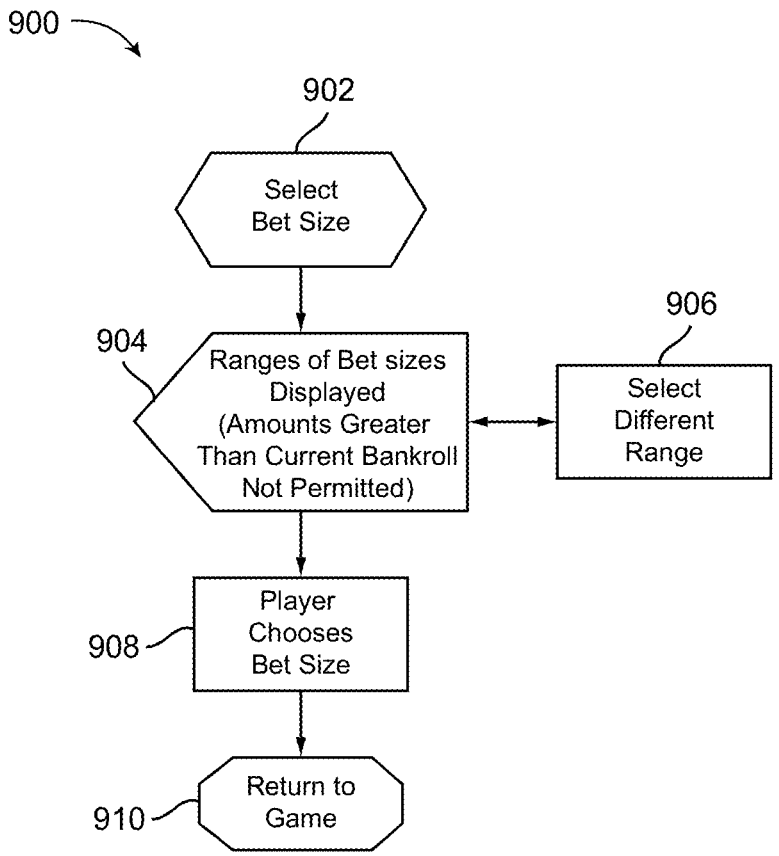
FIG. 9 illustrates a bet size processing flowchart.
Figure 10:
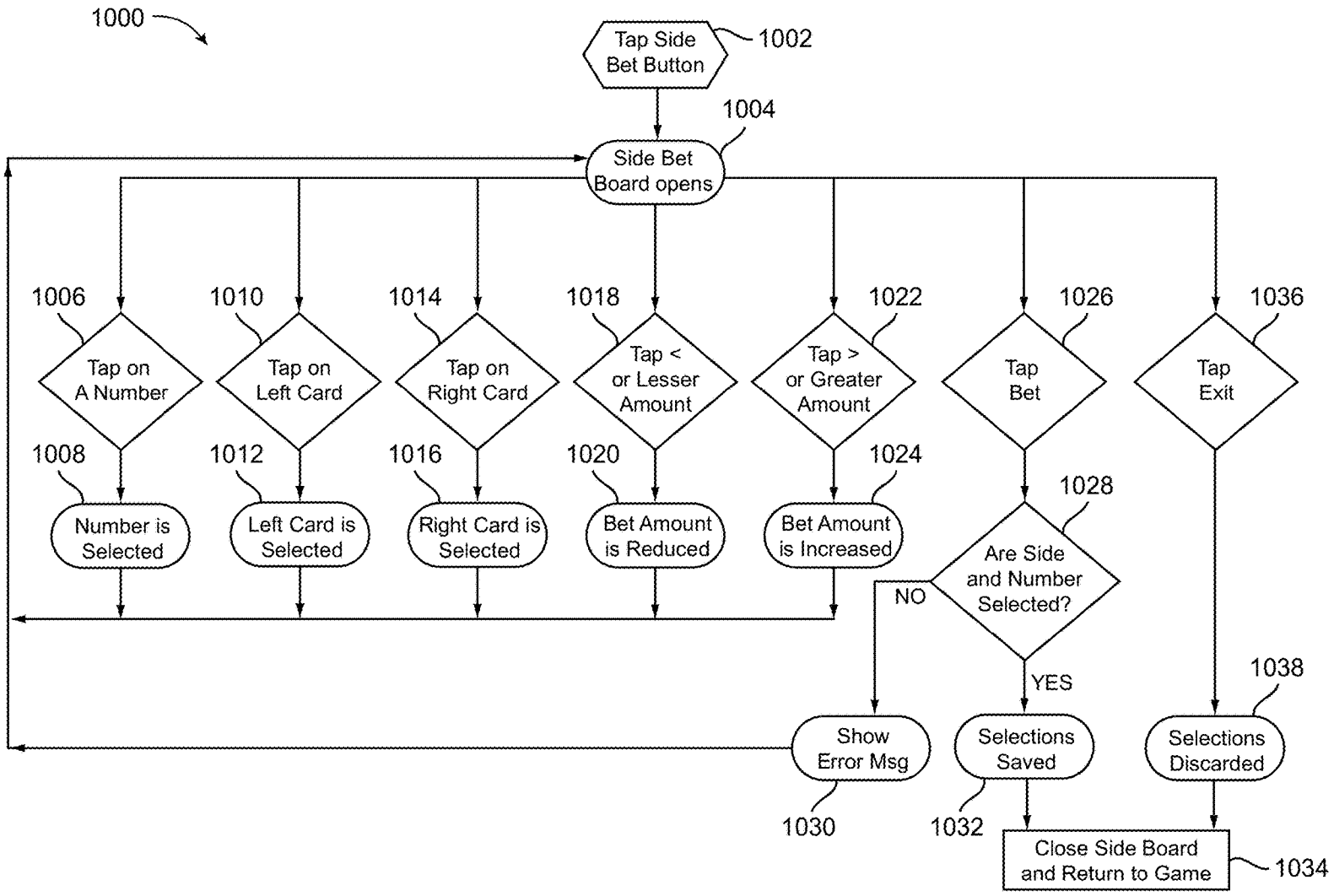
FIG. 10 illustrates a side bet processing flowchart.
Figure 11:
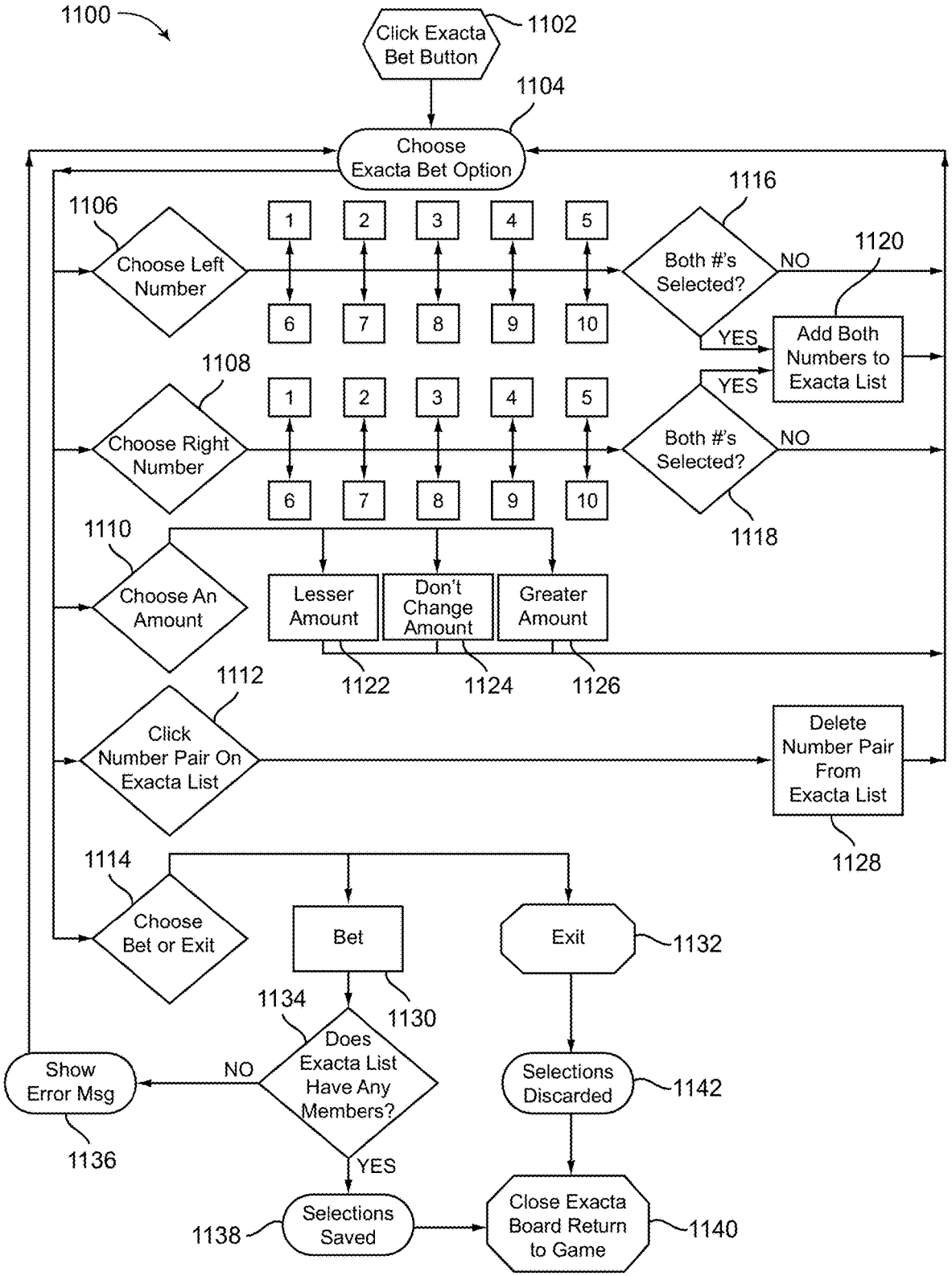
FIG. 11 illustrates an exacta bet processing flowchart.
Figure 12:
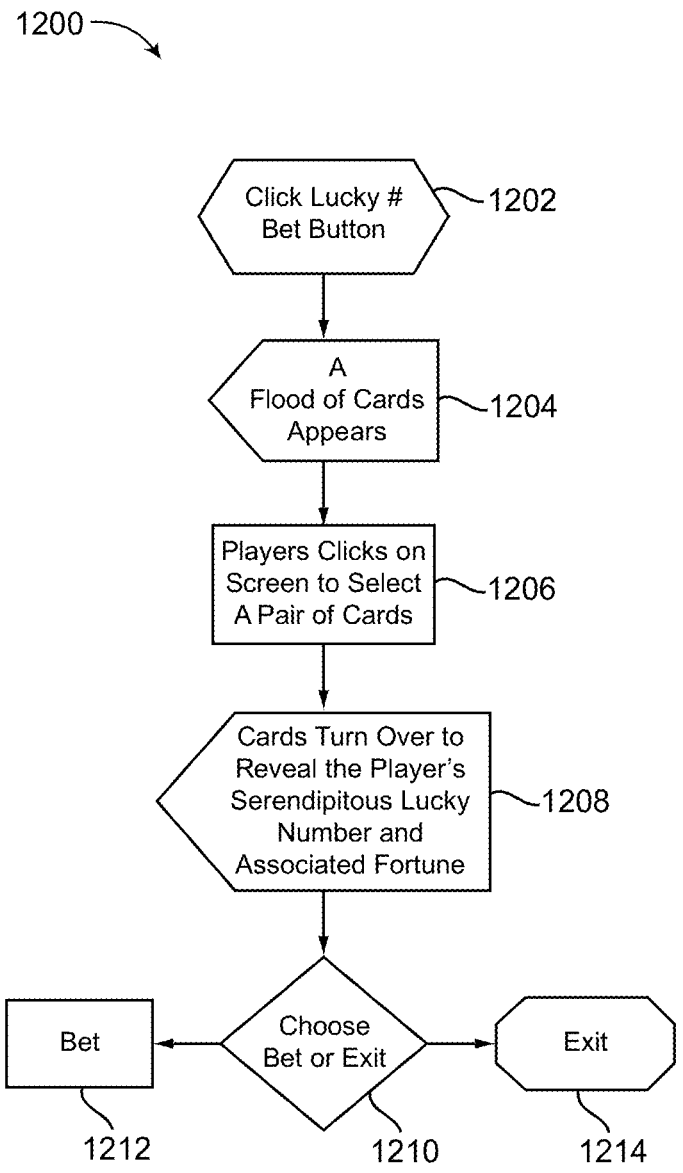
FIG. 12 illustrates a lucky number bet processing flowchart.
Figure 13:
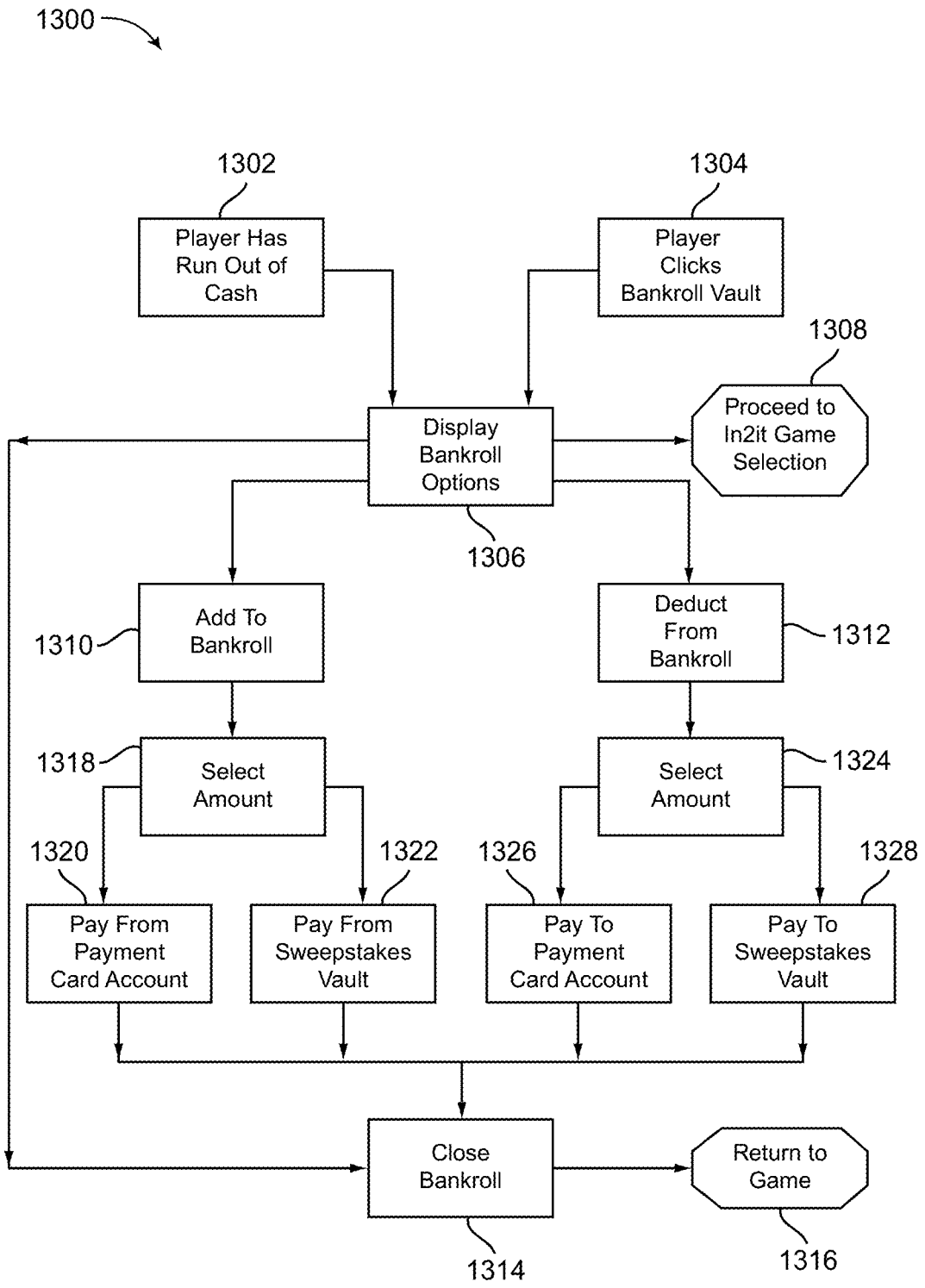
FIG. 13 illustrates a cash bankroll processing flowchart.
Figure 16:
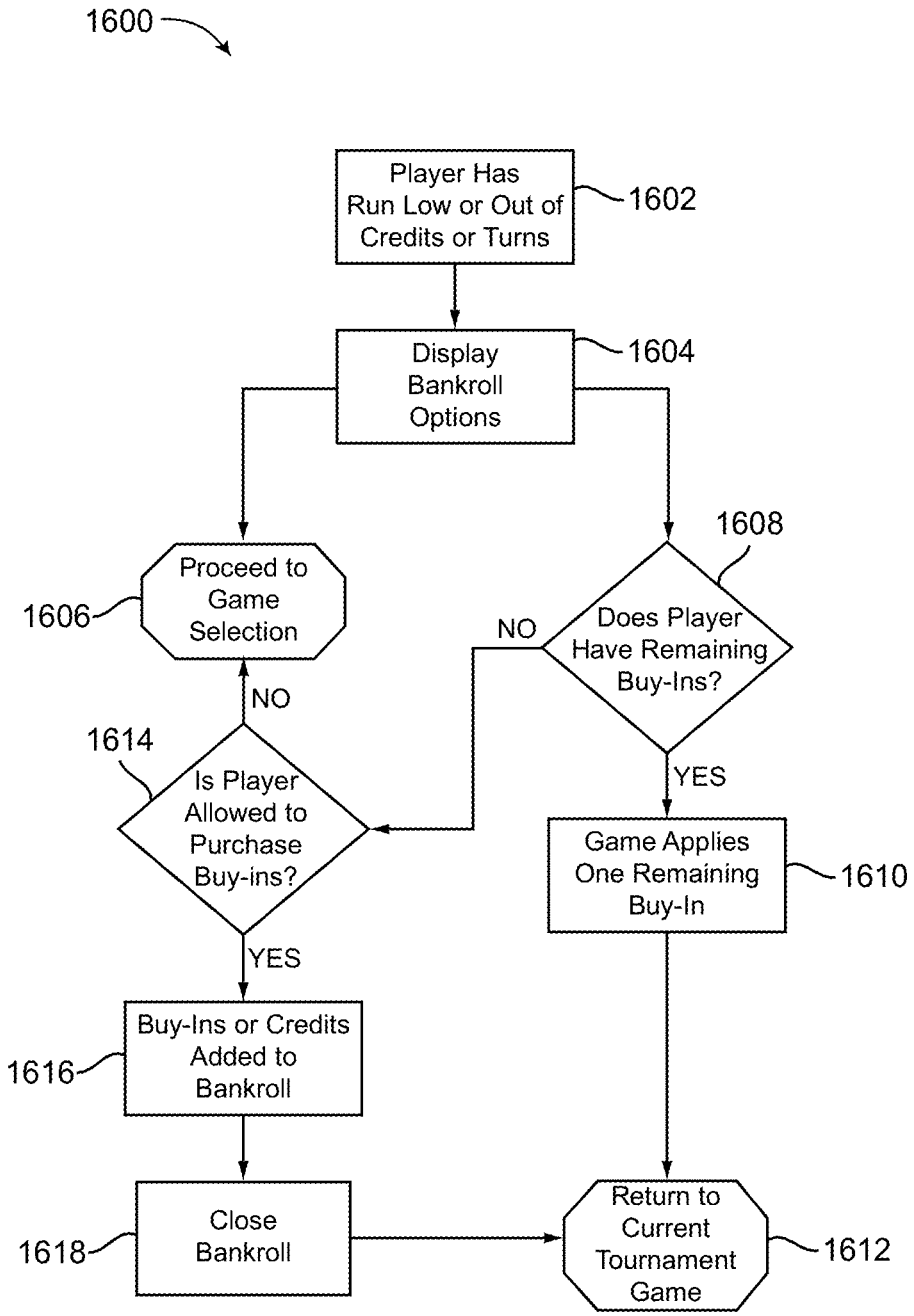
FIG. 16 illustrates a tournament bankroll processing flowchart.
Figure 17:
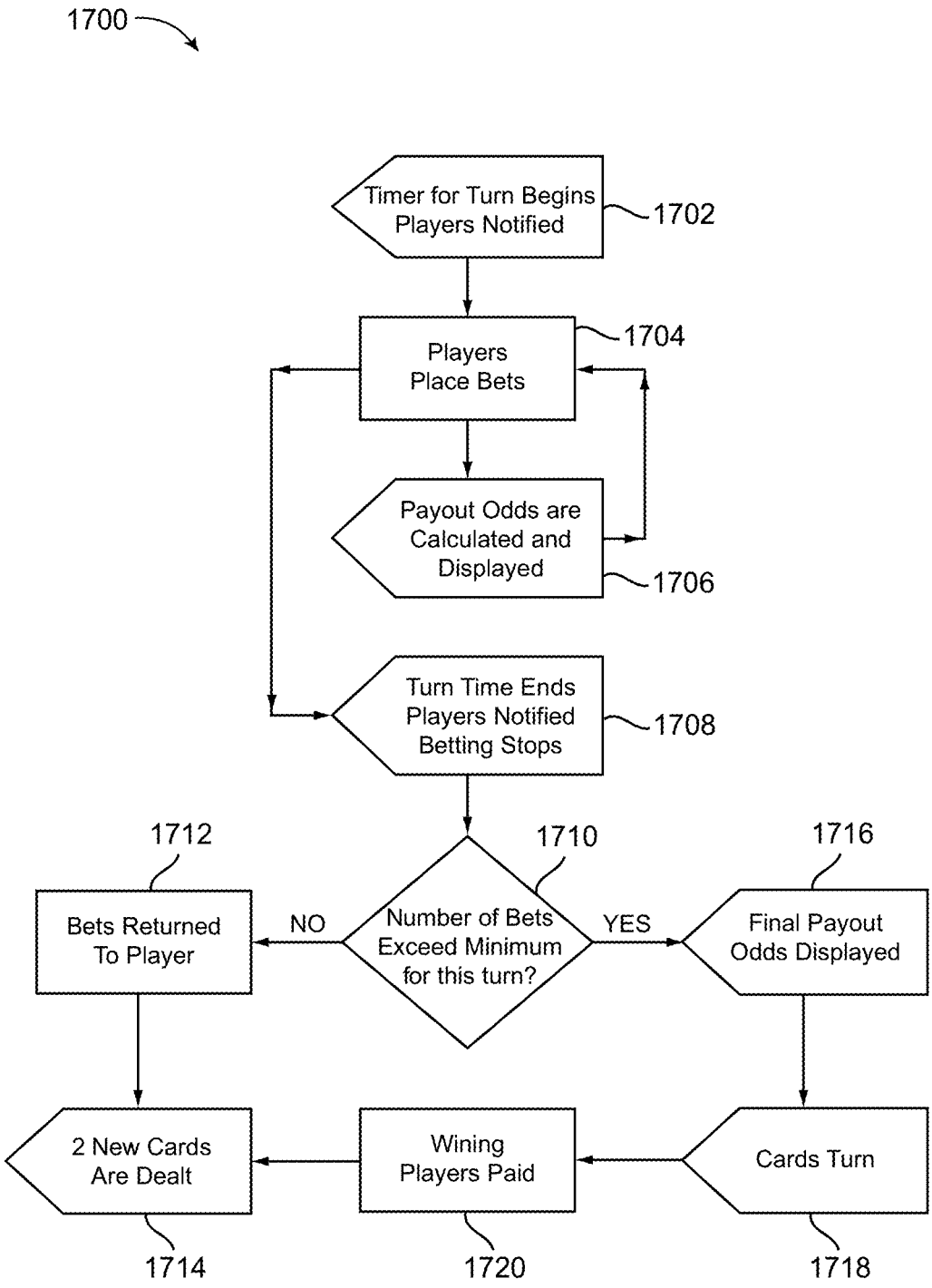
FIG. 17 illustrates a pari-mutuel bet processing flowchart.
Figure 18:
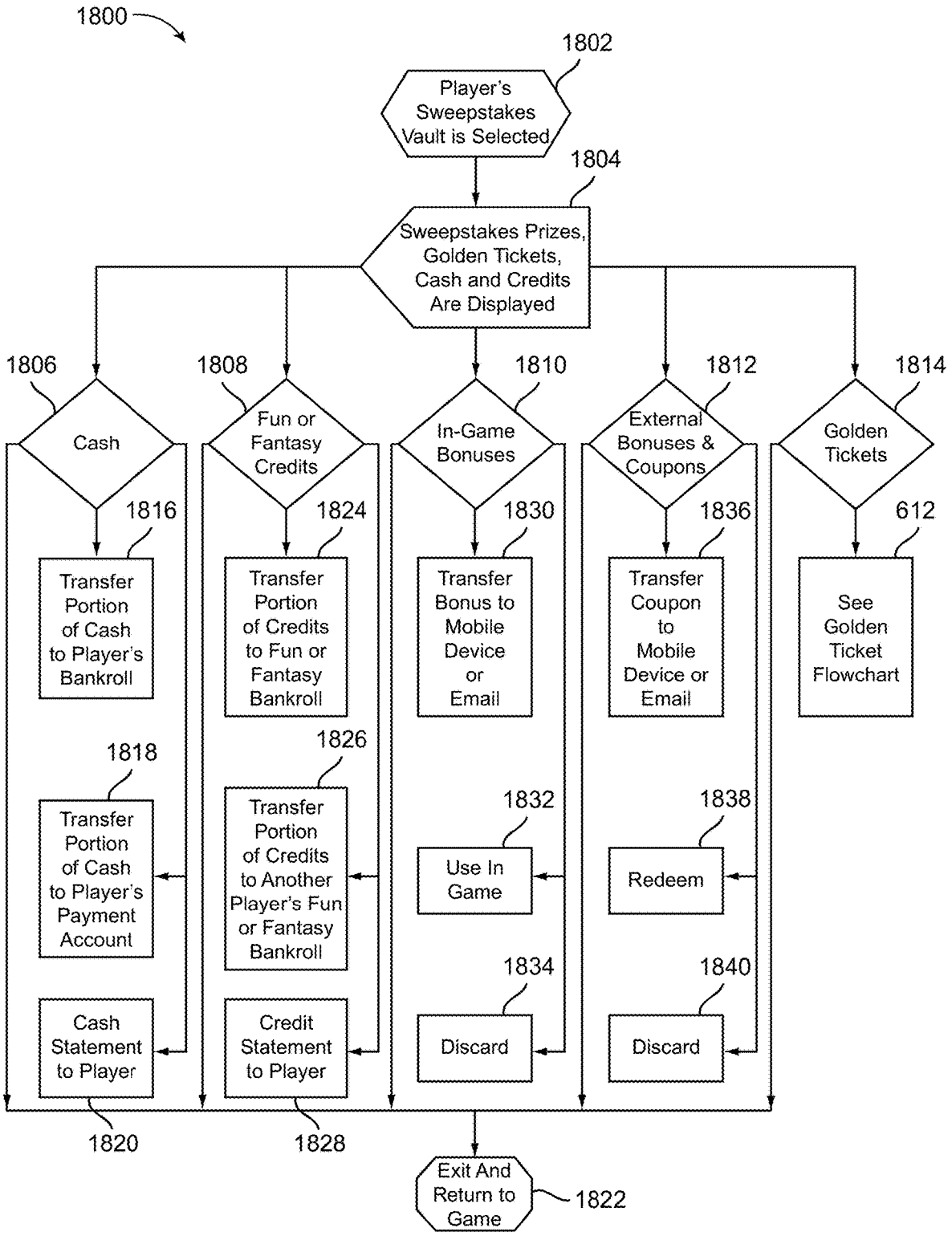
FIG. 18 illustrates a sweepstakes vault processing flowchart.
Figure 19:
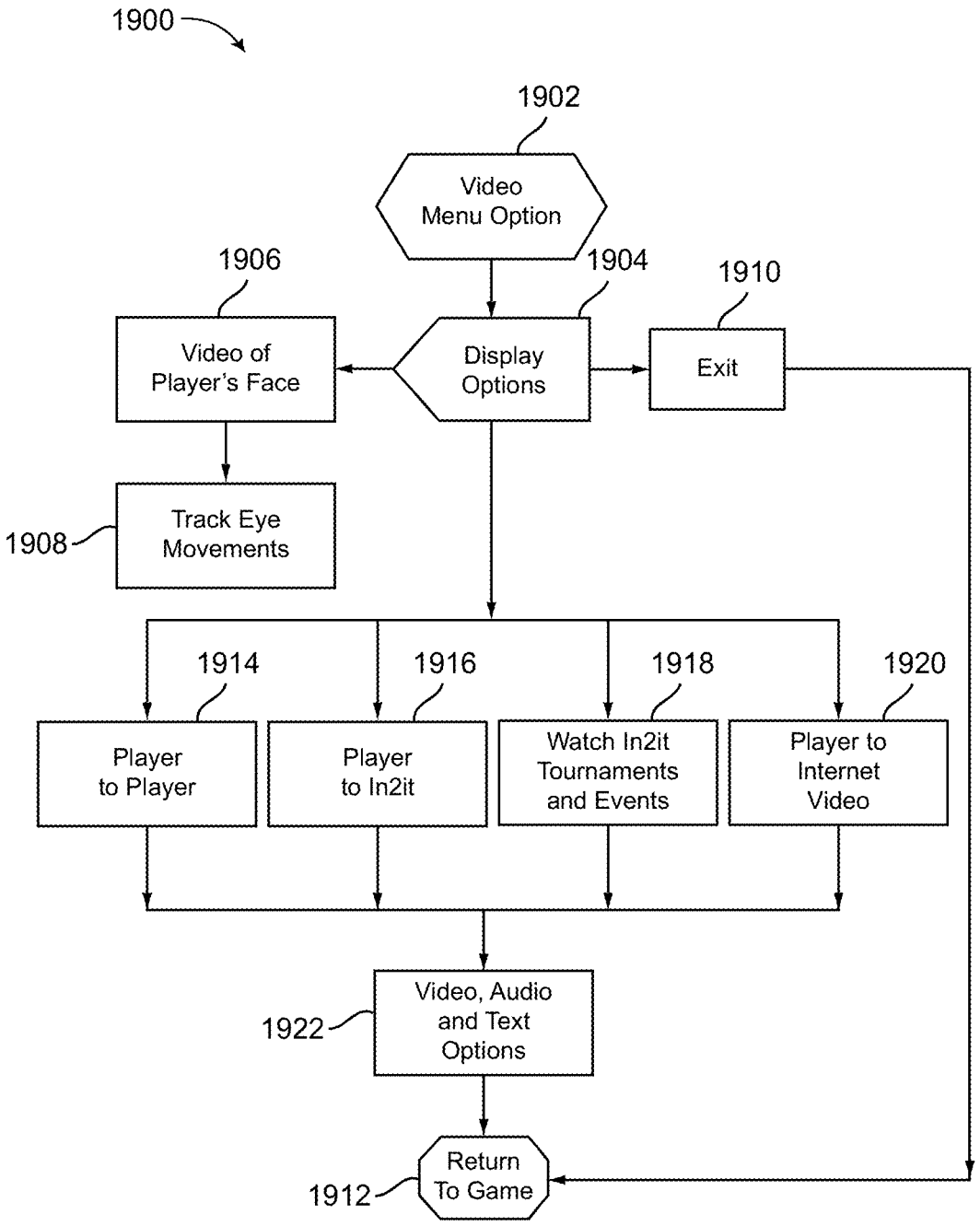
FIG. 19 illustrates a video option flowchart.
Figure 23:
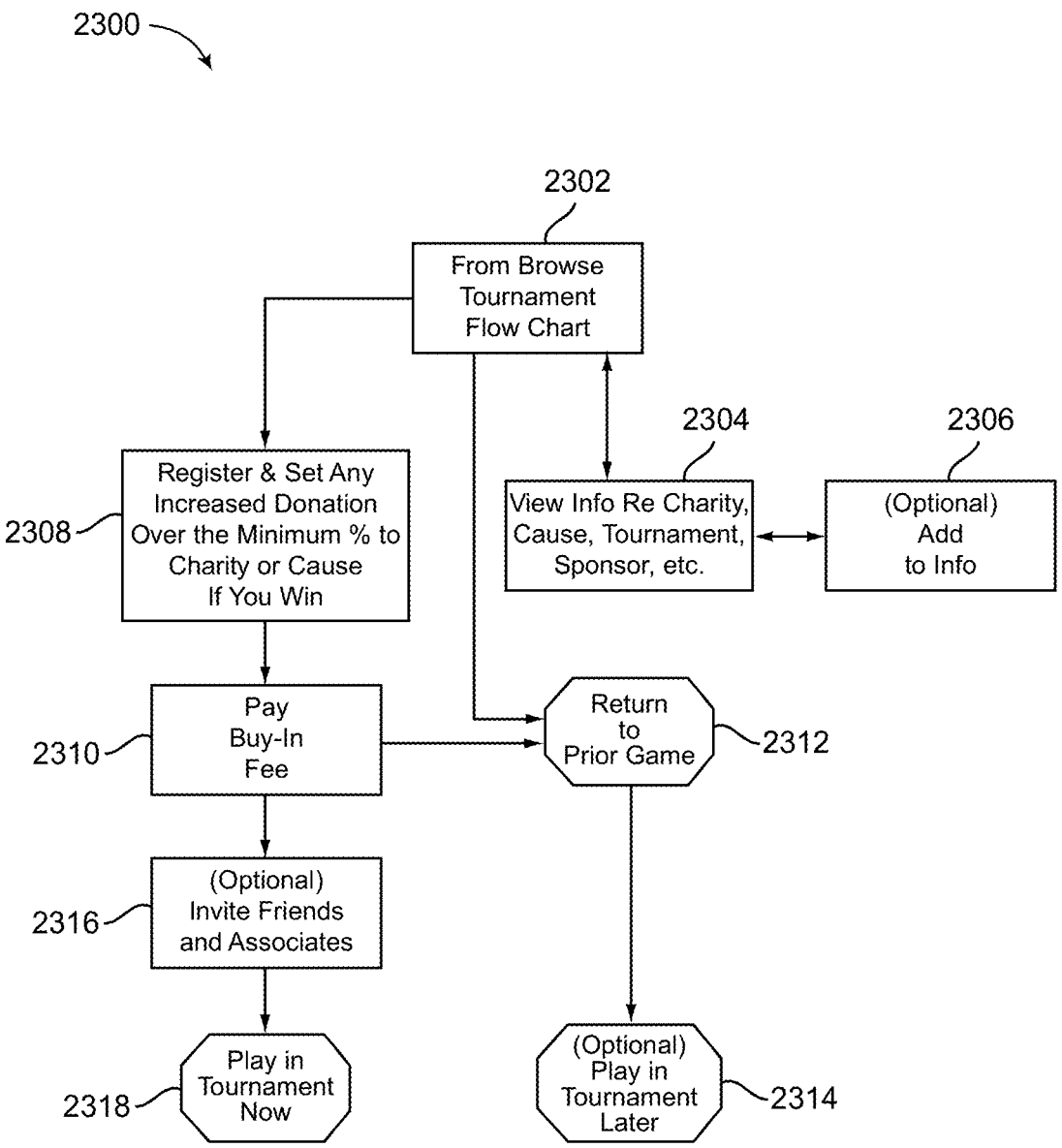
FIG. 23 illustrates a tournament joining flowchart.
Figure 24:
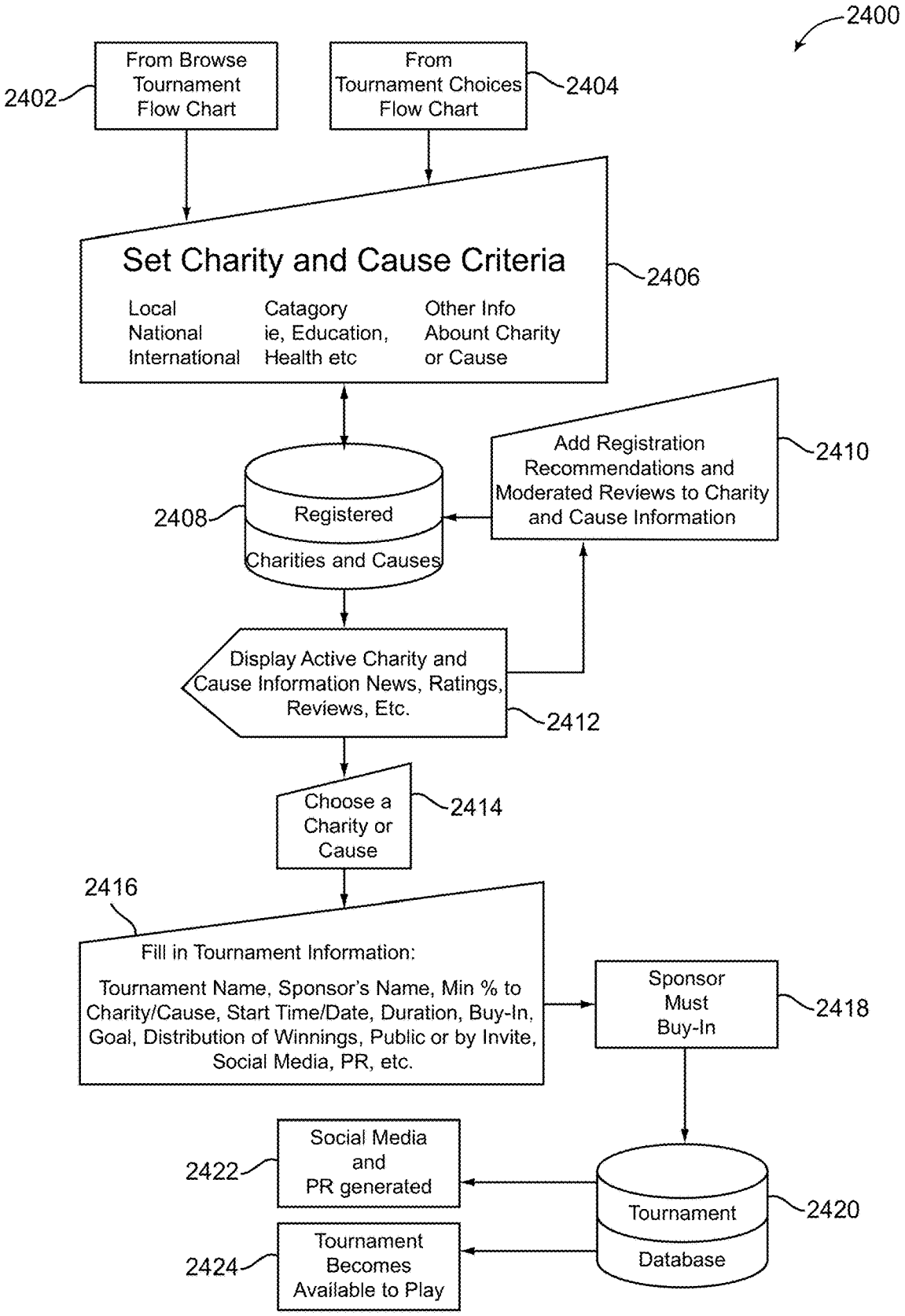
FIG. 24 illustrates a tournament sponsoring flowchart.
Figure 25:
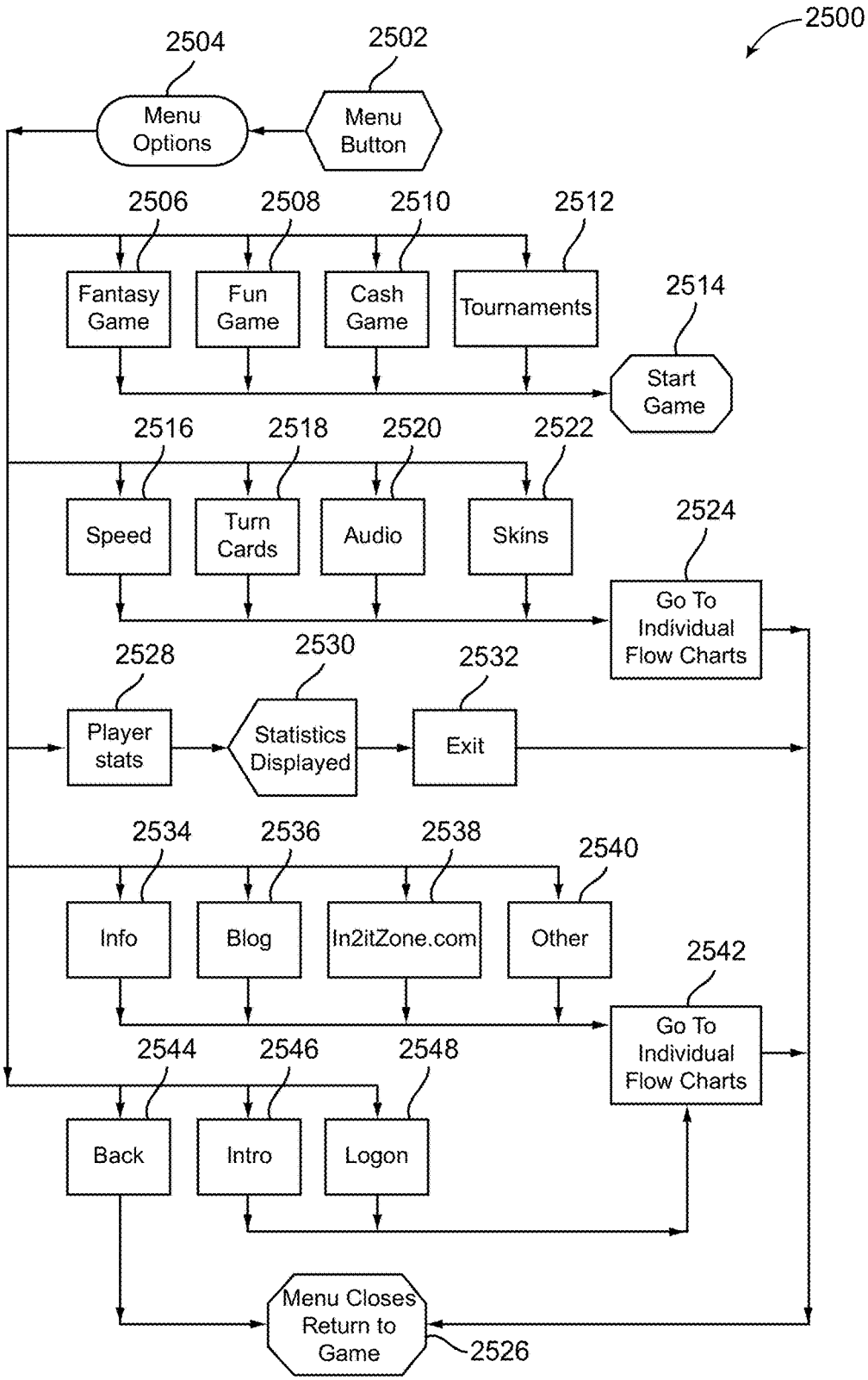
FIG. 25 illustrates a menu flowchart.

From the main game screen, the player can access a menu flowchart in step 112 as shown in FIG. 25; get lucky numbers in step 114 as shown in FIG. 12; watch videos in step 116 as shown in FIG. 19; examine outcome history and percentages of wins in step 118; access sweepstakes in step 120 as shown in FIGS. 4-5 and 18; access tournaments in step 122 as shown in FIGS. 21-24; change a card in step 124 as shown in FIGS. 7-8 and 11; process cash and non-cash bankrolls in step 126 as shown in FIG. 13; process side bets in step 128 as shown in FIG. 10; process exacta bets in step 130 as shown in FIG. 11; manage bet sizes in step 132 as shown in FIG. 9; and perform specific games in step 134 as shown in FIGS. 14-17 and 20, such as cash, fantasy, fun, pari-mutuel, and tournament games.

In a cash game, a player plays for cash, such as money, usually in the form of payment cards balance transfers. Players may also receive bonuses or Golden Tickets. In a fantasy game, players play for credits instead of money. Some credits are awarded without cost. Alternatively or in addition, players may purchase additional credits. There are several levels of play in the fantasy version of the game. Each level provides an opening amount of credits, and a credit amount goal is set which must be reached to complete that level. In some embodiments, a maximum number of permitted turns or a maximum time limit is required to achieve a given level. Players may receive credits on a timed basis, or may purchase a buy-in of credits and/or turns. Players may receive Golden Tickets and/or other prizes for completing a Fantasy level.

In a fun game, players play for credits. Players may receive credits on a timed basis, or may purchase a buy-in of credits. Players attempt to increase the amount of credits they have, or attempt to increase the amount of time they play before the credits run out. In a pari-mutuel game, players, play for cash/money or credits. Payout odds for left card bets, tie bets, and right card bets are determined by the pari-mutuel odds in proportion to the amount of cash or credits bet on each of the three winning possibilities, after deducting a vigorish, taxes, and other expenses. In a tournament game, tournaments create a way for players to raise money for the charities and causes of their choice. Tournament players buy-in with cash, such as money or payments with a payment card, and receive credits to be used to play in the specific tournament that a sponsor has set up with a buy-in price, credits per buy-in, optionally turns per buy-in, the number of buy-ins permitted, the length of time of the specific tournament, the start time, a credit goal amount needed to win the tournament, the minimum percentage of the winners prizes that will be donated to the charity or cause, and the name of the charity or cause that is being sponsored by the tournament.

Figure 20:
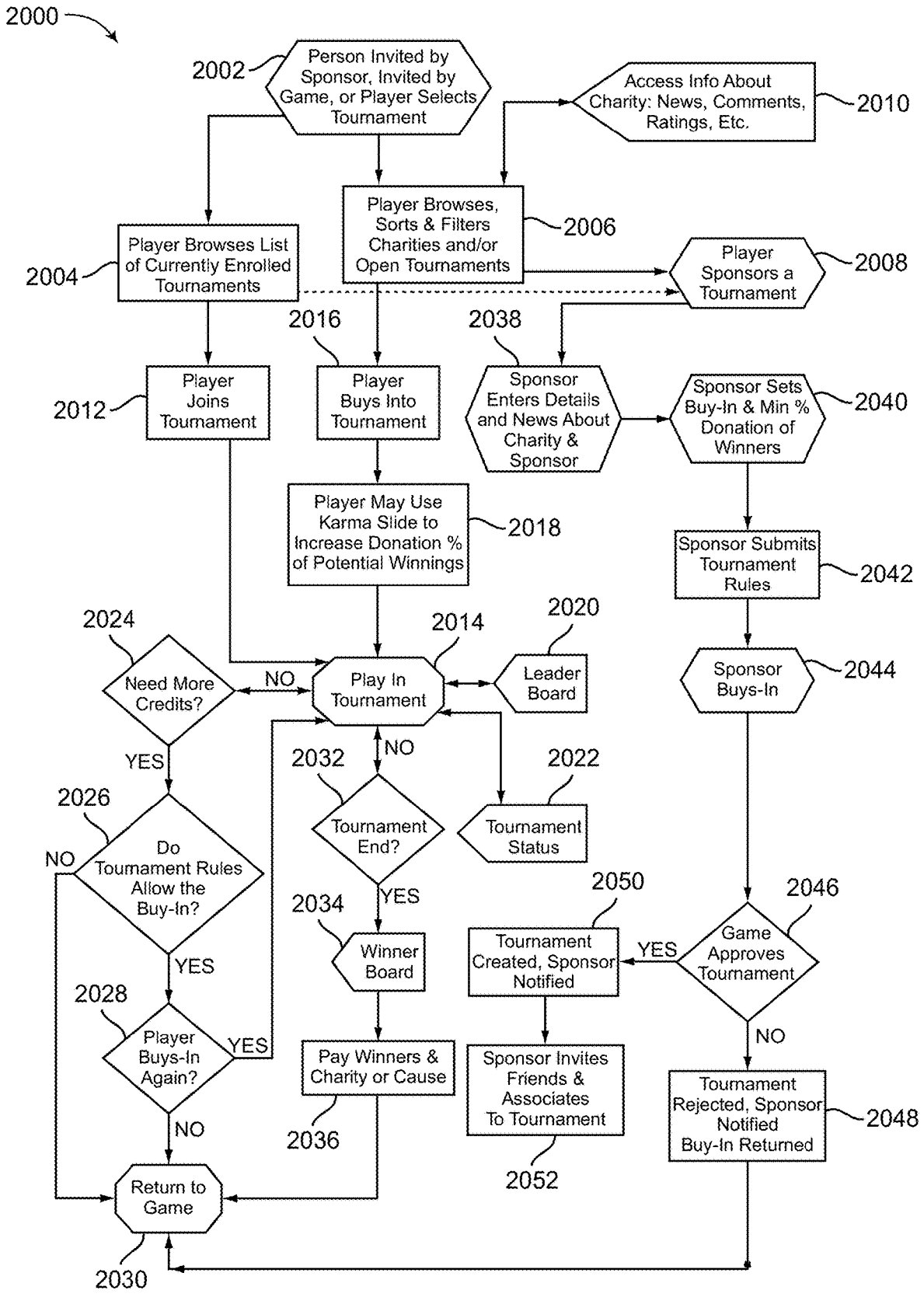
FIG. 20 illustrates a tournament processing flowchart.
Figure 21:
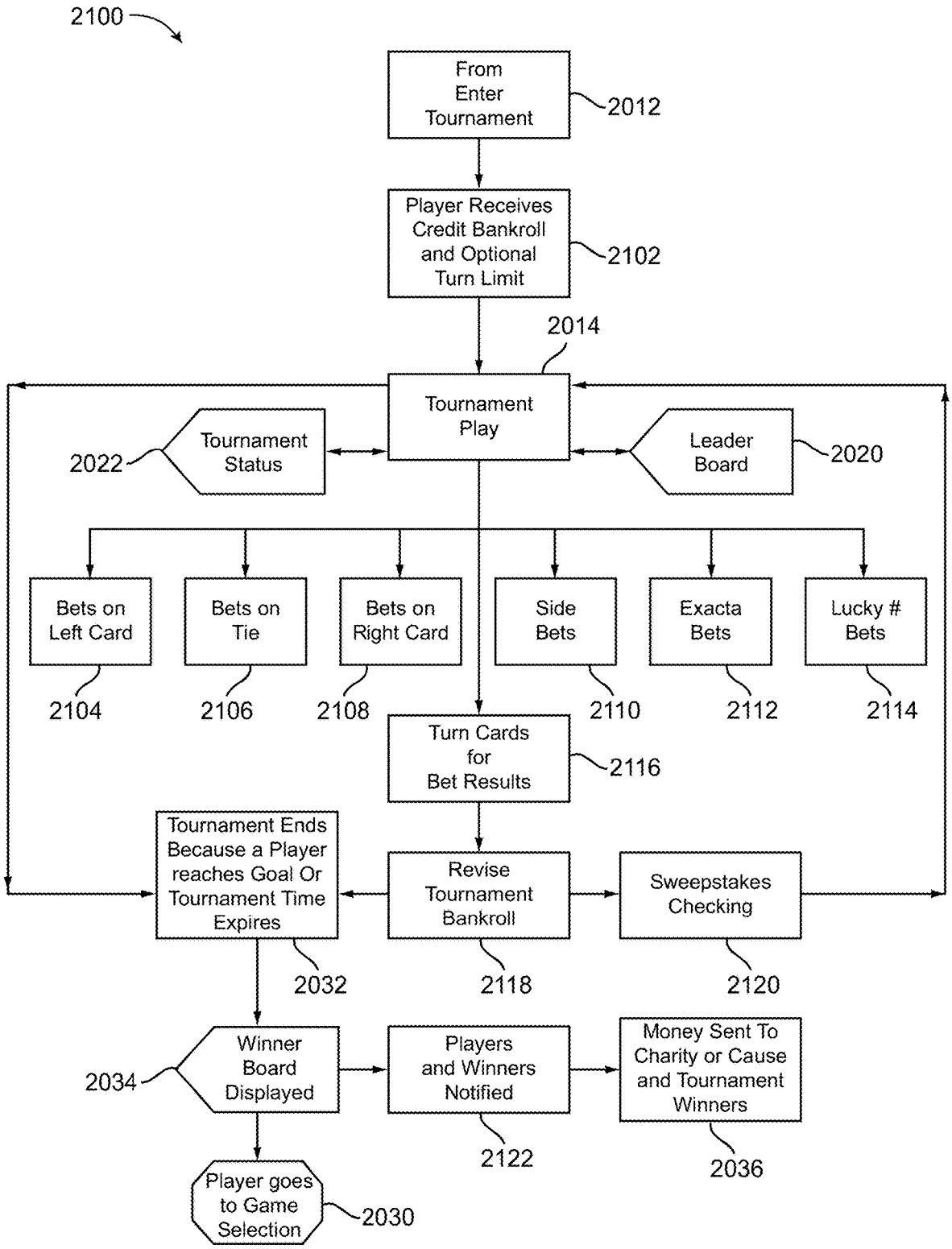
FIG. 21 illustrates a tournament play processing flowchart.

In an example embodiment, a tournament rule may be that the sponsor must be the first player to buy-in to the tournament. A flowchart of the steps of sponsoring a tournament are shown in FIG. 24. To join a tournament, players must buy-in to the tournament, at which time they may increase the percentage of the winnings that player will donate to the charity or cause being sponsored, above the minimum, if that player is a winner of that tournament. A flowchart of the steps of joining a tournament are shown in FIG. 23. Players place bets and try to increase their tournament credit bankroll to reach or surpass a set goal amount, as shown in FIG. 16. Tournaments end when either a player has reached the specified goal amount of the tournament, or the duration of the tournament has timed out. FIGS. 20-21 are flowcharts of the tournament system and tournament play, respectively.

Figure 37:
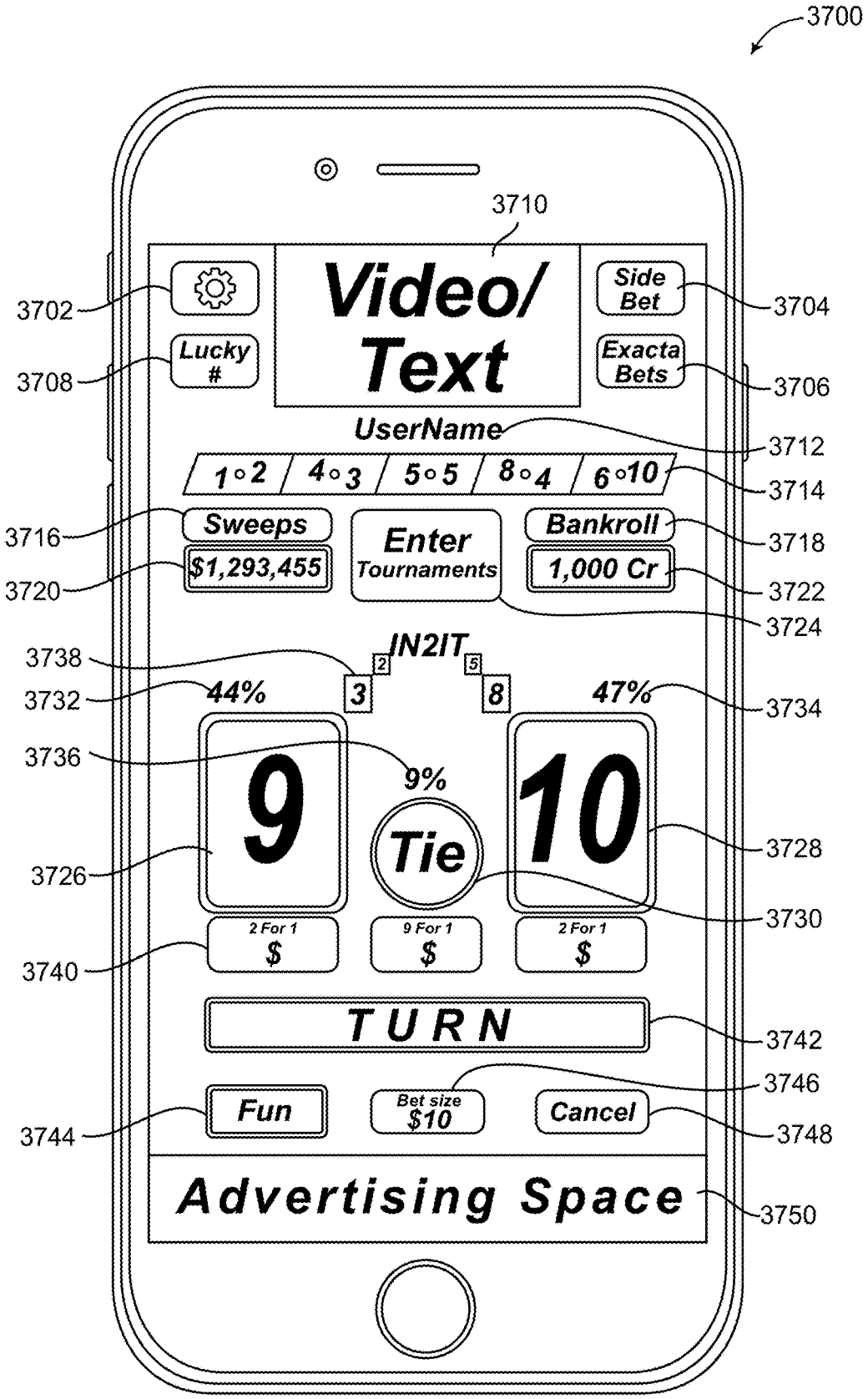
FIG. 37 illustrates an interface of a cellphone-based game.

Referring again to FIG. 1, such accessing of processes from the main game screen in steps 112-134 involves a player actuating or clicking a region on the main game screen, such as an icon or a labeled screen region. For example, as shown in FIG. 37, the user computer 18 is a cellphone displaying the main game screen 3700 having a plurality of actuatable icons. A settings icon 3702 is actuated for accessing a settings menu or screen to allow the player to control settings of the cellphone such as screen colors, volume, etc. The screen 3700 also shows an icon 3742 labeled "TURN" which, when actuated, turns the cards over, using the menu options in step 110 and processed using the flowcharts in FIGS. 3 and 27.

As shown in FIGS. 32-42, 44, the games described herein generally involve two "cards", either physical cards or electronically-displayed regions of an electronic interface simulating physical cards with a left side card, a right side card, and a tie indicator. The left side card may have a top view with an "L" in a generally rectangular box, the right side card may have a top view with an "R" in a generally rectangular box, and the tie indicator may have a top view with an "T" in a pad or region. In a preferred embodiment, the cards are two-sided cards, with numbers on both the top and bottom of each card.

During play, such as during a current round of play, players may purchase or receive cash or credit buy-ins. The buy-ins are credited to an appropriate game bankroll associated with a respective player, which is used to fund the bets of the player. Two cards are dealt by the dealer or computer, and players can bet on such cards. There are numbers on both sides of each card. Players may place bets on the following outcomes: left card wins, right card wins, or tie wins. There is also a variety of additional bets players may make, including: a side bet, which is a bet that a specific number appears on one of the cards after the cards are turned over, as described in FIG. 10; an exacta bet, which is a bet that one or more specific pairs of numbers are visible on the cards after the cards are turned over, as described in FIG. 11; and lucky number (#) bet, which a bet that a random "lucky" number will be visible on the cards after the cards are turned over, as described in FIG. 12.

If the cancel button is clicked in step 108 before the cards are turned over, all of the current bets of the player are cancelled. When the turn button is clicked in step 110, the bets are locked, the cards are turned over, and the numbers on the bottom faces of the cards are revealed. These newly visible numbers determine whether bets on the left or right card or the tie wins. In the preferred embodiment, when electronic cards are used, the bottom card numbers are not sent to the user computer 18 from the game server 30 until after the turn button is clicked in step 110, which helps prevent players from being able to cheat. If physical cards are used, a dealer signals the end of the betting period, then turns the cards over, revealing the winning card or a tie situation. The winning card is determined after the player selects either the left card or the right card as having the larger of two numbers on a bottom view of the cards, or the player selects the tie indicator to choose that the two numbers on the bottom view are identical. The round ends with the cards turned over and compared. In the example of physical cards, as shown in FIGS. 32-35 and 44, the physical two-sided cards are positioned so that the bottom faces are hidden from all players and after players place bets, for example on bet pads as described in FIG. 47, the two-sided cards are turned over to reveal the higher face or a tie. In the example of electronic cards, as shown in FIGS. 36-42, a pair of top-face images are displayed on the left and right, respectively, of the tie indicator, as images of numbers representing "top-card faces", before they are turned over to reveal the winner. In either case, after the cards are turned over losing bets are collected and winning bets are paid, as described in FIGS. 13-17. The outcomes of a predetermined number of previous turns are shown on an outcome strip associated with a player, as shown in the interface in FIG. 37. If clicked, the outcome strip can be scrolled to view many previous outcomes which implements step 118.

Players automatically enter several free sweepstakes at least once a day that they play and with each bet. At the conclusion of each turn, the visible numbers on the outcome strip associated with a player are checked in groups to see if any of these number combinations match up with winning sequences stored in the game server 30. If there is a match, the player will be notified of the win, and a certificate of this win will be stored in a sweepstakes vault associated with the player, as described in FIGS. 4-5.

Golden tickets are used to enter various drawings for prizes. Golden tickets may be awarded to players as bonuses, for fulfilling certain goals in the fantasy version of the game, or for other reasons. Golden tickets are saved in the sweepstakes vault associated with a player. One or more golden tickets may be used to enter a variety of scheduled drawings with known and/or unknown prizes. Players may access their sweepstakes wins and golden tickets in the sweepstakes vault associated with the player, as shown in FIG. 18. Some golden tickets and some coupons and bonuses may have an expiration date or time.

Referring to FIG. 9, the player can click a Bet Size button to change the bet size. Also, referring to FIG. 37, the player may choose to replace a card on the left or right side, as in step 124, by clicking the left or right queue of cards. The player may bet on the left, tie or right cards, as in step 106 by clicking the matching tie indicator or respective card. Referring to FIGS. 10 and 37, the player may click the Side Bet button, then bet that a specific number will appear on one card, either left or right, after the cards have been turned. Alternatively, referring to FIGS. 11 and 37, the player may click the exacta bet button, then bet that a specific pair of numbers will appear after the cards have been turned, and multiple pairs of numbers may be selected. Referring to FIGS. 12 and 37, the player may click the lucky number button to obtain a lucky set of numbers, with the option to bet on the lucky numbers. Referring to FIGS. 13-17 and 37, the player may open the Bankroll by clicking the bankroll button. The player may click the outcome strip, as shown in FIG. 37, which allows the player to scroll through the last 100+ turns, to examine outcome history and percentages as in step 118 in FIG. 1.

Referring to FIGS. 18 and 37, the player may click the Sweepstakes Vault to look at prizes won. Players may select and activate prizes in the Sweepstakes Vault prize for example by transferring money to the plater's bankroll or payment (credit) card, transferring the contents of a coupon to a smartphone for use online or in a store or restaurant, or player may delete non-monetary prizes from the Sweepstake Vault. Referring to FIG. 19, the player may click the Video button to interactively communicate with other players and with non-players while playing the game, share their game screen with others, watch another player's game screen and/or interact with an operating company via video, voice, and/or text, etc.

Figure 3:
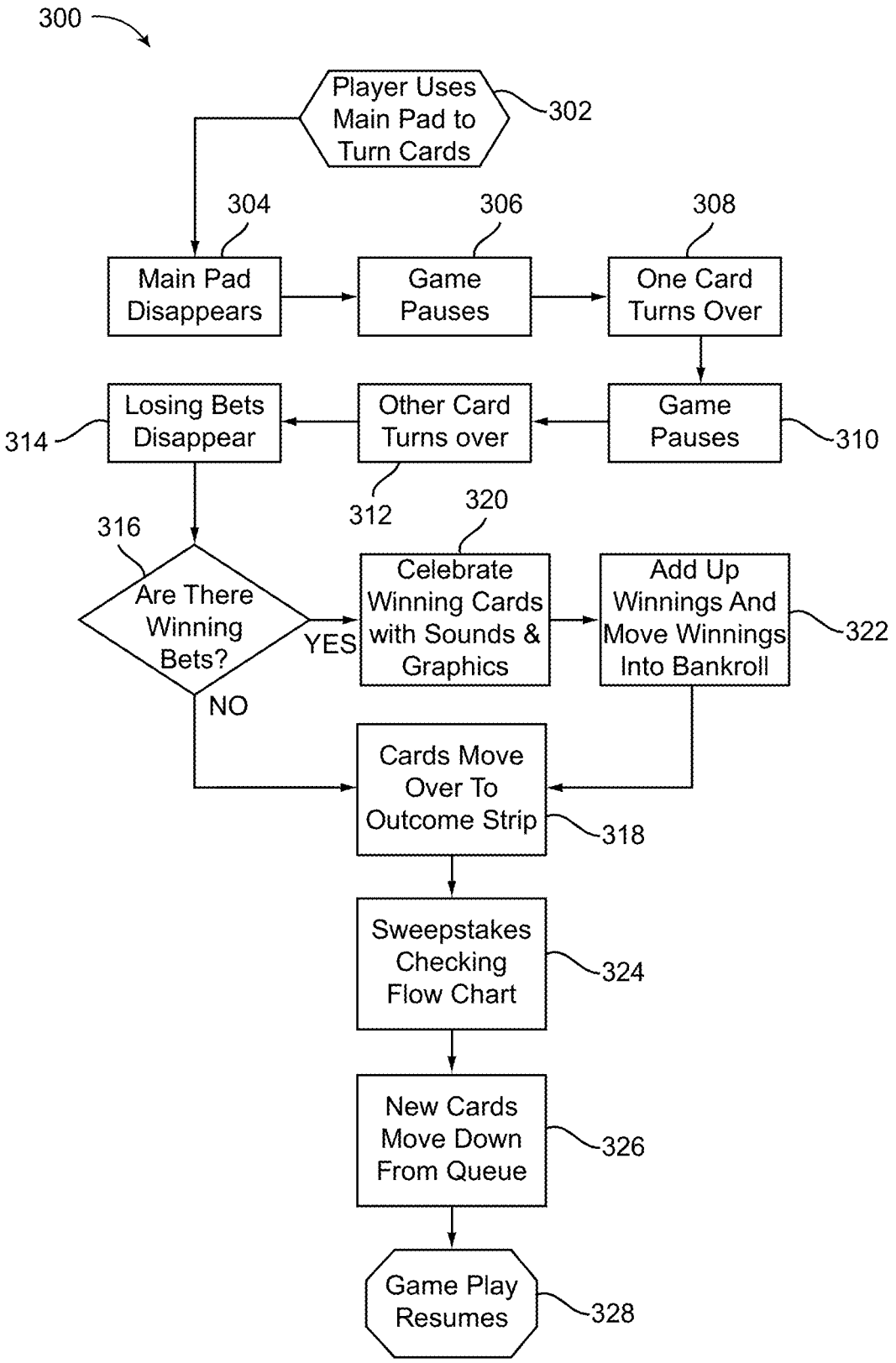
FIG. 3 illustrates a card turning processing flowchart.

Referring to FIGS. 20 and 37, the player may click Enter Tournaments button to enter the Tournament system. A player may choose to join a tournament, which sponsors a charity or cause that the player wishes to support, or a player may sponsor a tournament that will benefit a charity or cause chosen by the sponsoring player. Referring to FIG. 25, the player may click the Main Menu to display further options. Referring to FIGS. 3 and 37, if bets have been placed as determined in step 104, the player has two additional options: a player may click the Cancel button in step 108 to clear all placed bets before the Turn icon is clicked, and a player may click the Turn icon in step 110 to initiate the card turning sequence. Referring to FIGS. 14-17 and 20, different games may be selected and played in step 134.

Figure 2:
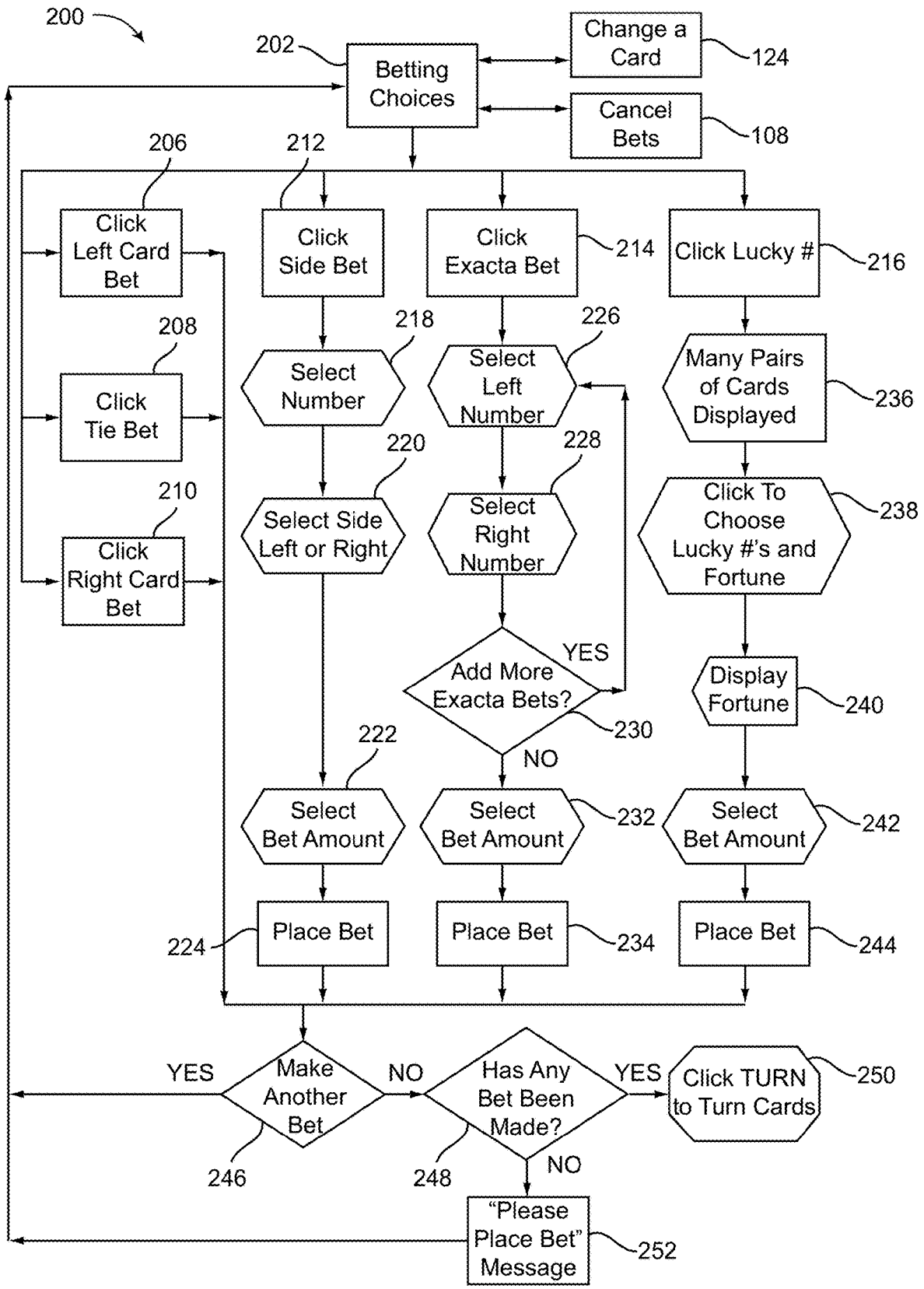
FIG. 2 illustrates a bet processing flowchart.

FIG. 2 illustrates a bet processing flowchart 200 for performing step 106. As shown in FIG. 2, betting choices appear on the game screen in step 202, allowing the player to click the option to change a card that is displayed in step 124, such that a new card replaces the original card. At step 202, the player may use this option a limited number of times. Alternatively, the player may click on a cancel icon to cancel all current bets in step 108.

Figure 47:
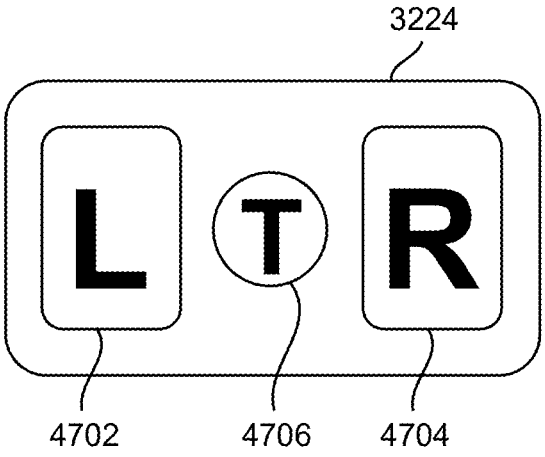
FIG. 47 is a top plan view of a betting pad.

The player may bet on the left card in step 206, the tie indicator in step 208, or the right card in step 210, as shown in FIGS. 37 and 47, by clicking the appropriate pad or card. A predetermined bet size amount is added to each bet with each click or tap of the cards or tie indicator. The player may click a side bet icon in step 212, an exacta bet icon in step 214, or a lucky number icon in step 216. The side bet is a bet on a number that may appear on either of the selected left or right side, as described with reference to FIG. 10. After step 212, the player selects a number in step 218, selects either the left side number or the right side number in step 220, selects a bet amount in step 222, and places a bet in step 224.

Placing an exacta bet places a bet on an exact left/right pair of numbers. After step 214, the player selects a left number in step 226, selects a right side number in step 228, and then the player selects whether to add more exacta bets in step 230. If so, the method loops back to step 226. Otherwise, if the player does not want to add more exacta bets in step 230, the player selects a bet amount in step 232, and places a bet in step 234. The player may click multiple pairs of numbers, up to a predetermined limit, if desired. The bet size can be adjusted before the pop-up window closes. Exacta betting is described with reference to FIG. 11.

Placing a lucky number bet causes a continual flood of cards to appear on the screen, such as the interface 3700 in FIG. 37, in a pop-up window. After step 216, a flood of many pairs of cards are displayed in step 236, and the player clicks to stop the flood in step 238 in order to display two lucky numbers and a related fortune which appear when the flood is stopped. The player can then decide to bet on such displayed numbers, if desired, by selecting a bet amount in step 242. The player then places a bet in step 244. Bet size can be adjusted before the pop-up window closes. Lucky number betting is described with reference to FIG. 12.

After steps 224, 234, and 244, the method then proceeds to step 246 to check if the player wants to make another bet. If so, the method loops back to step 202. Otherwise, the method proceeds to step 248 to determine if any bet has been made. If so, the method waits for the player to click the turn icon to turn the cards in step 250, and then to perform step 110, as well as the method in FIG. 3. The option to turn cards does not appear until a bet has been placed. However, in step 248, if no bet has been made, the method proceeds to step 252 to display a "Please Place Bet" message on the interface such as the interface 3700 shown in FIG. 37, and the method loops back to step 202.

FIG. 3 illustrates a card turning processing flowchart, in which the player initiates the turning over of the physical or electronic cards in step 110 by clicking the turn icon or pad in step 250. After bets are placed as determined in step 248 of FIG. 2, the player uses the main turn icon or pad, labeled, for example, "TURN", in step 302 by clicking or otherwise actuating the main turn icon or pad. After actuation in step 302, the main turn icon or pad disappears from the interface, such as the interface 3700 in FIG. 37, in step 304, and the game pauses in step 306. Then one card is turned over in step 308, such as either the left card or the right card to reveal the number on the back side of the turned-over card, and the game again pauses in step 310. Then the other card is turned over in step 312 to reveal the other number on the back-side of the second turn-over card, and losing bets disappear from the interface 3700 in step 314. After step 314, any winning bets are sequentially processed.

First, the method 300 checks if there are any winning bets in step 316. If not, the method proceeds to step 318 to move the played and turned-over cards and/or card numbers to the outcome strip shown in FIG. 37. The cards on the outcome strip move downward on the interface 3700, leaving a space for the next set of cards. However, if there are winning bets in step 316, the win with the winning cards is celebrated with sounds and graphics through the interface 3700 in step 320. The method then adds up winnings of the player in step 322, with such winnings added to the original bet, and the total winnings are added to the bankroll associated with the player, and the revised bankroll amount is moved up to the bankroll displayed on the interface 3700 and associated with the player. The method then proceeds to step 318. After step 318, the outcome strip is scanned in step 324 for any winning numbers using sweepstakes checking described with reference to FIG. 4, and then new cards are moved down from a queue of non-played cards in step 326. Then game play resumes in step 328 by displaying the main game screen in step 102.

FIG. 4 illustrates a sweepstakes processing flowchart 400, which is processed in step 324 to check for any sweepstakes winning sequences after each turning of the cards, that is, after step 318. From the gameplay in step 402, the method 400 determines a top two outcome strip numbers highlit/highlighted in step 404, and then the number sequence is sent to the game server 30 in step 406. The method 400 then checks in step 408 if any numbers match a winning number sequence, which are stored in the game server 30, which may be off-site from the user computer 18 and from the web server 12, and which may be referred to as a "Sweepstakes" server. There may be multiple sequences of winning numbers stored in the game server 30. Certain categories of players, based upon location, betting history or other criteria may have access to certain sequences of winning numbers and not to others sequences. If there is no match, the method 400 proceeds to step 414. Otherwise, the game server 30 returns with information about a winning prize in step 410, and a sweepstakes winning sequence is performed on the lowest, least recent, visible outcomes in step 412. Then the method proceeds to step 414.

In step 414, the method 400 determines a bottom four outcome strip numbers highlit/highlighted, and then the number sequence is sent to the game server 30 in step 416. The method 400 then checks in step 418 if any numbers match a winning number sequence stored in the game server 30. If there is no match, the method 400 proceeds to step 424. Otherwise, the game server 30 returns with information about a winning prize in step 420, and a sweepstakes winning sequence is performed in step 422. Then the method proceeds to step 424.

In step 424, the method 400 determines a bottom six outcome strip numbers highlit/highlighted, and then the number sequence is sent to the game server 30 in step 426. The method 400 then checks in step 428 if any numbers match a winning number sequence stored in the game server 30. If there is no match, the method 400 proceeds to step 434. Otherwise, the game server 30 returns with information about a winning prize in step 430, and a sweepstakes winning sequence is performed in step 432. Then the method proceeds to step 434.

In step 434, the method 400 determines a bottom eight outcome strip numbers highlit/highlighted, and then the number sequence is sent to the game server 30 in step 436. The method 400 then checks in step 438 if any numbers match a winning number sequence stored in the game server 30. If there is no match, the method 400 proceeds to step 444. Otherwise, the game server 30 returns with information about a winning prize in step 440, and a sweepstakes winning sequence is performed in step 442. Then the method proceeds to step 444.

In step 444, the method 400 determines a bottom ten outcome strip numbers highlit/highlighted, which may be all of the numbers in the outcome strip, and then the number sequence is sent to the game server 30 in step 446. The method 400 then checks in step 448 if any numbers match a winning number sequence stored in the game server 30. If there is no match, the method 400 proceeds to step 454 to return to the game. Otherwise, the game server 30 returns with information about a winning prize in step 450, and a sweepstakes winning sequence is performed in step 452. Then the method proceeds to step 454. More than 10 sequences are possible.

FIG. 5 illustrates a sweepstakes winning flowchart 500, which is performed for implementing steps 412, 422, 432, 442, 452 in FIG. 4. The method 500 starts in step 502, and processes a sweepstakes win in step 504 by notifying the winning player visually and/or auditorily with appropriate messages and/or sounds through the interface, such as the interface 3700. The method 500 then checks in step 506 whether the currently evaluated sweepstakes is a cash sweepstakes. If so, the method 500 proceeds to step 508; otherwise, the method proceeds to step 510. In step 508, a referring player is paid a predetermined percentage or amount, such as 10%, of the cash sweepstakes of the winning player. The winning player then selects one of a number of cash prize options in step 512, such as adding a portion or all of the cash prize to the bankroll of the winning player in step 514, crediting a portion or all of the cash prize to an account of the winning player in step 516, or sending a portion or all of the cash prize to a sweepstakes vault associated with the winning player in step 518. The method 500 then returns in step 520 to perform steps 414, 424, 434, or 444 in FIG. 4 to conduct sweepstakes checking.

However, if the sweepstakes is not a cash sweepstakes as checked in step 506, the method 500 allows the winning player to select one of a number of non-cash prize options in step 510, such as having the winning player delete or turn down a prize in step 522, sending the prize to a sweepstakes vault associated with the winning player in step 524 with the transfer being by display on the player's smartphone and/or communication device and/or text, E-mail, or other means of communication to be redeemed elsewhere, or having the winning player use a prize immediately in step 526. For example, the prize could be a promotional code, a coupon, or rebate for a product or service, which can be transferred or saved for later redemption. Alternatively, the prize could be a media file such as a blue ribbon image, a sample of music, an unlocked achievement message, or other types of media. The method 500 then returns in step 520 to perform steps 414, 424, 434, or 444 in FIG. 4 to conduct sweepstakes checking.

Figure 6:
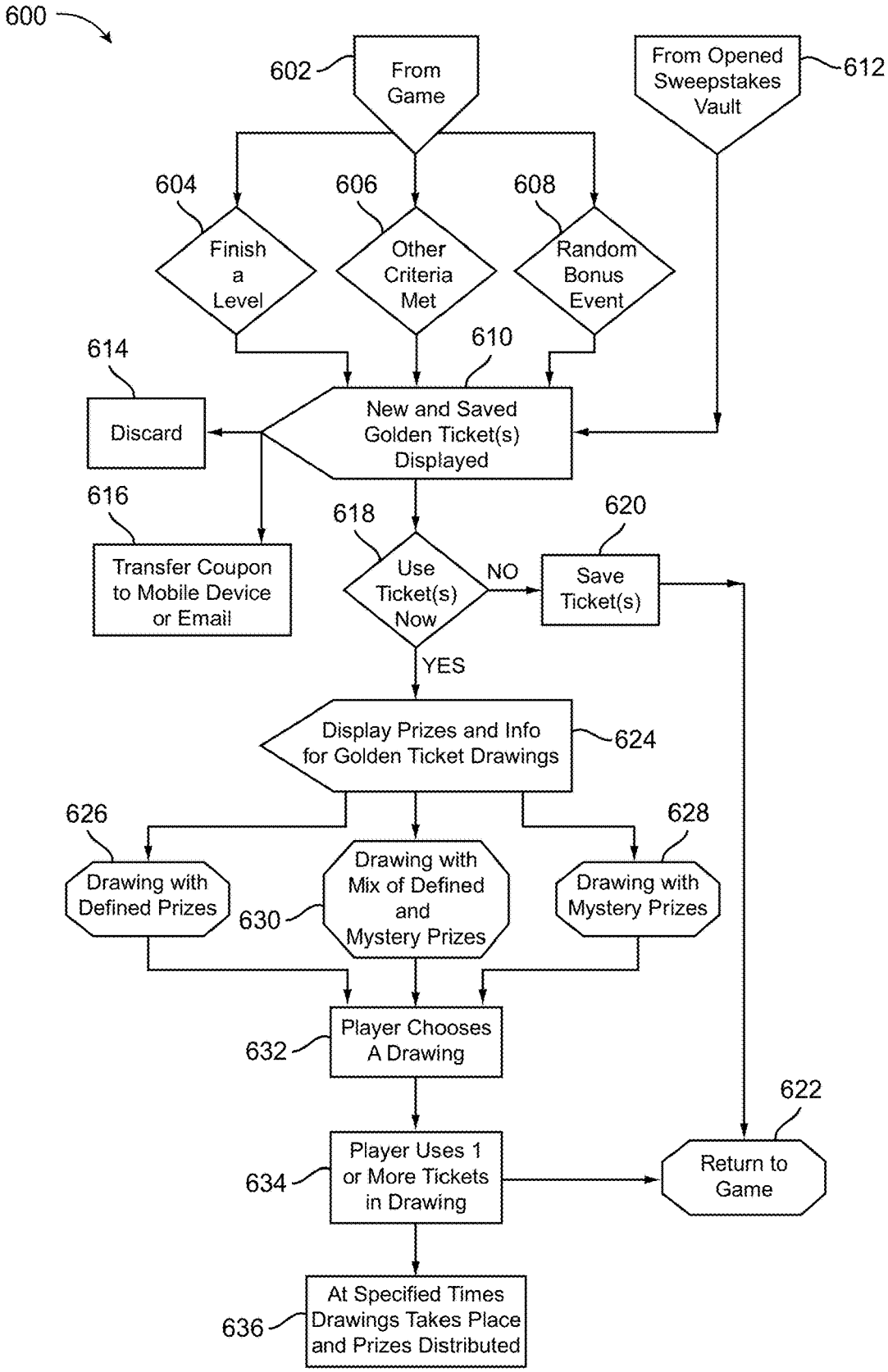
FIG. 6 illustrates a golden tickets processing flowchart.

FIG. 6 illustrates a golden tickets processing flowchart 600, by which a golden ticket may be awarded at any time or upon the player reaching a milestone or achievement. The system 10 or portions thereof, such as the game server 30, continually monitor games for players reaching a milestone or achievement in step 602, such as when a player finishes a game level, such as a level in a fantasy game, in step 604; other criteria are met which merit a bonus in step 606; or a random bonus event occurs in step 608. After steps 604, 606, and 608, a golden ticket is awarded to the receiving player, and the newly awarded golden ticket is displayed to the player in step 610 through the interface 3700. Alternatively or in addition, a player may, at any time, open a sweepstakes vault associated with the player, and any saved, and unexpired, golden tickets are displayed to the player in step 610 through the interface 3700. The player may then discard one or more golden tickets in step 614. Alternatively or in addition, the player may transfer one or more golden tickets as a prize or coupon to another device, such as a mobile device, or transfer to another entity via E-mail in step 616. Alternatively or in addition, the player is given a choice in step 618 to use one or more golden tickets immediately. If the player does not want to use one or more tickets in step 618, the player may save the one or more tickets in a sweepstakes vault in step 620, and return to the game in step 622. Otherwise, if the player uses one or more tickets immediately in step 618, the system 10 displays the prizes and/or information about drawings associated with the golden tickets in step 624.

The method 600 then conducts a drawing for defined prizes in step 626, for mystery prizes in step 628, or for a mix of defined prized and mystery prizes in step 630. The player chooses a drawing in step 632, and the player uses one or more golden tickets in step 623 to be applied to to the drawing. Once used, the golden tickets are removed from the sweepstakes vault of the player. The method 600 then returns to the game in step 622, and at later specified times, drawings take place involving the randomized Golden tickets of all players who have entered the specific drawing, and prizes are awarded and distributed to winning players in step 636.

FIG. 7 illustrates a game data flowchart 700 for random odds, which shows communications between a local device, such as the user computer 18 used by a player, and the off-site game server 30. Such communications are represented by the dotted line 702, and are performed over the network 30, such as through the Internet, and may include cloud-based communications. A player initiates gameplay to play a game by registering in some manner with the game server 30, such as by inserting an identification (ID) card into a physical device, described below; or by opening an application, app, or applet; or by going to a website, via a phone, cellphone, smartphone, personal computer (PC), laptop, or tablet; and then by logging into a game in step 704. Such insertion and reading of identification, opening an application, app, or applet, or going to a website in step 704 generates login information such as ID information of the player, location information of the player, the time and/or date associated with the player, etc., and the login information is sent from the user computer 18 of the player, as a local game device, to the game server 30 which receives such login information in step 706. The local game device deals two cards from a queue associated with the player, and the card deal data, which includes data of the tops of the cards, is sent to the game server 30 in step 708.

The game server 30 sends the received tops of the cards to a queue, and the tops of cards in the queue are replenished as necessary in step 706. The game server 30 then generates and assigns random bottom numbers to the bottoms of the cards before the cards are turned over, the top and bottom numbers are then saved with other information including a time/date and security codes in step 710, which are recorded to a log to ensure validity of the numbers associated with the cards.

In step 712, the player may request a change of a card, up to a preset limit per deal, which is checked in step 714. If a card change is permitted, the discarded card is sent to the game server 30 in step 712. If the number of requests to change a card is greater than or equal to a predetermined maximum, such as four requested changes per card turn, as determined in step 714, an error message is generated and displayed in step 716, and no change in cards is performed. Otherwise, in step 714, if the number of card change requests is les than the predetermined maximum, the game server 30 receives the discarded card, which is saved in a discarded card record in step 718. The game server 30 then generates a new bottom card, which is saved with time/date information and security codes in step 720. Note that, at this stage, the game server 30 does not send the new bottom number of the card to the local game device, so the player and the local game device does not know the bottom number at this time.

Bets are placed, as desired, by the player in step 722. Once the turn icon, pad, or bar, as shown in FIG. 37, has been clicked in step 724, all options are locked, and the local game device sends a turn event notification and all betting information to the game server 30 in step 726. The game server 30 processes any bets and other information in step 728, and retrieves the saved card numbers, including bottom card numbers, in step 730. The game server 30 also checks the outcome list for possible sweepstakes wins in step 732, and sends the bottom card numbers and any sweepstakes and golden ticket winning information to the local game device of the player in step 734. The cards are turned over in step 736 as shown on the interface 3700, with the bottoms of the cards being displayed in step 738. The local game device of the player determines in step 740 if the player wins the turn or round. If not, the local game device proceeds to step 742. Otherwise, the local game device notifies the player of the winning of the turn or round in step 744, and the bankroll of the player is increased accordingly in step 746. The local game device proceeds to step 742 to send the turned-over cards to the outcome list, and to check for any wins from sweepstakes as well as any wins from golden tickets. If the player wins a sweepstakes as determined in step 748, the local game device notifies the player of the sweepstakes win in step 750. Then the method 700 loops back to step 708. In addition, after step 742, if the player wins a golden ticket in step 752, the local game device notifies the player of the golden ticket win in step 754, and the method 700 loops back to step 708. If there are no sweepstakes wins or golden ticket wins in steps 748, 752, respectively, then the method 700 loops back to step 708.

FIG. 8 illustrates a game data flowchart 800 for set odds, which shows communications between a local device, such as the user computer 18 used by a player, and the off-site game server 30. Such communications are represented by the dotted line 802, and are performed over the network 30, such as through the Internet, and may include cloud-based communications. A player initiates gameplay to play a game by registering in some manner with the game server 30, such as by inserting an identification (ID) card into a physical device, described below; or by opening an application, app, or applet; or by going to a website, via a phone, cellphone, smartphone, personal computer (PC), laptop, or tablet; and then by logging into a game in step 804. Such insertion and reading of identification, opening an application, app, or applet, or going to a website in step 804 generates login information such as ID information of the player, location information of the player, the time and/or date associated with the player, etc., and the login information is sent from the user computer 18 of the player, as a local game device, to the game server 30 which receives such login information in step 806. The local game device deals two cards from a queue associated with the player, and the card deal data, which includes data of the tops of the cards, is sent to the game server 30 in step 808.

The game server 30 sends the received tops of the cards to a queue, and the tops of cards in the queue are replenished as necessary in step 806. The game server 30 then saves the top card numbers with other information including a time/date and security codes in step 810, which are recorded to a log to ensure validity of the numbers associated with the cards.

In step 812, the player may request a change of a card, up to a preset limit of deals per card turn, which is checked in step 814. If a card change is permitted, the discarded card is sent to the game server 30 in step 812. If the number of requests to change a card is greater than or equal to a predetermined maximum, such as four requested changes, as determined in step 814, an error message is generated and displayed in step 816, and no change in cards is performed. Otherwise, in step 814, if the number of card change requests is less than the predetermined maximum, the game server 30 receives the discarded card, which is saved in a discarded card record in step 818.

Bets are placed, as desired, by the player in step 822. Once the turn icon, pad, or bar, as shown in FIG. 37, has been clicked in step 824, all options are locked, and the local game device sends a turn event notification and betting and player information to the game server 30 in step 826. The game server 30 processes any bets and other information in step 828. The game server 30 then generates a random number and compares the random number to set odds to determine a win or a loss in step 830. For example, using a set odds algorithm, the odds can be set so that the player is likely to win 55% of the time. The game server 30 will then generate and assign bottom card numbers in step 831 to produce wins and loses which ensure the set odds probability outcome. By this method 800, the odds of winning can be set to be positive or negative for all players of a game during a period of time.

The game server 30 also checks the outcome list for possible sweepstakes wins in step 832, and sends the bottom card numbers and any sweepstakes and golden ticket winning information to the local game device of the player in step 834. The cards are turned over in step 836 as shown on the interface 3700, with the bottoms of the cards being displayed in step 838. The local game device of the player determines in step 840 if the player wins the turn or round. If not, the local game device proceeds to step 842. Otherwise, the local game device notifies the player of the winning of the turn or round in step 844, and the bankroll of the player is increased accordingly in step 846. The local game device proceeds to step 842 to send the turned-over cards to the outcome list, and to check for any wins from sweepstakes as well as any wins from golden tickets. If the player wins a sweepstakes as determined in step 848, the local game device notifies the player of the sweepstakes win in step 850. Then the method 800 loops back to step 808. In addition, after step 842, if the player wins a golden ticket in step 852, the local game device notifies the player of the golden ticket win in step 854, and the method 800 loops back to step 808. If there are no sweepstakes wins or golden ticket wins in steps 848, 852, respectively, then the method 800 loops back to step 808.

FIG. 9 illustrates a bet size processing flowchart 900, which is started when the player clicks the bet size option or icon from the main game screen in step 132. The bet size is the amount of a bet placed each time that a player clicks a betting option. In FIG. 9, the player selects a bet size in step 902, and a pop-up window is displayed on the interface 3700 in step 904 which shows all allowed bet sizes or ranges of allowed bet sizes, with the current bet size also being indicated. Bets larger than the bankroll of the player are disallowed. In step 906, the player can select a different range of bet sizes, and in step 908, the player chooses a bet size. When the player selects a bet size by clicking on a bet size in step 908, the bet size screen is closed and the local game device returns to the game in step 910.

FIG. 10 illustrates a side bet processing flowchart 1000, which is started in step 128 by clicking or tapping a side bet button in step 1002 from the main playing screen as shown in the interface 3700 in FIG. 37. A pop-up window or panel opens on the interface 3700 in step 1004 to reveal several options, which perform steps 1006, 1010, 1014, 1018, 1022, 1026, 1036. In step 1006, the player clicks or taps a number from a number pad, so that the chosen number is selected in step 1008, and the method loops back to step 1004. In step 1010, the player clicks or taps a left card, so that the left card is selected in step 1012, and the method loops back to step 1004. In step 1014, the player clicks or taps a right card, so that the right card is selected in step 1016, and the method loops back to step 1004. In step 1018, the player clicks or taps a less-than sign or a lesser amount, so that the bet amount is reduced in step 1020, and the method loops back to step 1004. In step 1022, the player clicks or taps a greater-than sign or a greater amount, so that the bet amount is increased in step 1024, and the method loops back to step 1004. In step 1026, the player clicks or taps a bet, and the method 1000 determines if a side and a number are selected in step 1028. If not, an error message is displayed to the player in step 1030, and the method loops back to step 1004. Otherwise, if a side and a number are selected in step 1028, the selections are saved in step 1032, and a side bet board, panel, or pop-up window showing the side bet options is closed and the method 1000 returns to the game in step 1034. In step 1036, the player clicks or taps an exit icon, and so any selections are discarded and no bets are placed in step 1038, and the method 1000 proceeds to step 1034.

FIG. 11 illustrates an exacta bet processing flowchart 1100, for performing step 130. First, the player clicks the exacta bet button on the interface 3700 in step 1102, and then the player chooses an exacta bet option in step 1104, such as choosing a left number in step 1106, choosing a right number in step 1108, choosing an amount in step 1110, clicking a pair of numbers on an exacta list in step 1112, and choosing to bet or to exit in step 1114. After step 1106, a number pad is displayed which displays the numbers 1 to 10 for selection of the left number by the player. If both the left and right numbers are not selected in step 1116, the method loops back to step 1104. Similarly, after step 1108, a number pad is displayed which displays the numbers 1 to 10 for selection of the right number by the player. If both of the left and right numbers are not selected in step 1118, the method loops back to step 1104. However, if both of the left and right numbers are selected in either of steps 1116, 1118, the method 1100 adds both of the left and right numbers to an exacta list in step 1120, and the method loops back to step 1104. If a player wishes to change either or both of the left and right numbers, the player can choose the exacta bet option in step 1104, and then can choose the left number and/or the right number in steps 1106, 1108 again to replace the selected number for replacement by clicking on the selected number, and then clicking on a different number. The method 1100 then loops back to step 1104.

If the player wishes to choose an amount in step 1110, the player chooses a lesser amount in step 1122, chooses to not change the amount in step 1124, or chooses a greater amount in step 1126. After steps 1122-1126, the method 1100 loops back to step 1104.

If a player wishes to delete a chosen left/right pair, the player clicks on the number pair on the exacta list in step 1112, and then the method 1100 deletes the selected pair in step 1128. The method 1100 then loops back to step 1104. A limited number of left/right pairs can be selected. As more pairs are selected, the odds change and are redisplayed. After the maximum limit of pairs is reached, no further number selections are allowed.

Once a bet is established, the player has the option in step 1114 to place the exacta bet in step 1130, or the player may exit without placing any bet in step 1132. After step 1130, the method 1100 checks if the exacta list has any members in step 1134. If not, an error message is displayed to the player in step 1136, and the method 1100 loops back to step 1104. Otherwise, in step 1134, if the exacta list has members, the selected pairs of numbers are saved in step 1138, and the exacta board or GUI is closed and the method 1100 returns to the game in step 1140. Referring back to step 1132, if the player has chosen to exit without placing any bet, the method 1100 proceeds to step 1140 to close the exacta board or GUI and to return to the game.

FIG. 12 illustrates a lucky number bet processing flowchart 1200 to implement step 114. The method 1200 starts with the player clicking the lucky number bet button in step 1202, as shown in the interface 3700 in FIG. 37; generating and displaying a continual flood of cards in step 1204; and then receiving a selection by the player who clicks on the screen to stop the flood and to select a pair of two-sided cards in step 1206. Then in step 1208, the selected pair of cards are turned over to reveal the serendipitous lucky number of the player and any associated fortune presented to the player for enjoyment purposes. The player then chooses in step 1210 to bet on these now-visible numbers or to exits. If the player chooses to bet, the betting is performed in step 1212, with the bet size being adjustable as described above. Otherwise, the player chooses to exit, and the method 1200 exits in step 1214. A lucky number bet may have a large payoff, such as 80 to 1 odds.

The player also has access to a bankroll associated with the player, with such a bankroll being processed differently for the different types of games: cash, fantasy, fun, pari-mutuel, and tournament. A bankroll can be clicked on at any time through a bankroll icon on the interface 3700. Optionally, the bankroll opens automatically if a player has insufficient cash or credit to make a bet.

FIG. 13 illustrates a cash bankroll processing flowchart 1300 to implement step 126 for a cash game. The method 1300 starts when either the player has run out of cash in step 1302, or the player clicks a bankroll icon, such as shown in the interface 3700 in FIG. 37, for accessing a bankroll vault in step 1304. After either of steps 1302 or 1304, the method 1300 proceeds to step 1306 to display bankroll options, including proceeding to select a game in step 1308, to add to a bankroll in step 1310, to deduct from a bankroll in step 1312, or to close a bankroll in step 1314. After closing a bankroll in step 1314, the method 1300 returns to the game in step 1316. Referring back to step 1310, after selecting to add to the bankroll, the player selects an amount in step 1318, and either the amount is paid from a payment card account in step 1320 or is paid from a sweepstakes vault in step 1322. After either of steps 1320 or 1322, the method 1300 proceeds to close the bankroll in step 1314, and return to the game in step 1316. Referring back to step 1312, after selecting to deduct from the bankroll, the player selects an amount in step 1324, and either the amount is paid from a payment card account in step 1326 or is paid from a sweepstakes vault in step 1328. After either of steps 1326 or 1328, the method 1300 proceeds to close the bankroll in step 1314, and return to the game in step 1316.

Figure 14:
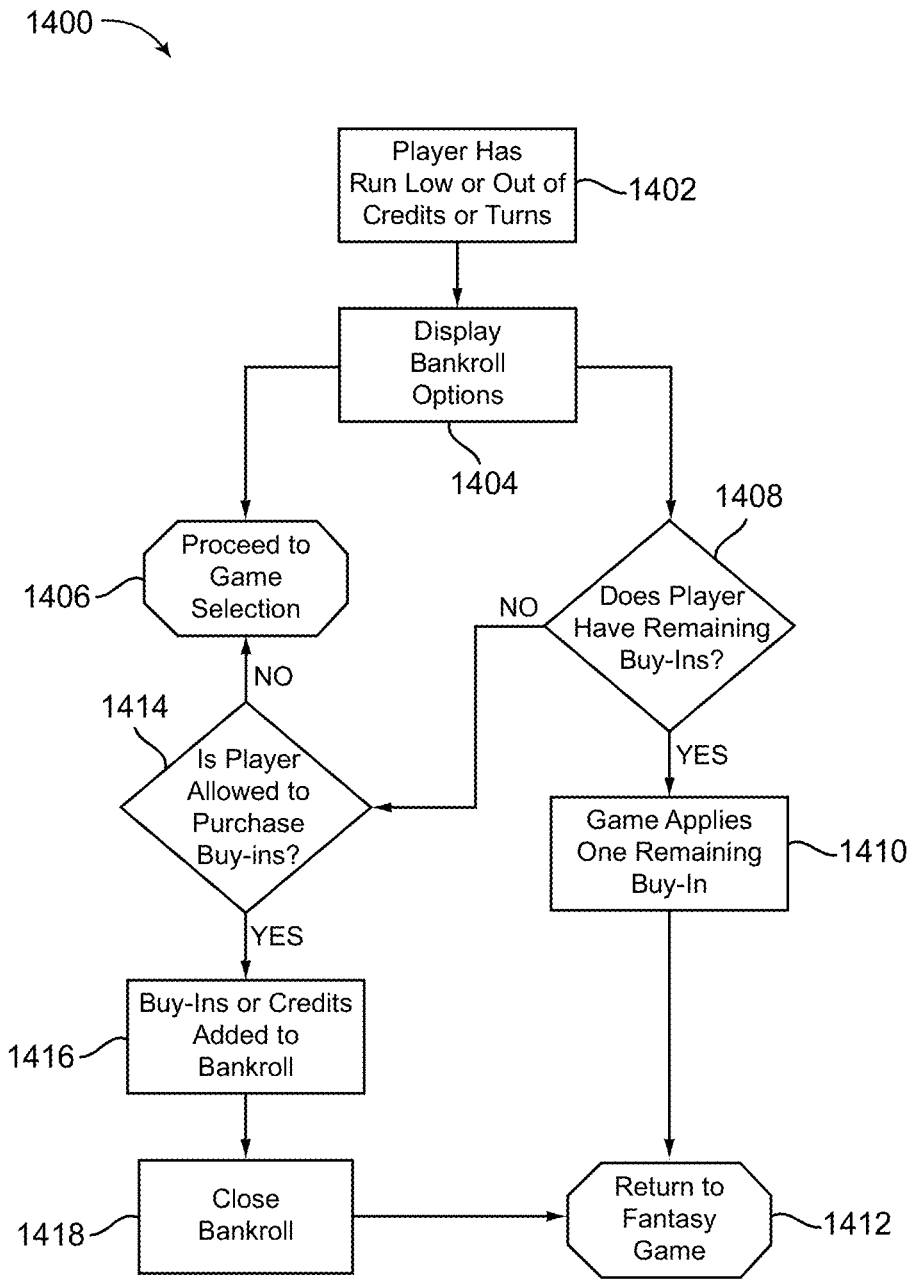
FIG. 14 illustrates a fantasy bankroll processing flowchart.

FIG. 14 illustrates a fantasy bankroll processing flowchart 1400, which starts when a player has run low or out of credits or allotted turns in step 1402, or when the player clicks a bankroll icon, such as shown in the interface 3700 in FIG. 37. Then bankroll options are displayed in step 1404, including either selecting a game in step 1406, or checking in step 1408 if a player has any remaining buy-ins. If so, the game automatically applies one remaining buy-in to set the bankroll and the number of turns in step 1410 to values specified for a particular fantasy game level. The method 1400 then returns to the fantasy game in step 1412. However, if the player does not have any remaining buy-ins in step 1408, the method 1400 checks if the player is allowed to purchase buy-ins in step 1414. The player then selects the source of money, such as a payment account or money saved in a sweepstakes vault, and the buy-in value is added to the bankroll. If the player is not allowed, the method 1400 proceeds to game selection in step 1406. However, if the player is allowed to purchase buy-ins, such buy-ins or credits are added to a bankroll associated with the player in step 1416, the bankroll is closed in step 1418, and the method 1400 returns to the phantasy game in step 1412. At any time, the player has the option to select a different game.

Figure 15:
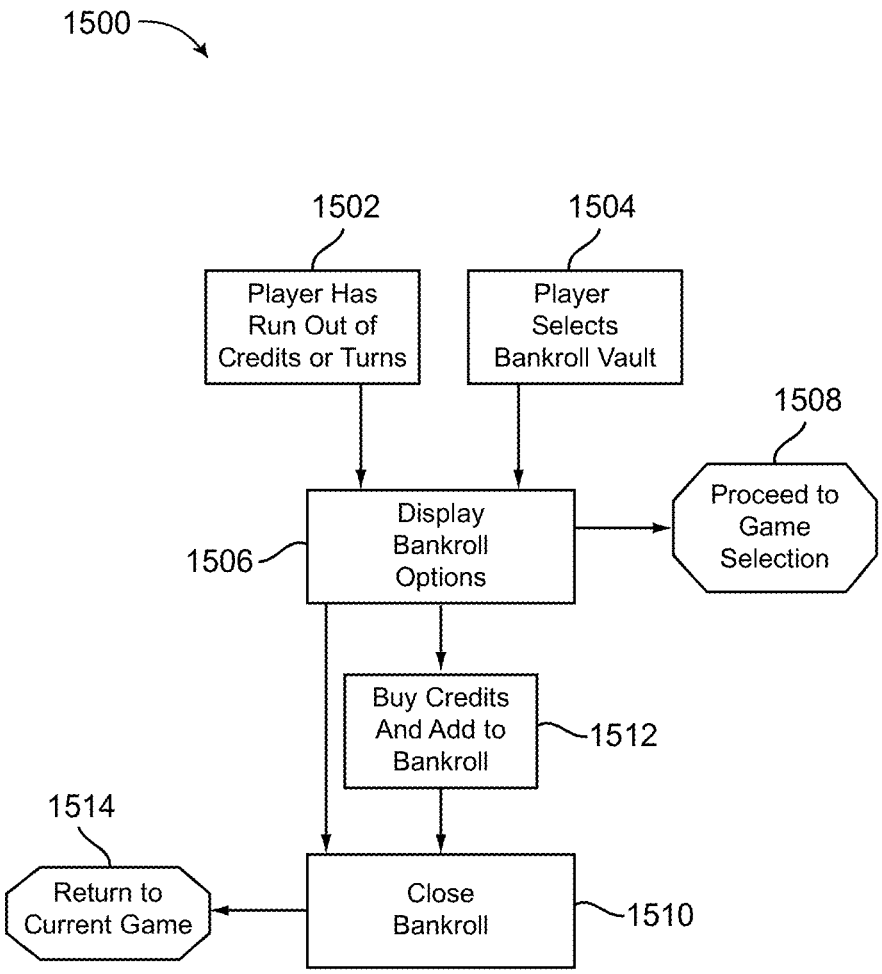
FIG. 15 illustrates a fun bankroll processing flowchart.

FIG. 15 illustrates a fun game bankroll processing flowchart 1500, which starts automatically when a player has run out of credits or allotted turns in step 1502, or when the player clicks a bankroll icon, such as shown in the interface 3700 in FIG. 37, to access a bankroll vault in step 1504. Then bankroll options are displayed in step 1506, including either selecting a game such as a different game in step 1508, closing a bankroll in step 1510, or buying credits and adding to the bankroll in step 1512, after which the bankroll is closed in step 1510. In step 1512, when the player buys credits, a fixed number of fun credits are obtained for fixed prices. Upon selecting the buy option in step 1512, the player must select a source of money, such as a payment account or money saved in a sweepstakes vault associated with the player. Once the bankroll is closed, the method 1500 returns to the current game in step 1514.

FIG. 16 illustrates a tournament bankroll processing flowchart 1600. The bankroll can be accessed by a player by clicking the bankroll icon in the interface 3700 of FIG. 37 for deposits and withdrawals. In addition, the bankroll opens automatically in step 1602 if player has run out of tournament credits or has run out of allotted turns that can be funded. The method 1600 then displays bankroll options in step 1604, and either the player proceeds to selecting a game in the tournament or leaving the game in step 1606, or the method 1600 checks if the player has any remaining buy-ins in step 1608. If the player has any remaining buy-ins, the game applies one of the remaining buy-ins in step 1610, and the method returns to the current tournament game in step 1612. Otherwise, in step 1608, if the player does not have any remaining buy-ins, or the bankroll of the player is below a pre-determined threshold, the method 1600 checks in step 1614 if the player is allowed to purchase buy-ins? If not, the method 1600 proceeds to step 1606 to have a player select a game without buy-ins, or leave the game. However, in step 1614, if the player is allowed to purchase buy-ins, buy-ins and/or credits for a number of turns are added to the bankroll of the player in step 1616, with the added buy-ins or turns set to the values specified for the particular tournament being conducted. In step 1616, the player selects the source of money, either from a payment account or from money in a sweepstakes vault of the player. The method 1600 then closes the bankroll in step 1618. Then the method 1600 proceeds to step 1612 to return to a current tournament game.

FIG. 17 illustrates a pari-mutuel bet processing flowchart 1700. Pari-mutuel Betting is a betting system in which all bets of a particular type are placed together in a pool, in which taxes and the house take are removed, and payoff odds are calculated by sharing the pool among all winning bets. Pari-mutuel pools reflect the chances of a left card, tie, and right card to win as anticipated by the players. The individual payoffs are large for those bettors whose bets are backed by relatively few bets, and small if the winning bets are backed by a relatively large proportion of the bets. The more popular the choice, the lower the individual payoff. The final payout is not determined until the pool is closed.

The system 300 maintains a timer that lets the bettors know how much time is left before the pool is closed. If a minimum number of bets for a current turn are not placed, bets are returned to players and new cards are dealt. However, if the minimum number of bets is reached or exceeded, the cards are turned, winners are paid, and new cards are dealt. Referring to FIG. 17, the timer for a turn begins, and players are notified of the time in step 1702. Players then place their bets in step 1704, and payout odds are calculated and displayed to the players in step 1706. The method then loops back to step 1704. The players may continue to place their bets until the turn time ends in step 1708, and the players are notified that the betting stops. The method 1700 then checks in step 1710 if the number of bets exceeds a predetermined minimum for the current turn. If not, the bets are returned to the player in step 1712, and two new cards are dealt to the players in step 1714. However, if the number of bets does exceed the predetermined minimum in step 1710, a final payout odds is displayed on the interface 3700 for viewing by the player in step 1716, the cards are turned over in step 1718, winning players are paid in step 1720, and two new cards are dealt to the players in step 1714. Additional bets such as exacta bets, side bets, and lucky number bets are optional.

FIG. 18 illustrates a sweepstakes vault processing flowchart 1800, in which a sweepstakes vault of a player is selected by a player in step 1802, and the sweepstakes vault may be opened by clicking a sweepstakes icon or pad on the interface 3700. A sweepstakes vault panel opens and displays a gallery of prizes won by the player in step 1804, such as sweepstakes prizes, golden tickets, cash, and credits associated with the player. If a player selects options to process cash in step 1806, the player can then transfer a portion of cash to the bankroll of the player in step 1816, transfer a portion of cash to a payment account of the player in step 1818, request a cash statement to be provided to the player in step 1820, or otherwise exit and return to a game in step 1822. Cash cannot be discarded or deleted from the sweepstakes vault of a player. If a player selects options to process fun credits or fantasy credits in step 1808, the player can then transfer a portion of credits to a bankroll of the player for a fun game or a fantasy game in step 1824, transfer a portion of credits to the bankroll of another player for a fun game or a fantasy game in step 1826, request a credit statement to be provided to the player in step 1828, or otherwise exit and return to a game in step 1822. If a player selects options to process in-game bonuses in step 1810, the player can then transfer a bonus to a mobile device or an Email in step 1830, use a bonus in a game in step 1832, discard a bonus in step 1834, or otherwise exit and return to a game in step 1822. If a player selects options to process external bonuses and coupons in step 1812, the player can then transfer a coupon or bonus to a mobile device or Email in step 1836, redeem a bonus or coupon in step 1838, discard a bonus or coupon in step 1840, or otherwise exit and return to a game in step 1822. If a player selects to process golden tickets in step 1814, the method 1800 performs the method 600 in FIG. 6 starting with step 612, or otherwise the player selects to exit and return to a game in step 1822. When exiting in step 1822, the sweepstakes vault of a player is closed.

FIG. 19 illustrates a video option flowchart 1900, which implements step 116 in FIG. 1. The method 1900 starts in step 1902 by providing a video menu option, and then displaying in step 1904 various options or video modes available to the player using the interface 3700 implemented, for example, on a smartphone. For example, the player may activate the capturing of a video of the face of the player in step 1906, and the system 300, through the smartphone, can track eye movements of the player in step 1908. Another option includes exiting the video options in step 1910, and returning to a game in step 1912. Further options include establishing a player-to-player video link in step 1914, such as establishing a video chat session with other people, sharing a game screen with other people, watching a game screen of another player, or interacting with an operating company via video and/or text, etc.; player-to-In2it in step 1916, by which a player can interact with a game operator and/or customer support for games operated by the game server 330; watching In2it game tournaments such as live events and other tournaments run by the game server 330, as well as watching a recorded video from the game server 330 of the game operator in step 1918; and establishing a player-to-Internet video link in step 1920 such as to other people, not limited to players, using known video telecommunication systems, such as SKYPE or FACETIME. After any of the steps 1914, 1916, 1918, 1920, the player can set various video, audio, and text options and settings in step 1922 such as muting audio, adjusting volume, activating captions, controlling video quality, etc., and the method 1900 returns to the game in step 1912.

FIG. 20 illustrates a tournament processing flowchart 2000, which starts when a person is invited by a sponsor or by a game to be a player, or when an existing player selects a tournament. Tournaments can be selected by a player clicking a link in an invitation Email, during initial game selection, from the Main Menu or Main Game Screen at step 102 in FIG. 1, or by selecting an "Enter Tournaments" button or icon on the interface 3700. Players then have several options: in step 2004, the player browses a list of active tournaments in which the player is currently enrolled; in step 2006, the player browses, sorts, filters, and otherwise searches a list of currently enrolled or existing charities and/or open tournaments, with options to join selected tournaments; or in step 2008, the player sponsors a new tournament.

In step 2004, the player is given the options of joining a tournament in step 2012 to play in the joined tournament in step 2014, or to sponsor a tournament in step 2008. To join a tournament in step 2012, a player registers and sets any increased donation over a predetermined minimum percentage of winnings to go to a selected charity or cause, if the player wins a tournament. If a tournament has already started, a player may begin to play immediately, or otherwise the player waits until an appointed start time/date of the tournament.

In step 2006, the system 300 allows the browsing or searching player to access information about a charity, such as news, comments, ratings, etc. in step 2010. The player then buys into a tournament in step 2016, and the player may use a karma slider or other input mechanism through a GUI in step 2018 to increase a donation percentage of potential winnings. The method 2000 then proceeds to step 2014. During play of a tournament in step 2014, a leader board can be clicked by a player in step 2020 which shows the top players and scores in the tournament. In addition, a player can check for status of the tournament in step 2022, such as when the tournament begins, when the tournament ends, an amount of donations to charity or cause, total donations distributed, etc.

During playing of a tournament, if a player is low or out of credits or turns in step 2024, and if permitted by the rules of the tournament in step 2026, the player may purchase another buy-in in step 2028 to resume play in the tournament in step 2014. However, if the rules do not allow a buy-in in step 2026, or if the player does not buy-in again in step 2028, the player is removed from the tournament, and the player returns to the game in step 2030.

If the tournament ends in step 2032, players in that tournament are notified and each player may view a winner board in step 2034, showing the winning players, an amount that the winning players have won, a percentage and an amount of donations to charity or cause, and the total donations distributed. The winners are paid and the donation is sent to the charity or cause in step 2036, and the method 2000 returns the players to play their respective games outside of a tournament.

Referring back to step 2008, to sponsor a new tournament, the player has previously browsed registered charities and causes in step 2004. A sponsor may create a new charity or cause to benefit from the tournament, subject to registration approval, and enter new information in step 2038, including details and news about the charity or cause and about the sponsor. The sponsor sets the parameters of the tournament, such as start/stop dates, a predetermined minimum percentage donation by the winners, a buy-in amount, etc. in step 2040. The sponsor also submits tournament rules in step 2042. The sponsor commits to a tournament created by the sponsor by paying a buy-in in step 2044. The tournament is submitted to the In2it/game server 330 for approval in step 2046. If the tournament is not approved, the tournament is rejected in step 2048, the sponsor is notified, the buy-in of the sponsor is returned, and the method 2000 returns the player to select a game to play in step 2030 outside of a tournament. However, if the tournament is approved in step 2046, the tournament is created in step 2050, the sponsor is notified of the creation of the tournament, and the sponsor invites friends and associates and others to join and play in the tournament in step 2052.

FIG. 21 illustrates a tournament play processing flowchart 2100 which shows various steps in FIG. 20 in greater detail. The method 2100 starts with step 2012 with a player entering a tournament. If the player enters a tournament for a first time, the player receives a buy-in bankroll in step 2102, including a credit bankroll and optional turn limits; otherwise, the player utilizes a prior bankroll balance. During tournament play in step 2014, the player has the following options: view a leaderboard in step 2020, view tournament status in step 2022; bet on a left card in step 2104; bet on a tie in step 2106; bet on a right card in step 2108; place side bets in step 2110; place exacta bets in step 2112; place lucky number bets in step 2114; and after bets are placed, the player clicks to turn cards in step 2116 to reveal bet results, and then revise or update the tournament bankroll in step 2118. In addition, sweepstakes are checked and player notified if a win occurs in step 2120, and the method 2100 loops back to step 2014 to continue tournament play.

However, in step 2032, tournament ends if a player reaches the goal amount or tournament time has expired. A winner board is displayed in step 2034, showing the winning players, the amounts that the players have won, the percentage and amount of donations to the charity or cause of the tournament by the winners, and the total donations distributed. Players and winners are notified in step 2122; money is sent to the charity or cause, and to tournament winners in step 2036; and the player goes to a game selection screen to return to playing a game outside of a tournament in step 2030.

Figure 22:
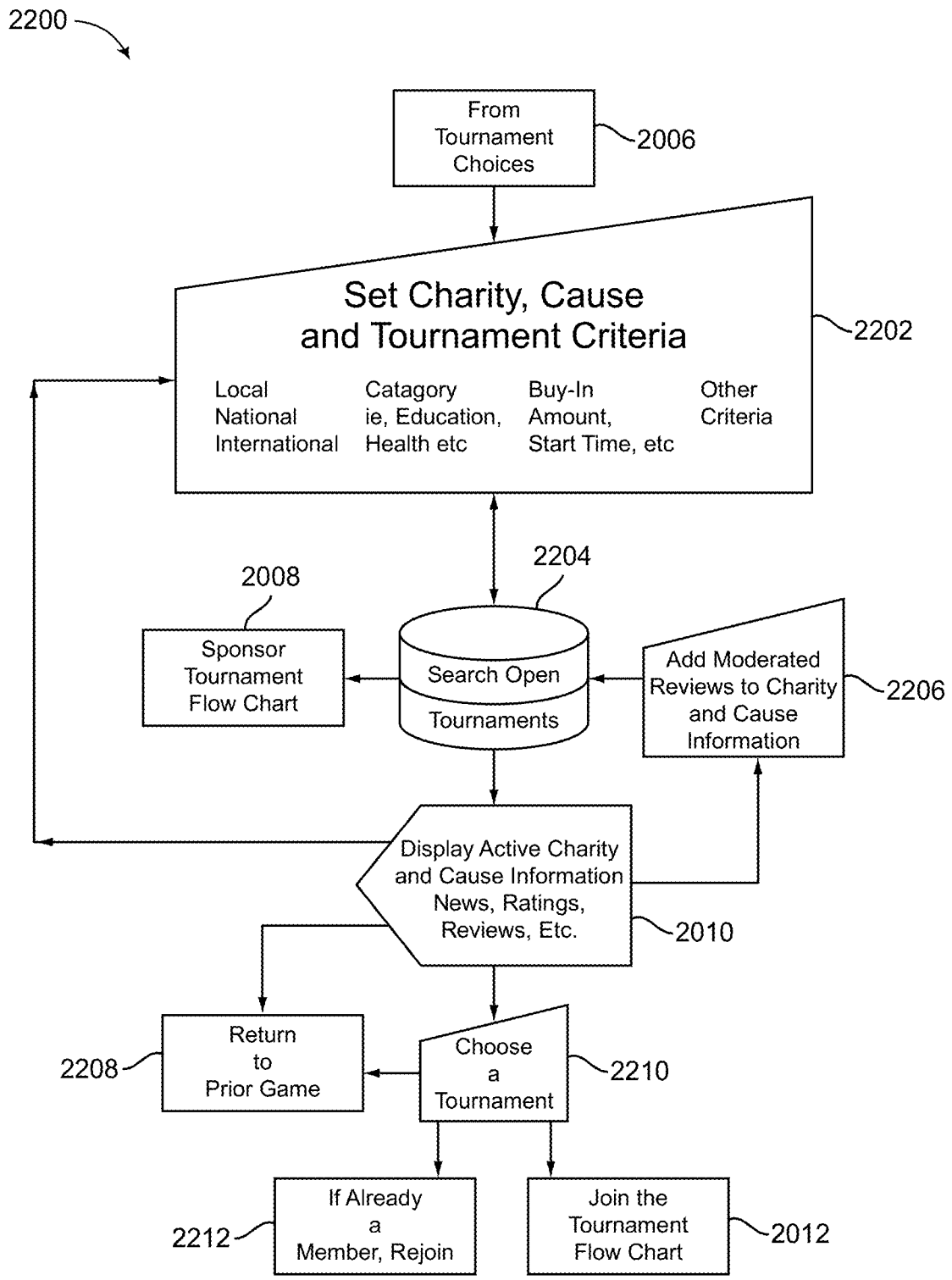
FIG. 22 illustrates a browse tournaments processing flowchart.

FIG. 22 illustrates a browse tournaments processing flowchart 2200 which starts with step 2006 in FIG. 20, in which tournament choices are presented to a player, and the player then sets criteria for a charity, cause, and tournament in step 2202, including whether the charity, cause, and/or tournament is local, national, and/or international in scope. The category of the charity or cause is also set to be for education, health, etc. For tournaments, a buy-in amount, start time, etc. are specified, and other criteria may be set. The system 300 then searches for open or available tournaments in step 2204 which satisfy the criteria set by the player. If no open tournament meets the criteria, the player may sponsor a tournament in step 2008 in FIG. 20. The system 300 may also display information, news, ratings, reviews, etc. about charities and causes in step 2010, with such information, news, ratings, reviews, etc. stored in the database 22. The system 300 may also allow the player or other parties to add moderated reviews of a particular charity or cause to the information about such a charity or cause in step 2206, with such reviews added to the database 22. The player may then return to a prior game in step 2208.

A player may choose an available tournament to join in step 2210, and the player joins the chosen tournament in step 2012, which is described in greater detail with reference to FIG. 23. Alternatively, if the player is already a member of a tournament, the player may rejoin and play in the tournament in step 2212. Furthermore, at step 2210, the player may choose to not play in a tournament, and the player may then return to a prior game in step 2208.

FIG. 23 illustrates a tournament joining flowchart 2300 for the step 2012 in FIG. 20. The method 2300 starts in step 2302, and allows the player to view information regarding a charity, a cause, a tournament, a sponsor, etc. in step 2304. After step 2304, the player can go back to step 2302, or the player can then add to the information to a tournament information database in the database 322 in step 2306. After step 2302, the player can also proceed to step 2312, as described below, to return to a prior game. Also, after step 2302, a player registers with the system 300 in step 2308 and sets any increased donation over a predetermined minimum percentage to go to a charity or cause, if the player wins. The player then pays a buy-in fee in step 2310, and returns to a prior game in step 2312. After step 2312, the player has the option to play in a tournament later in step 2314, if the tournament has not expired at the later time. Referring back to step 2310, after paying the buy-in fee, the player may also have the option of inviting friends and associates to join a tournament with the player in step 2316, and the player then plays in the tournament now in step 2318.

FIG. 24 illustrates a tournament sponsoring flowchart 2400, which starts in steps 2402, 2404, to implement step 2008 in FIG. 22 and FIG. 20, respectively, after step 2204 and steps 2004, 2006, respectively. After steps 2402, 2404, a player sets charity and cause criteria and searches registered charities and causes in the database 322 that meet those criteria in step 2406. The criteria may indicate a local, national, and/or international charity or cause; a category of the charity or cause such as education, health, etc.; and other information about the charity or cause. The information is searched and/or saved in the database 322 in step 2408, to which the player or the game may add moderated reviews and registration recommendations in step 2410, and the system 300 displays to the player active charity and cause information, news, ratings, reviews, etc. in step 2412. The player then chooses a charity or cause to sponsor in step 2414, and may add reasons for choosing such a charity or cause in the information about the charity or cause in the database 322.

To sponsor a tournament, a player fills out tournament information in step 2416, such as a tournament name; a name of the sponsor; a predetermined minimum percentage to go to the charity or cause from the winnings of a player, a start time and date of the tournament, a duration of the tournament, a buy-in to the tournament, a goal amount of the tournament, a distribution of winnings of the tournament, whether the tournament is public or by invitation only, social media and public relations (PR) of the tournament, etc. The sponsor then buys-into the tournament in step 2418, since the sponsor must buy-in and must be the first person to buy-in. Such filled-in tournament information is then saved to a tournament database in the database 322 in step 2420, from which social media and PR are generated in step 2422 as per the decision of the sponsor to sponsor the tournament. The tournament then becomes available to play at its designated start time in step 2424.

FIG. 25 illustrates a menu flowchart 2500 for implementing step 112 in FIG. 1, which starts when a menu button or icon, such as a gear icon in the interface 3700 in FIG. 37, is actuated in step 2502, and then menu options are displayed in step 2504, including switching to a fantasy game in step 2506, switching to a fun game in step 2508, switching to a cash game in step 2510, and switching to a tournaments screen in step 2512. After each of steps 2506, 2508, 2510, 2512, the method 2500 starts the respective game in step 2514. Other menu options include adjusting the adjust the speed of game play in step 2516, setting whether cards turn over together or separately in step 2518, adjust audio options in step 2520, and select background and card icon or pad styles as skins in step 2522. After steps 2516, 2518, 2520, 2522, the method 2500 goes in step 2524 to a respective method 2600, 2700, 2800, 2900 in FIGS. 26-29, respectively. The method 2500 then closes the menu and returns to a game in step 2526.

Further menu options include selecting player statistics in step 2528, with the method 2500 then displaying the statistics of the player in a current game session in step 2530, and then exiting in step 2532 to go to step 2526. Additionally, the menu options could include displaying house statistics to display statistics about multiple players or durations, and also adjusting the house edge to adjust the game odds of winning, as described below with reference to FIG. 30. More menu options include displaying general information and help about the game in step 2534, which is described in greater detail in connection with FIG. 31; displaying a blog about a game or tournament in step 2536; displaying an in2itzone.com icon in step 2538 which opens a browser and goes to a website of the game such as the website 16 in FIG. 45; and displaying other possible options in step 2540. After steps 2534, 2536, 2538, 2540, the method 2500 goes to individual flow charts in step 2542, such as shown in FIG. 31 for implementing step 2534.

More menu options include going back to a previous display in step 2544, after which the method 2500 proceeds to step 2526; allowing player to repeat portions or all of an introduction in step 2546; and allowing a different player to be logged in and play a game in step 2548. After steps 2546, 2548, the method 2500 goes to individual flow charts in step 2542.

Figure 26:
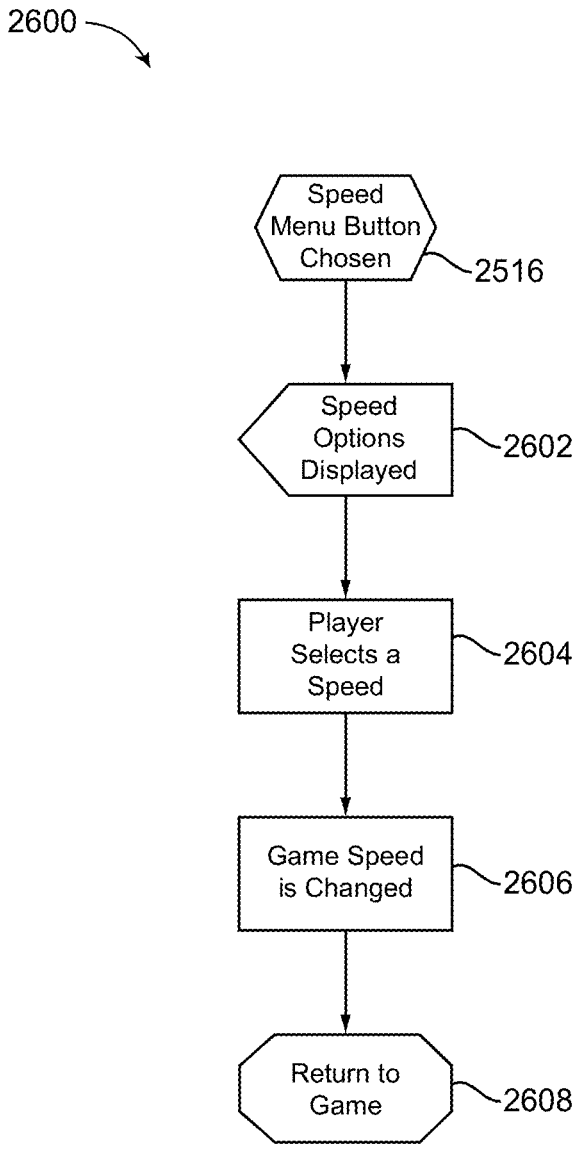
FIG. 26 illustrates a game speed option flowchart.

FIG. 26 illustrates a game speed option flowchart 2600, after the speed option is clicked from the Main Menu in FIG. 25 to implement step 2516. After step 2516, the method 2600 displays speed options in step 2602, with several speed options available, such as Leisure, Fast and Yowza or Very Fast. Then the player selects a speed in step 2604, the game speed is changed in step 2606, and the method 2600 returns to a game in step 2608. Such speed selection affects certain aspects of general game play, such as the amount of time to turn the cards, the speed of outcome list sweepstakes checking, etc.

Figure 27:
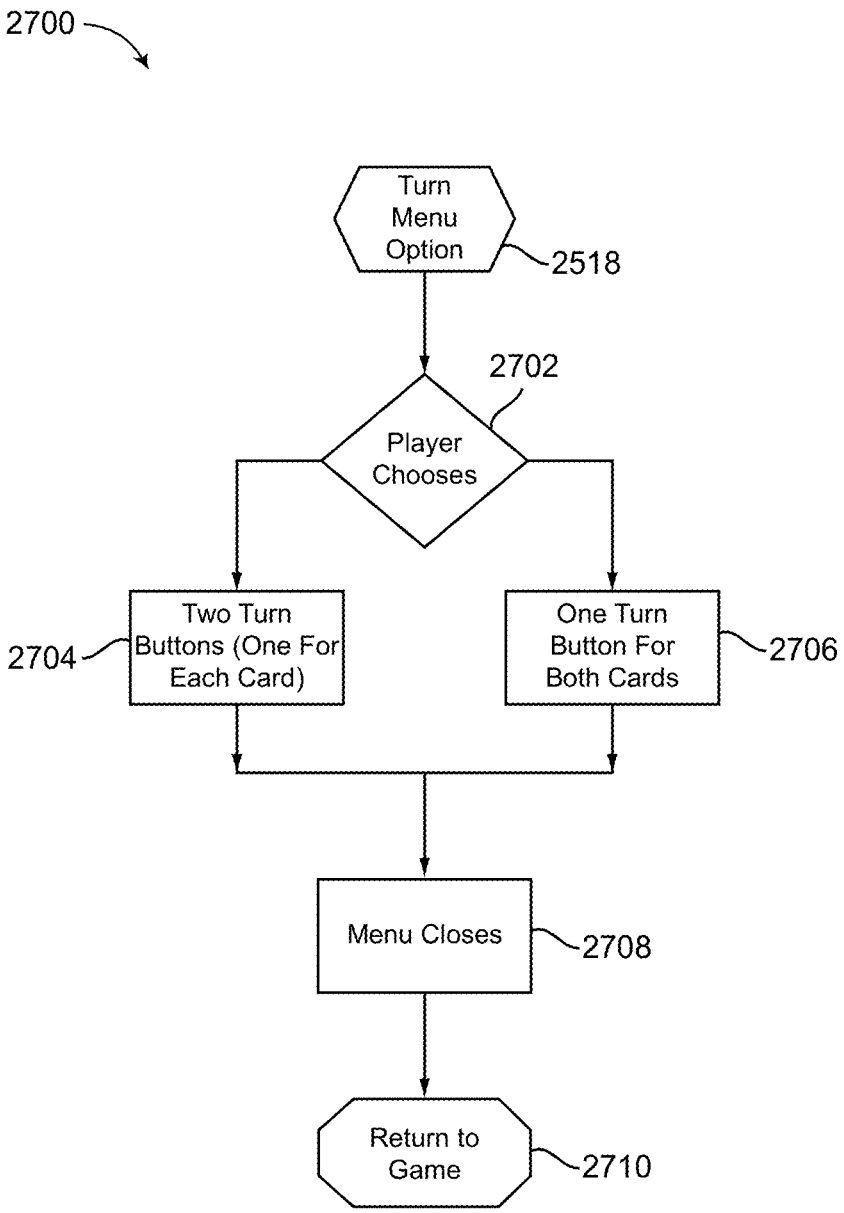
FIG. 27 illustrates a card turn option flowchart.

FIG. 27 illustrates a card turn option flowchart 2700, after the turn-cards option is clicked from the Main Menu in FIG. 25 to implement step 2518. The player chooses between two available choices in step 2702: the left and right cards can be turned over individually for heightened suspense in step 2704, or both cards turn over at the same time in step 2706. For step 2704, if this option is selected, separate left and right turn icons pads appear as soon as any bet is placed. Otherwise, one turn button appears for both cards in step 2706. After steps 2704, 2706, the menu closes in step 2708, and the method 2700 returns to the game in step 2710.

Figure 28:
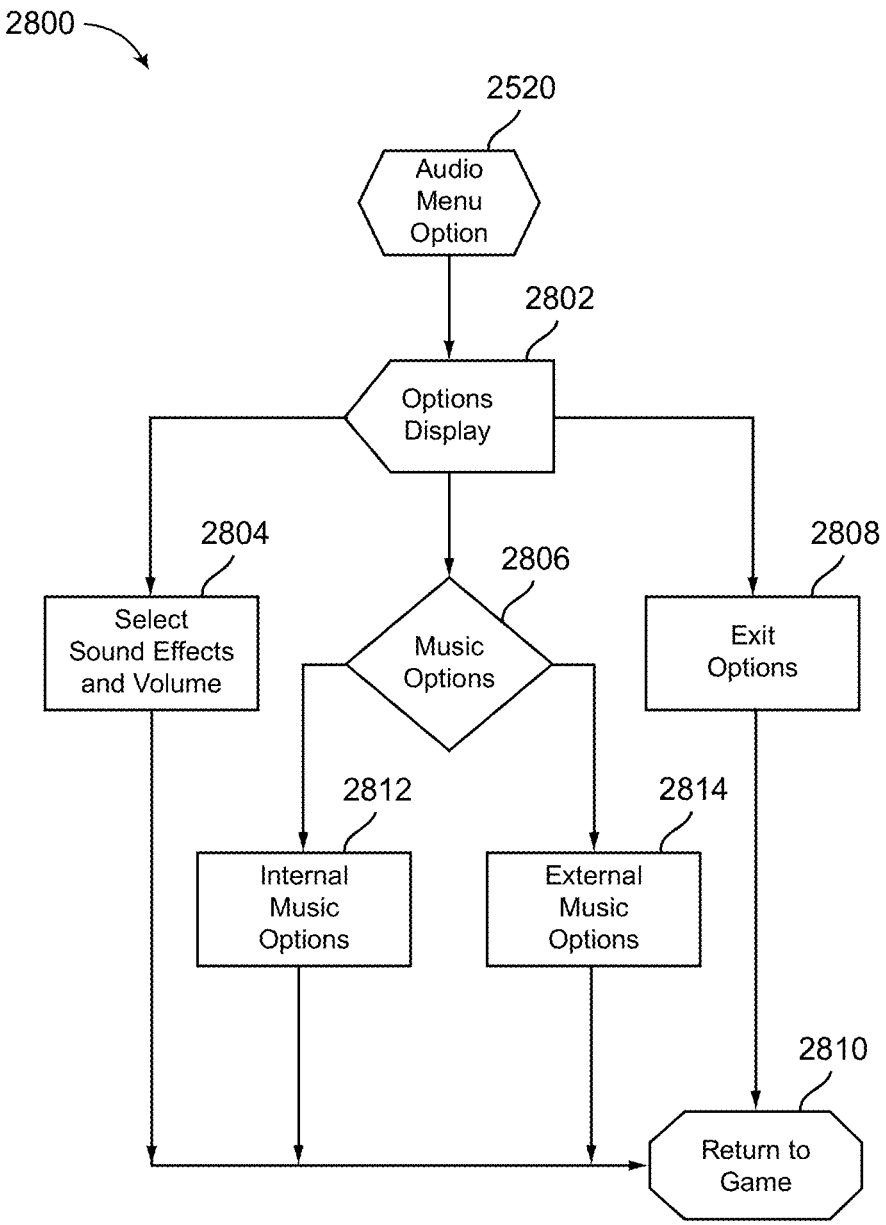
FIG. 28 illustrates an audio option flowchart.

FIG. 28 illustrates an audio option flowchart 2800, after the audio option is clicked from the Main Menu in FIG. 25 to implement step 2520. The method 2800 displays options in step 2802 including selecting sound effects and volume in step 2804, providing music options in step 2806, and providing exit options in step 2808. In step 2804, a player may select various sound effects associated with visual cues such as an applause sound accompanying flashing lights when a player wins. In step 2804, the player may also adjust the volume of the sound effects. In step 2806, music options are provided such as internal music options in step 2812 and external music options in step 2814. The internal music may be specific musical pieces played during gameplay, while the external music options may be background music. The volume of the internal and external music such as the background music may be set in steps 2812, 2814, respectively.

Figure 29:
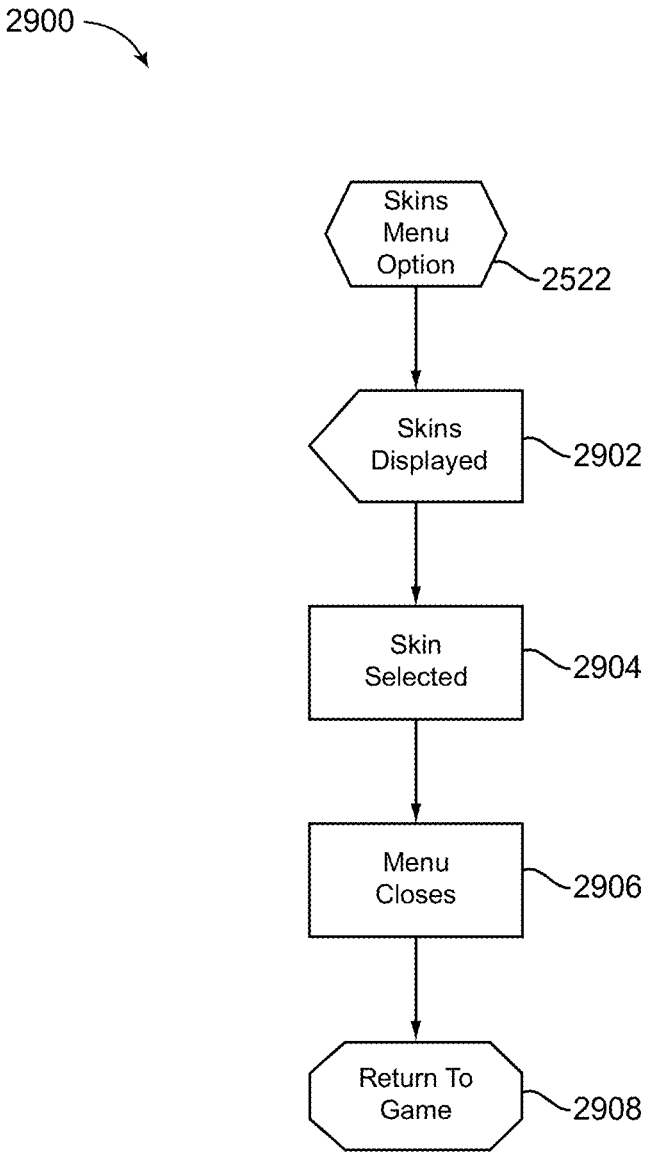
FIG. 29 illustrates a screen skins option flowchart.

FIG. 29 illustrates a screen skins option flowchart 2900, after the skins option is clicked from the Main Menu in FIG. 25 to implement step 2522. A choice of skin options is presented or displayed with varying background pictures, pad colorings and other possible cosmetic changes in step 2902. A player selects a skin in step 2904, which is then implemented on the interface 3700 in FIG. 37, and then the menu closes in step 2906, and the player returns to a game in step 2908.

Figure 30:
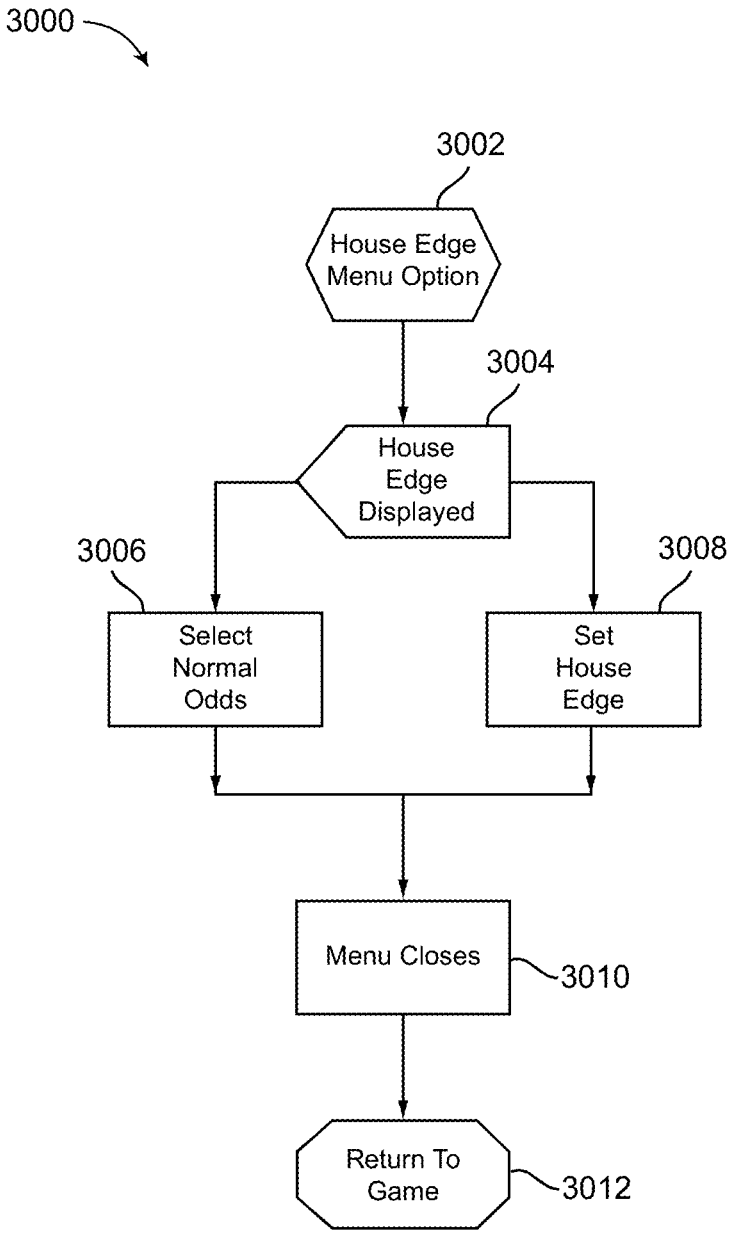
FIG. 30 illustrates a house edge processing flowchart.
Figure 31:
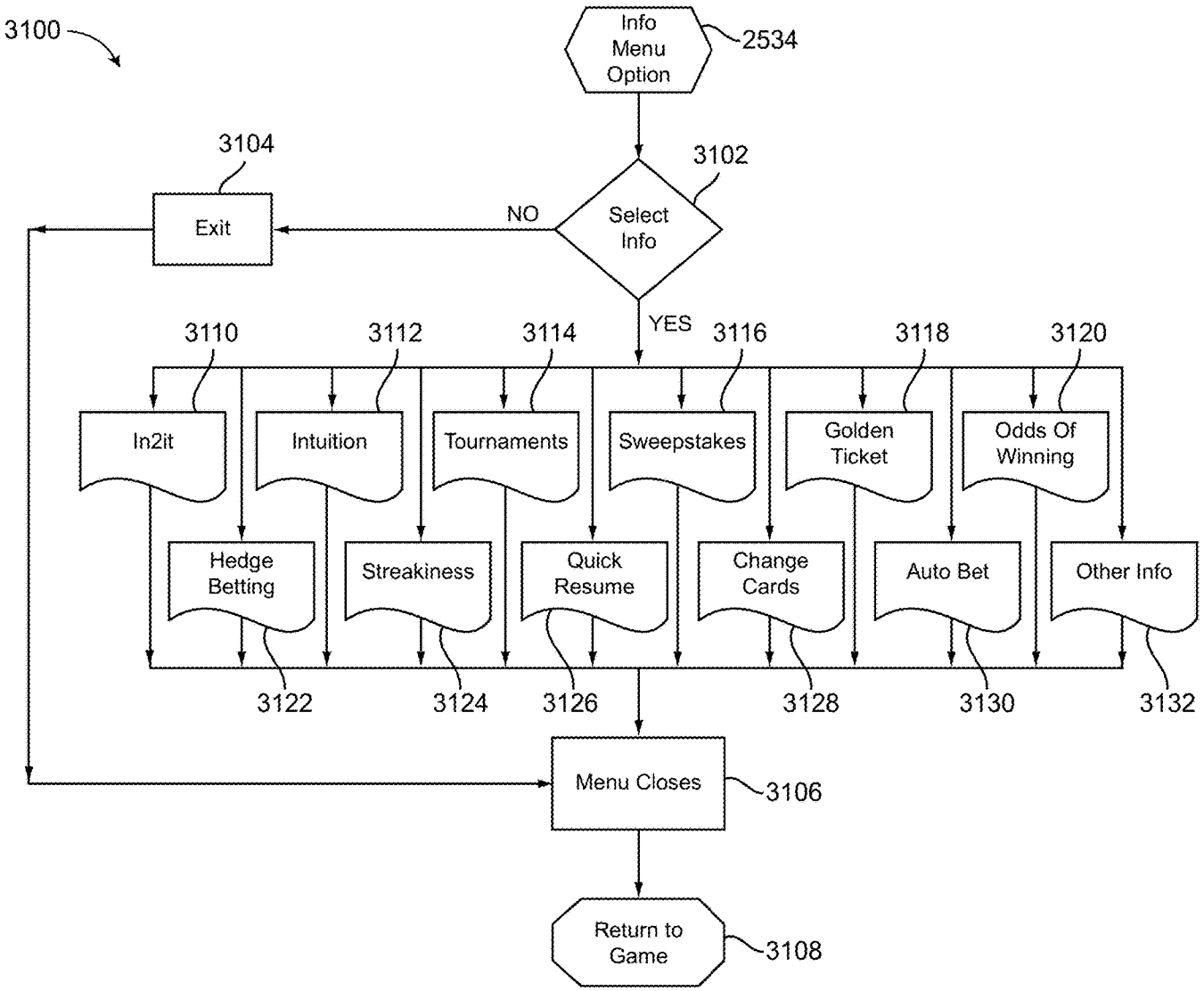
FIG. 31 illustrates an information processing flowchart.

FIG. 30 illustrates a house edge processing flowchart 3000, after a house edge option is clicked from the Main Menu in step 3002. Typically, the house edge option is only available to game operators, such as an operator or administrator of a game accessing the game server 330. The game operator must enter a password or otherwise be authenticated to continue. The current house edge settings are displayed in step 3004 and may be changed. Such settings may be for normal odds, that is, random odds are being used, as in step 3006; or set odds, that is, a specified house edge is being used as in step 3008. If set odds are chosen in 3008, the game operator may input and change the set odds, for example, using an input field to specify a numerical value of the set odds, or a slider is shown in a GUI, with the slider position reflecting a selected house edge. Other options are displayed to the game operator, such as a save option to save the currently displayed odds settings, and an exit option to exit the house edge options menu. The menu for the house edge settings closes in step 3010, and the game operator returns to the game in step 3012.

FIG. 31 illustrates an information processing flowchart 3100, after the information option is clicked from the Main Menu in FIG. 25 to implement step 2534. After step 2534, the player chooses to select information or not in step 3102. If not, the system 300 exits in step 3104, the information menu closes in step 3106, and the player returns to a game in step 3108. However, in step 3102, if the player chooses to select information, a scrollable reading panel or window is generated on the interface 3700, for example, to be displayed on the right side, with a scrollable list of information categories being displayed, such as In2it for general information in step 3110; intuition in step 3112; tournaments in step 3114; sweepstakes in step 3116; golden tickets in step 3118; odds of winning in step 3120; hedge betting in step 3122; streakiness in step 3124; quick resume in step 3126; changing cards in step 3128; auto betting in step 3130; and other information in step 3132. Clicking any category displays the relevant information in a scrollable reading panel or window in the interface 3700. After reviewing all desired information, the player clicking an exit icon in step 3106 to close the reading panel, returning the player to the menu, and playing a game by a player resumes in step 3108.

Figure 32:
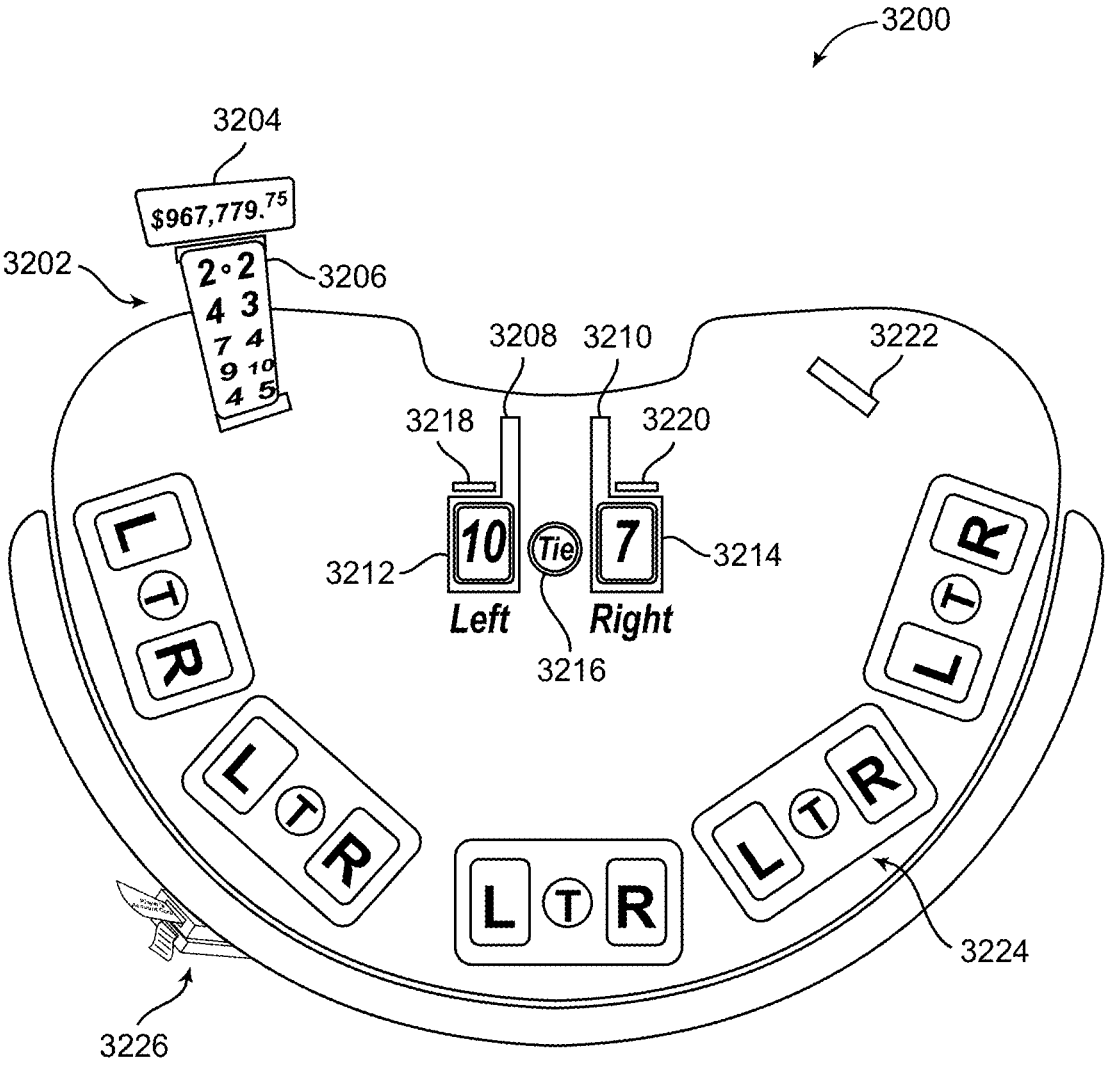
FIG. 32 is a top plan view of a table game configuration with chip-based bets.

FIG. 32 is a top plan view of a table game configuration with chip-based bets on physical cards, with a table 3200 having a display 3202 of jackpot amounts 3204 and lists 3206 of outcomes of the cards previously turned over. A pair of card landing paddles 3208, 3210 are provided upon which a left two-sided card 3212 and right two-sided card 3214 are positioned, respectively, on either side of a tie pad 3216. A left card dealing slot 3218 and a right card dealing slot 3220 are provided near the card landing paddles 3208, 3210, respectively. A discard slot 3222 is provided with an adjacent card reader for receiving played cards 3212, 3214 after the cards are turned. The card reader is capable of reading and recognizing the cards 3212, 3214 as the cards are displayed.

Figure 46:
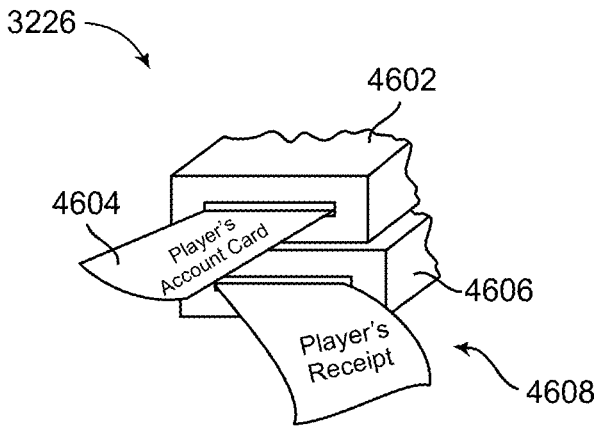
FIG. 46 is a top front side perspective view of an account card reader and a receipt printer.

A plurality of betting pads 3224 are positioned about the top surface of the table 3200, with the betting pads 3224 shown in FIG. 47, and having a left pad 4702, a right pad 4704, and a tie pad 4706. Physical betting chips are placed on the left pad 4702, the right pad 4704, and/or the tie pad 4706, allowing a player to place a bet on either the left card, right card, or a tie, respectively. The pads 4702, 4704, 4706 may have any known sensing technology, such as RFID readers, to scan the value amounts from the chips or a number of the chips on a particular pad 4702, 4704, 4706. In addition, adjacent to each of the betting pads 3224, a player-specific apparatus 3226 is attached to the table 3200, preferably on an underside of the table 3200. The player-specific apparatus 3226 is shown in greater detail in FIG. 46, has an account card reader 4602 for reading a physical account card 4604 associated with a player, and also has a receipt printer 4606 for printing a physical receipt 4608 of the bets and winnings of the player.

For table games in casinos and other venues, physical cards may be printed underneath the table 3200 and delivered to the table surface through slits 3218, 3220 in the table 3200 as described in U.S. Pat. No. 5,199,710, which is incorporated herein. Alternatively, a series of decks shuffled together may be dealt from a single shoe, or pair of shoes may be used. If such a system and method are used, then after the cards 3212, 3214 are turned over, the cards 3212, 3214 may be placed in a hopper to be shuffled together with the other cards. Upon delivery of the cards 3212, 3214 to their respective positions on the table 3200, players may place bets. After a short period of time, the dealer indicates that time is up for betting.

Two options for turning over the cards 3212, 3214 at the table 3200 exist. For a first option, the dealer turns over both cards 3212, 3214, and then the dealer collects losing bets and pays winners. The used cards are collected by the dealer and removed from the table 3200. For a second option, the dealer presents a choice to the player with the largest total bet, offering the player the opportunity to choose which card to turn over; that is, the left card 3212 or the right card 3214. The dealer turns over the non-selected card. Then the dealer slides the chosen card to the player, who turns over the chosen card, often in dramatic fashion. The used cards are collected by the dealer and removed from the table 3200. The table game may be played with chips placed on areas of the gaming table marked Left, Tie and Right, or its equivalents in the pads 3224.

Figure 33:
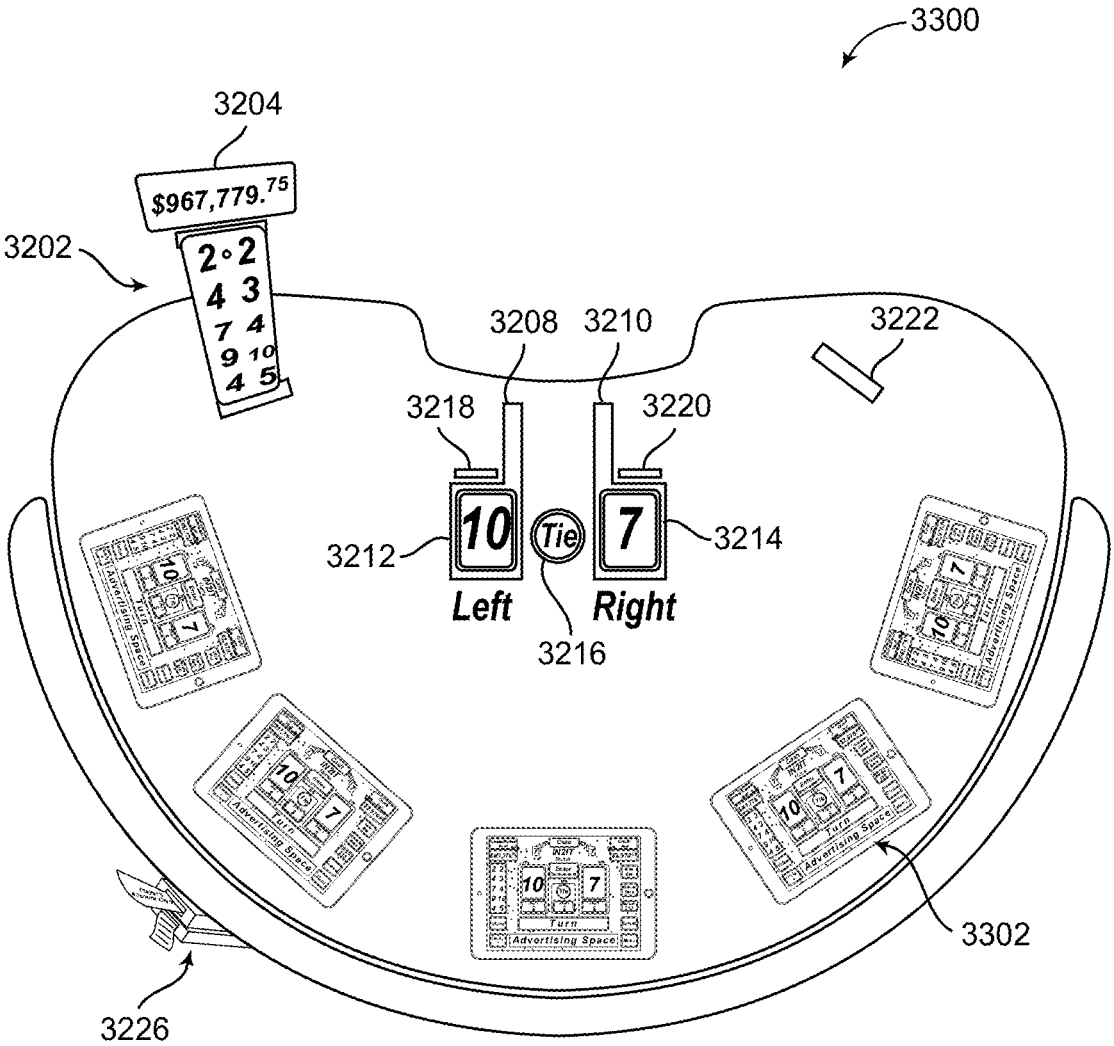
FIG. 33 is a top plan view of a table game configuration with electronic bets.
Figure 38:
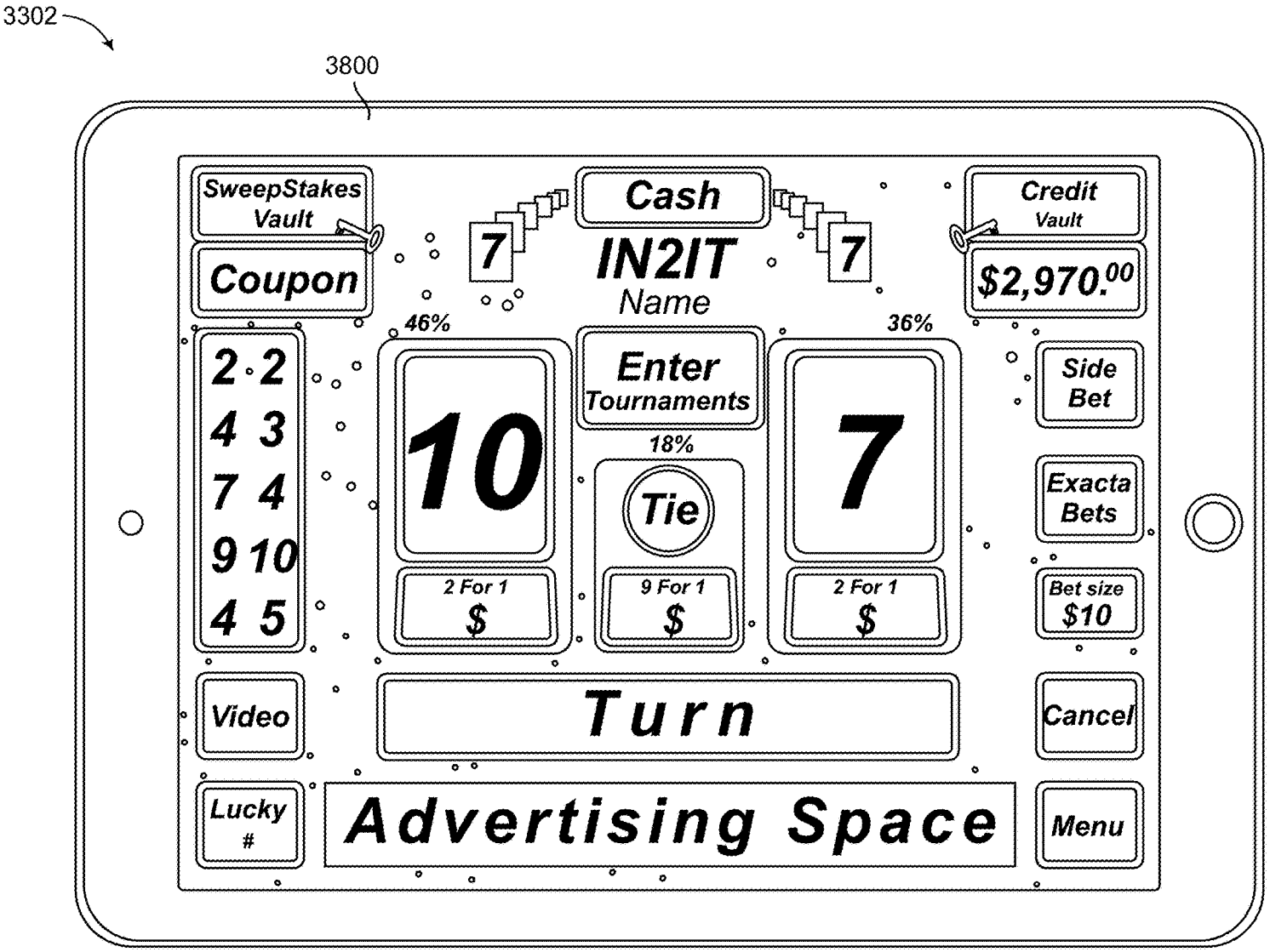
FIG. 38 illustrates an interface of a cash game.

FIG. 33 is a top plan view of a table game configuration with electronic bets. In an alternative embodiment, at a game table 3300 which uses the two-sided cards that are delivered to the table 3300, players may use electronic devices 3302, such as shown in FIG. 38, at the table 3300 to place bets, and also to broadcast to other locations for betting on the outcome of the cards at that table 3300. Referring to FIG. 38, each electronic device 3302 may be an electronic tablet associated with the player, and having a link to the game at the table 3300 for entering bets from the player.

Figure 34:
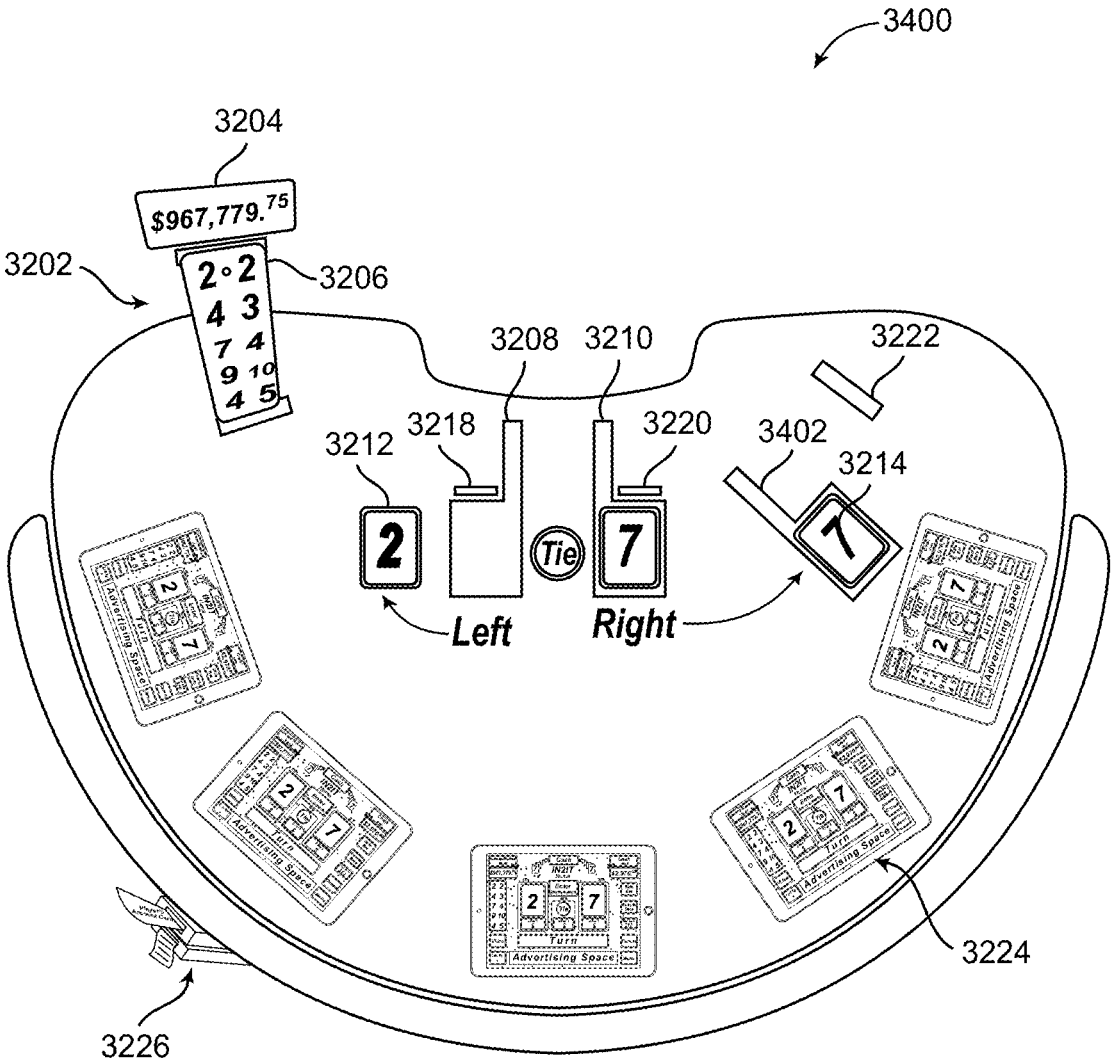
FIG. 34 is a top plan view of a table game configuration with physical card presentations.

FIG. 34 is a top plan view of a table game configuration with physical card presentations, in which the dealer has turned over the left card 3212, and has presented the other, right card 3214 to a player to physically turn over, as represented by the moved paddle 3402 indicating that the right paddle 3210 has been lifted by the dealer and moved to an arbitrary player to turn over the right card 3214.

Figure 35:
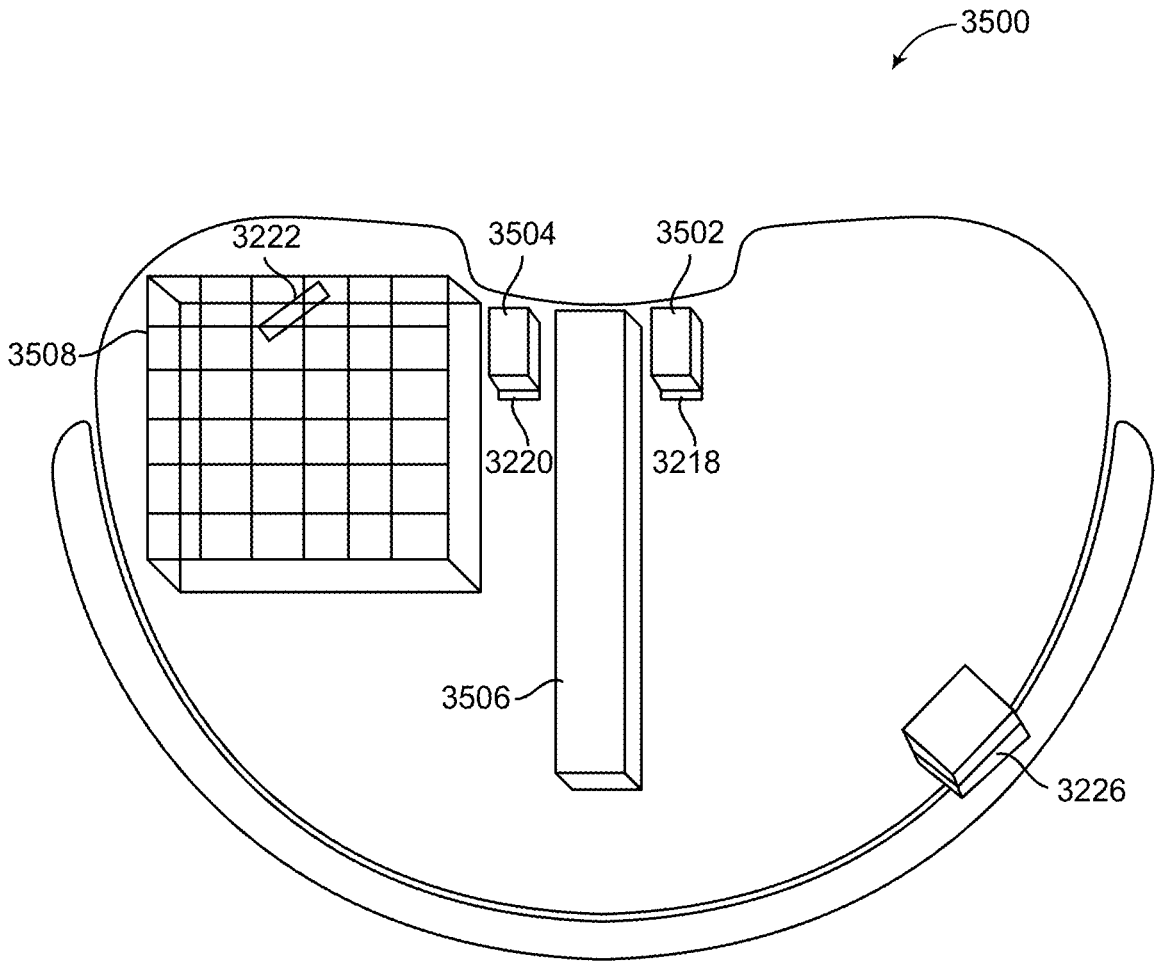
FIG. 35 is a bottom plan view of the table game configurations of FIGS. 32-34.

FIG. 35 is a bottom plan view of the table game configurations of FIGS. 32-34, with the bottom of each table 3500 having a left card printer 3502 for printing a left card 3212 which is output through the slot 3218 to the top surface of the table 3500, and having a right card printer 3504 for printing a right card 3214 which is output through the slot 3220 to the top surface of the table 3500. The cards 3212, 3214 are printed from card stocks received from a card stock feeder 3506. The discarded cards 3212, 3214 are received through the discard slot 3222 into a used card collection bin 3508. In an alternative embodiment, a card reader may be positioned within the card collection bin 3508 and adjacent to the discard slot 3222 to read each discarded card for tracking the cards to be displayed in the lists 3206 of outcomes of the cards previously turned over.

Figure 36:
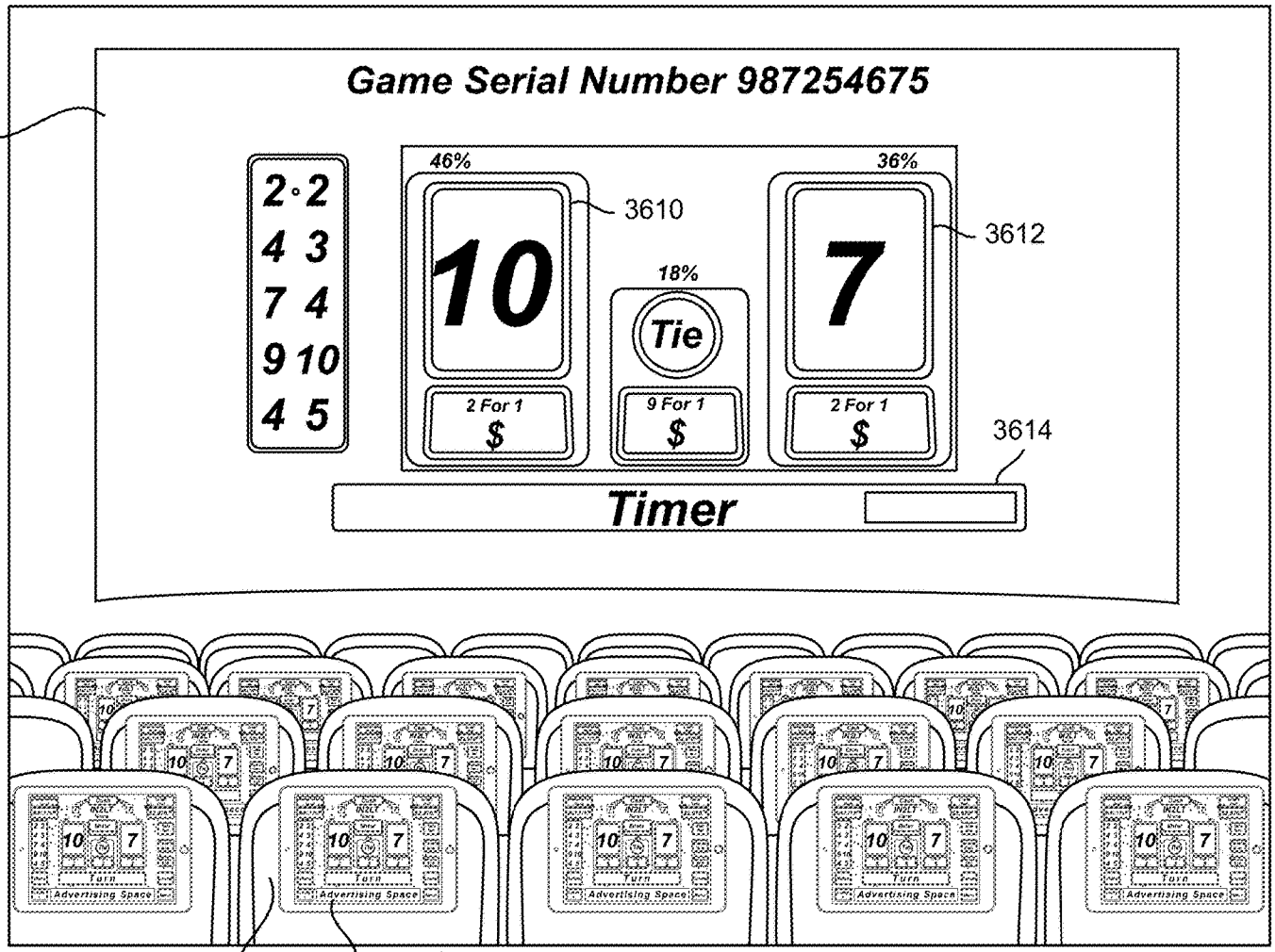
FIG. 36 illustrates a large audience configuration of a game.

FIG. 36 illustrates a large audience configuration of a game, which is displayed on a large screen 3602 to a plurality of players sitting in the audience and having a smartphone or tablet with a game app or access to local electronic devices, such as 3604 mounted on the backs 3606 of seats 3608. Such electronic devices 3604 may be in the form of the tablets 3302 shown in FIGS. 33-34 and 38. The localized game may also be displayed on the large screen 3602 with images 3610, 3612 of cards being shown to the audience as well as a timer 3614 indicating how long the players in the audience have to place their bets. In airport lounges, aboard ship, in theaters, in stadiums, in bingo halls and other locations in which a number of people can play at the same time, large audience games provide for the possibility of experiencing competitiveness and comradery as a member of a group of simultaneous players in definable locations. Individual players may have their own gaming device such as individual tablets 3302 shown in FIG. 38, or may use a gaming device 3604 provided at their location. Each of the gaming devices 3604 at that location receives a signal that may be simultaneously received by a large display 3602 at the location.

Individual players may place bets through their respective individual game device 3604 before the timer 3614 counts down to the end of the turn. At the end of the countdown, all bets are locked, the images 3610, 3612 of the cards are turned over, the bankrolls of the winners are updated, and new card images are dealt. One or more locations may be dealt the same card sequences simultaneously. Fixed winning payouts may be applied, such payouts of 2 for 1 (1:1) on bets of either the left or right cards winning, and for payout of 9 for 1 (8:1) on tie bets. Alternatively, payouts can depend on a para-mutual algorithm described above.

FIG. 37 illustrates an interface 3700 of a cellphone-based game, showing a main game screen displayed in step 102 of FIG. 1. An upper portion of the interface 3700 has a settings icon 3702 for accessing and displaying a settings menu implementing step 112, a side bet icon 3704 for implementing a side bet in step 128, an exacta bet icon 3706 for implementing an exacta bet in step 130, a lucky number icon 3708 for obtaining a lucky set of numbers in step 114, and a media region 3710 for displaying video and/or text to the player using the cellphone displaying the interface 3700 and for implementing step 116. The upper portion may also display a username 3712 associated with the player, an outcome strip 3714 for displaying past outcomes of the cards being turned over and implementing step 118, a sweeps icon 3716 for accessing a sweepstakes vault in step 120, a bankroll icon 3718 for accessing a bankroll in step 126, a bankroll money amount 3720, a bankroll number of credits 3722, and an icon 3724 to enter a tournament implementing step 122.

In a middle portion of the interface 3700, a left card 3726, a right card 3728, and a tie icon 3730 are displayed, along with percentages 3732, 3734, 3736 of the left card winning in the past, the right card winning in the past, and a tie occurring in the past, respectively. In addition, a set 3738 of miniaturized cards are shown, representing future cards for future turns and/or a potential flood of cards for lucky number gameplay, implementing step 114. Below each card 3726, 3728 and the tie icon 3730, a set 3740 of bet icons allow the player to enter a bet on the respective card 3726, 3728 or the tie icon 3730, with current odds such as 2 for 1 or 9 for 1 being displayed. A turn icon 3742 allows the player to turn over the cards 3726, 3728 to determining a winning card or a tie.

In a lower portion of the interface 3700, an icon 3744 indicates the type of game being played to implement step 134, such as a fun game. Another icon 3746 indicates the bet size such as $10, and clicking the icon 3748 implements step 132. An icon 3748 labeled Cancel allows a player to cancel a bet. In addition, the interface 3700 includes a region 3750 for displaying advertisements.

Figure 39:
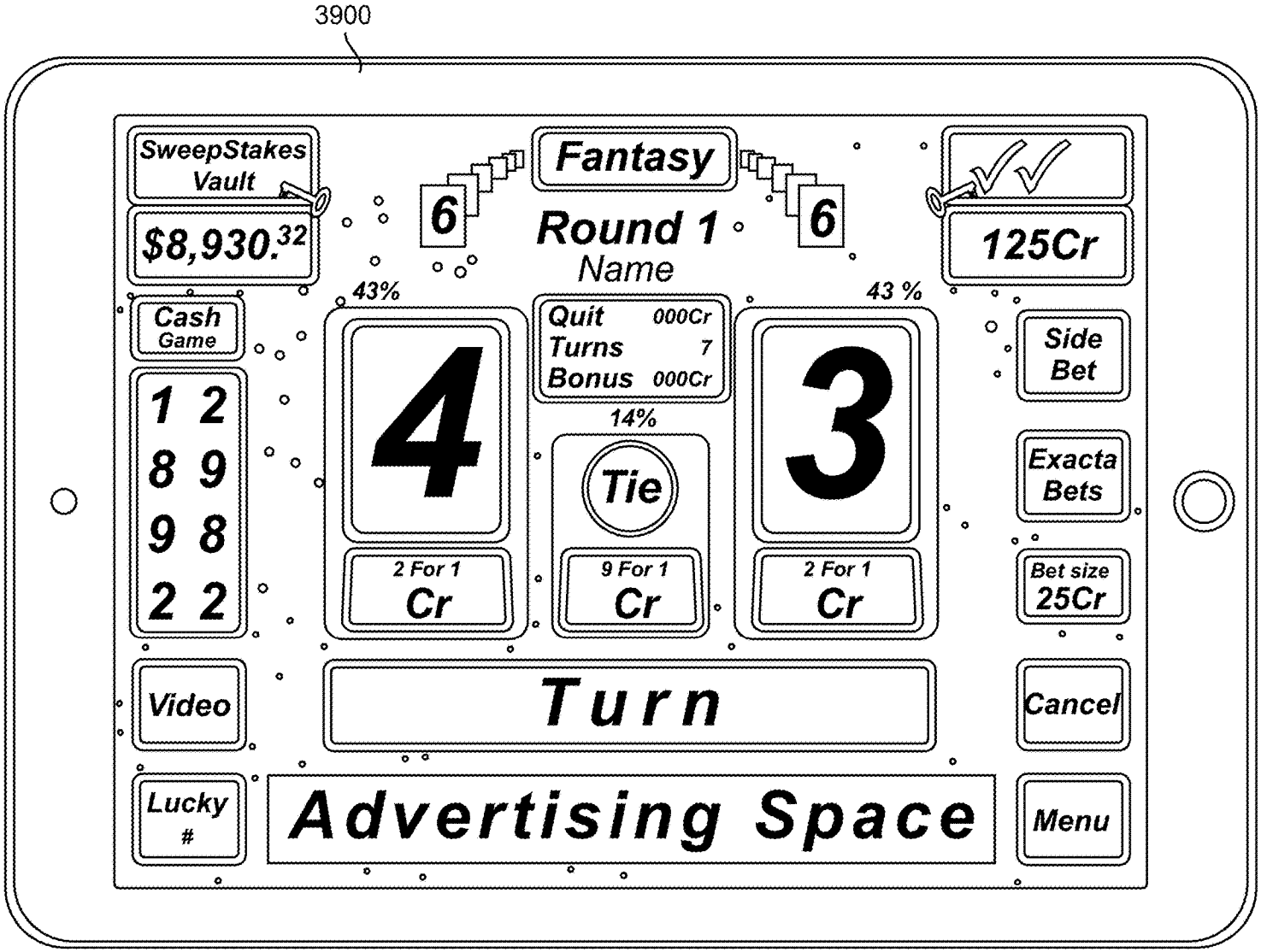
FIG. 39 illustrates an interface of a fantasy game.
Figure 40:
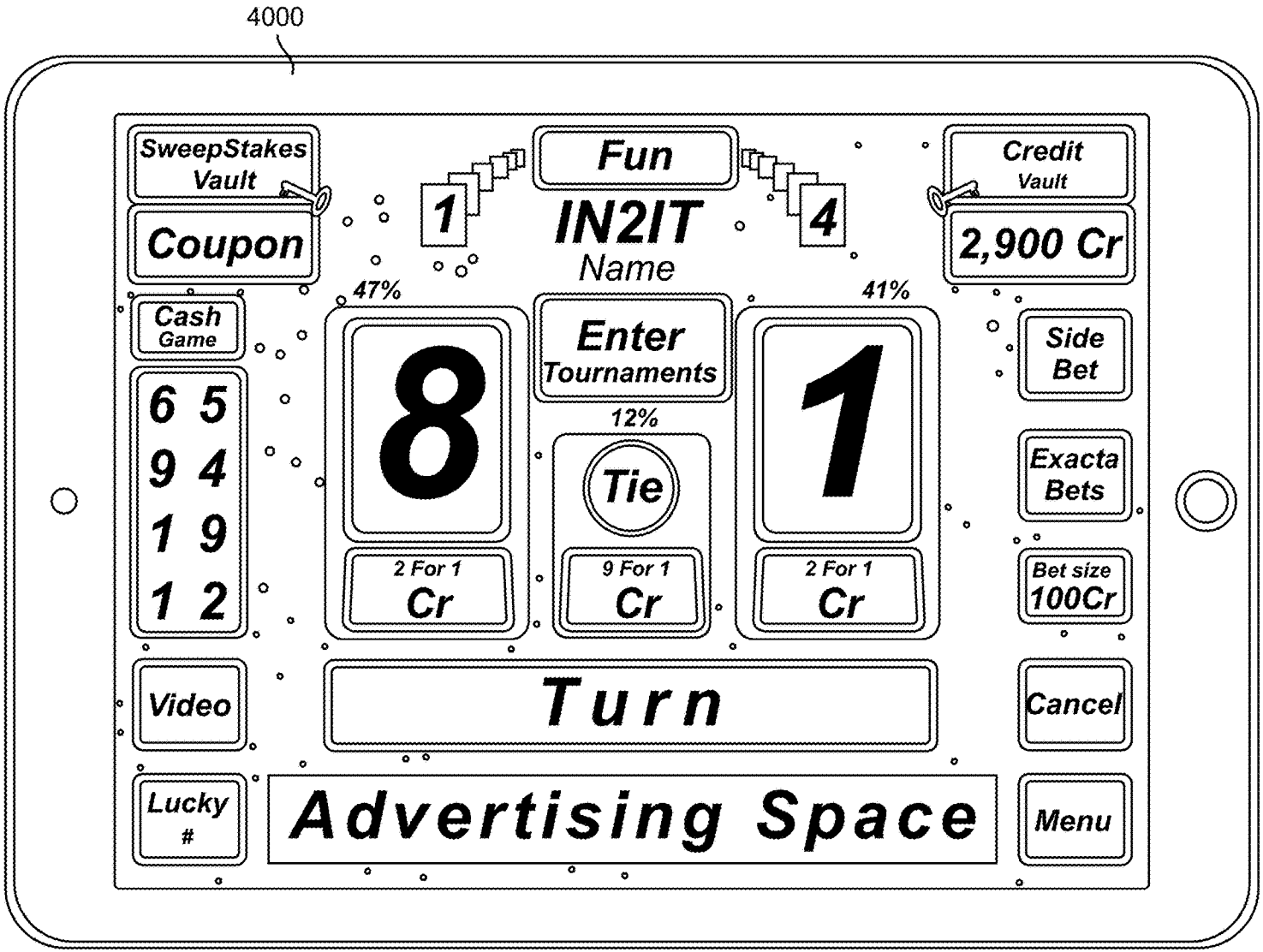
FIG. 40 illustrates an interface of a fun game.
Figure 41:
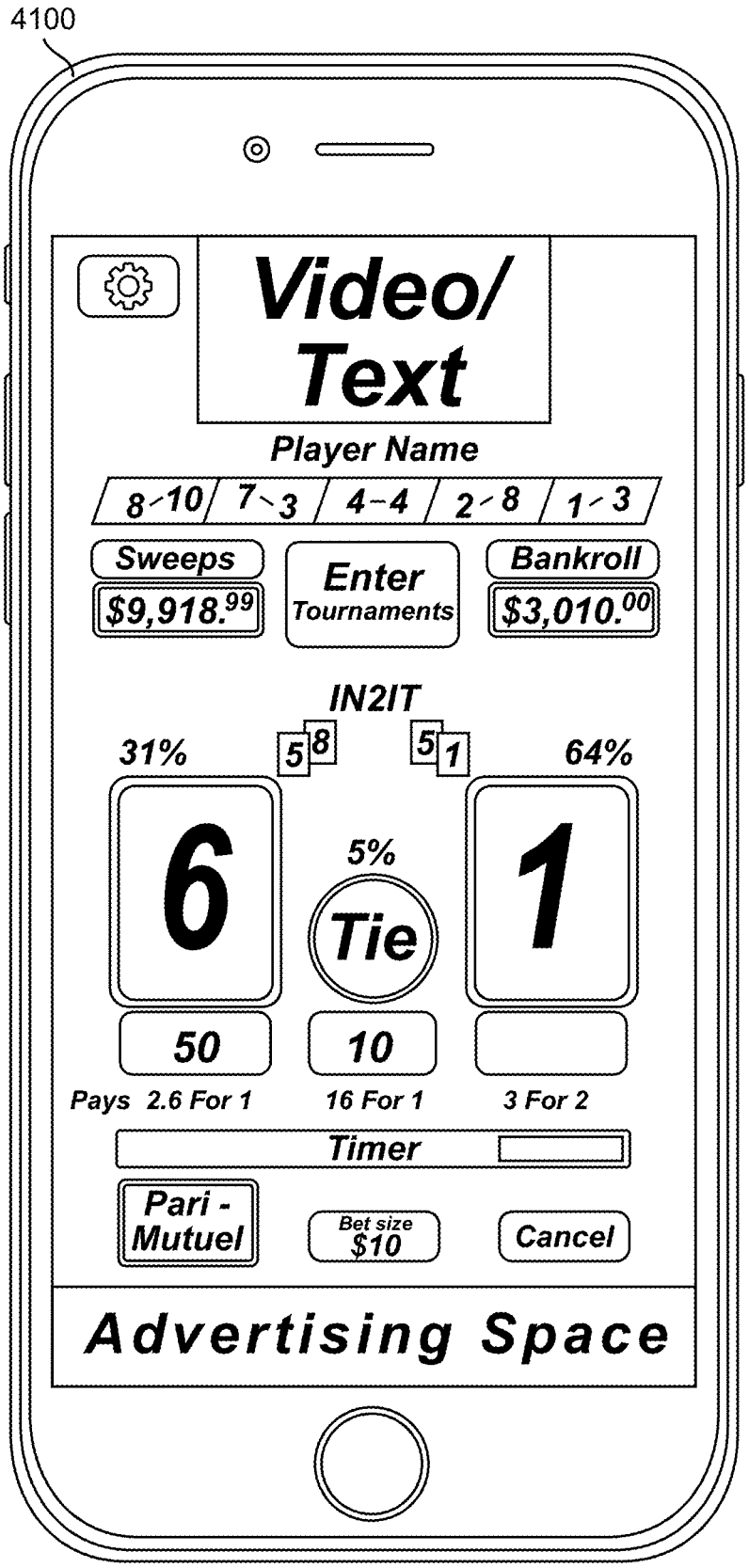
FIG. 41 illustrates an interface of a pari-mutuel game.
Figure 42:
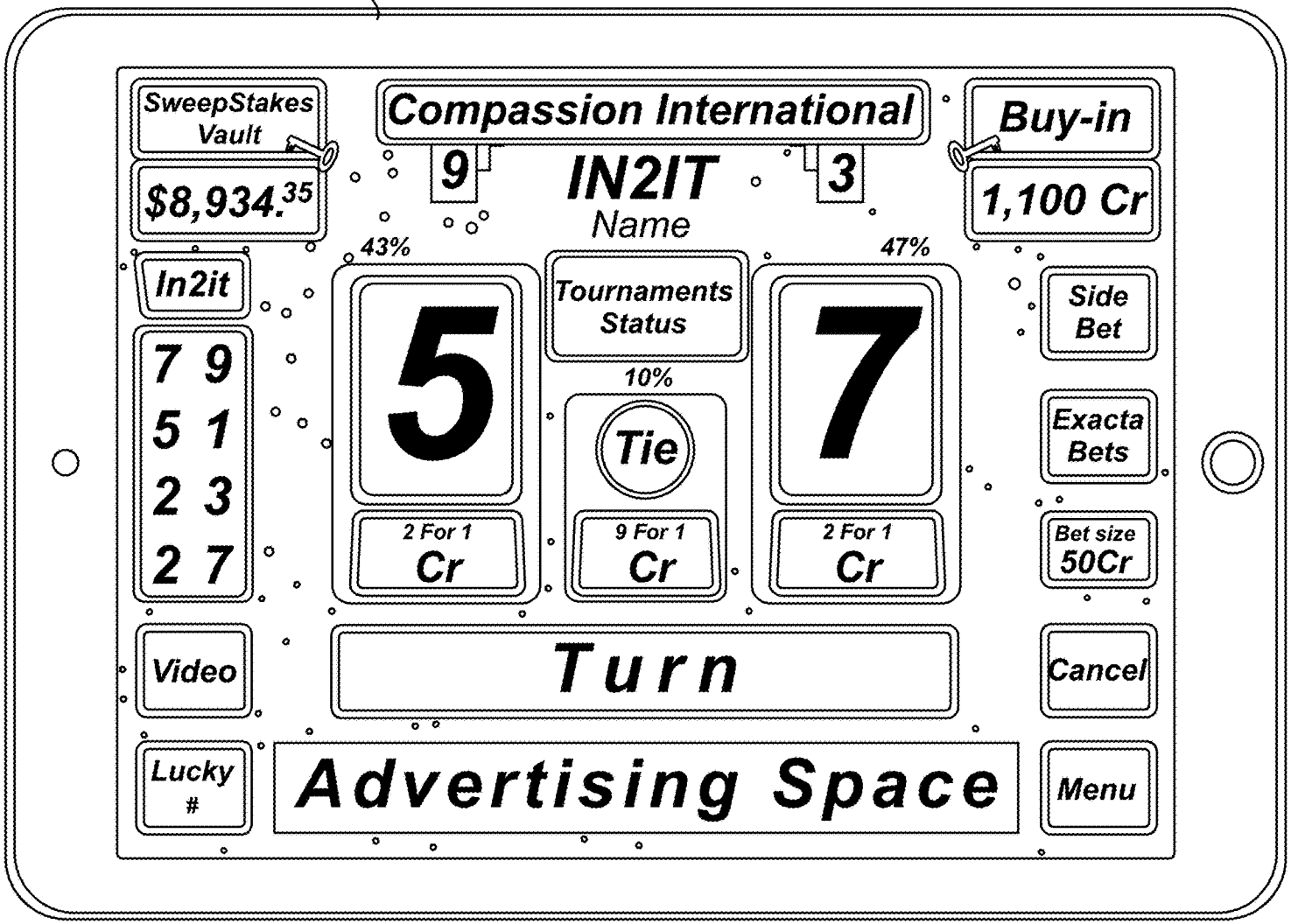
FIG. 42 illustrates an interface of a tournament game.

FIG. 38 illustrates an interface 3800 of a cash game which is implemented on a tablet 3302 or other known electronic devices. The interface 3800 of the cash game is similar to the interface 3700 in FIG. 37, with various icons and display regions in different portions of the interface 3800, and specific icons for conducting a cash game. Similarly, FIG. 39 illustrates an interface 3900 of a fantasy game which is similar to the interface 3700 in FIG. 37, with various icons and display regions in different portions of the interface 3900, and specific icons for conducting a fantasy game. Similarly, FIG. 40 illustrates an interface 4000 of a fun game which is similar to the interface 3700 in FIG. 37, with various icons and display regions in different portions of the interface 4000, and specific icons for conducting a fun game. Similarly, FIG. 41 illustrates an interface 4100 of a pari-mutuel game which is similar to the interface 3700 in FIG. 37, with various icons and display regions in different portions of the interface 4100, and specific icons for conducting a pari-mutuel game. Similarly, FIG. 42 illustrates an interface 4200 of a tournament game which is similar to the interface 3700 in FIG. 37, with various icons and display regions in different portions of the interface 4200, and specific icons for conducting a tournament game.

Figure 43:
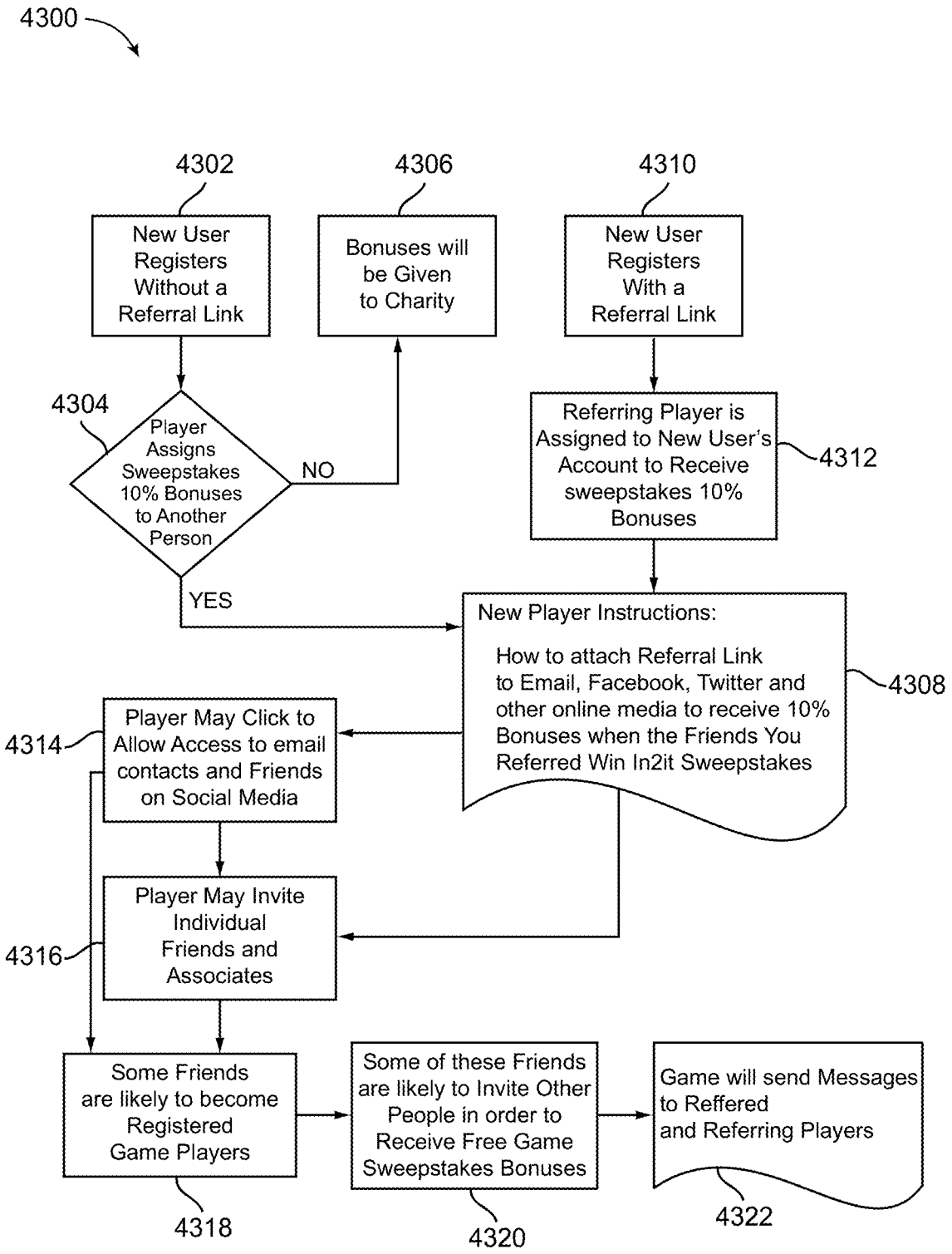
FIG. 43 illustrates a flowchart of viral marketing using referrals.

FIG. 43 illustrates a flowchart 4300 of viral marketing using referrals. Referrals provide an incentive for players to participate in tournaments, and thus to increase the money forwarded to a charity or cause. When an existing player refers a new player, the two players are linked, so that if the referred player wins any cash sweepstakes, the referring player receives a bonus. When referred players win any cash sweepstakes, the referring player is awarded a predetermined bonus, such as 10% of the cash winnings. Referring to FIG. 43, if a new user registers with the game server 330 without a referral link in step 4302, the new user as a player is given a choice in step 4304 to award the 10% bonus from the sweepstakes to another person. If the player does not choose to award the 10% bonus to another person in step 4304, the system 300 gives the bonus to a selected charity or cause, or randomly to charities and causes associated with a tournament in step 4306. Otherwise, the player gives the 10% bonus to another player according to new player instructions presented to the new player in step 4308.

In an alternative, if a new user registers with the system 300 with a referral link in step 4310, the referring player is assigned to the account of the new user, which is stored in a memory such as in the database 322, and the referring player receives the 10% sweepstakes winning bonuses. The method 4300 then proceeds to step 4308. In step 4308, the new user, whether registered or not, is instructed regarding how to attach a referral link to an Email or to a Facebook or Twitter account and/or to other online media. Such attached referral links allow the system 300 to allocate the 10% bonuses when the friends of the player referred by the player win an in-game cash sweepstakes. If users allow a game operated by the game server 330 to access their contacts on Facebook, Twitter, Email, etc., it is easier for the system 300 to establish referral links and to solicit additional players to tournaments, and such users granting access to their contacts have many more opportunities to get 10% bonuses.

Referring back to FIG. 43, after step 4308, a player may click an icon or a hyperlink on an interface to allow the system 300 to access Email contacts and friends on social media in step 4314, and players may invite individual friends and associates in step 4316, so that such contacts, friends, and associates may be invited to participate in tournaments. In step 4318, some friends are likely to become registered game players, and in turn, in step 4320, some of such registered friends are likely to invite other people in order to receive free game sweepstakes bonuses, and the game server 330 sends messages to the referred players as well as the referring players indicating, for example, the status of the referral of new users and players by the referring players. Therefore, the system 300 of the present invention utilizes viral marketing of the games and tournaments, and in turn, charities and causes to which players contribute.

Tools are thus provided by the system 300 to make it easy for a player to refer potential new players. If allowed by the player, the operator of the game can access Email contacts of the player and social media friends. The operator can automatically send Emails to these people with a referral link. The link encodes information about the referrer, so that when signup is completed, the referring player is linked to receive the bonus. If the referred person has already signed up, the referring player may be notified. Players may also invite specific players. Referral links, which include information about the referrer, are provided for signup.

The referring and viral marketing of games and tournaments may be described by a K factor, which reflects exponential growth of a customer base. The K factor is as follows:

$$K=i\times c\%$$

in which i is an average number of invites sent by players and visitors to the games and tournaments, and c is a percent conversion of each invite. For example, if an average new customer invites six friends or associates, then i=6. Also, if two out of eight invites become a visitor or player, then c=⅜=0.25=25%. Accordingly, in this example, K=i×c %=6×0.25=1.5. Since K=1.5 is greater than 1, K leads to expectations of exponential growth.

Figure 44:
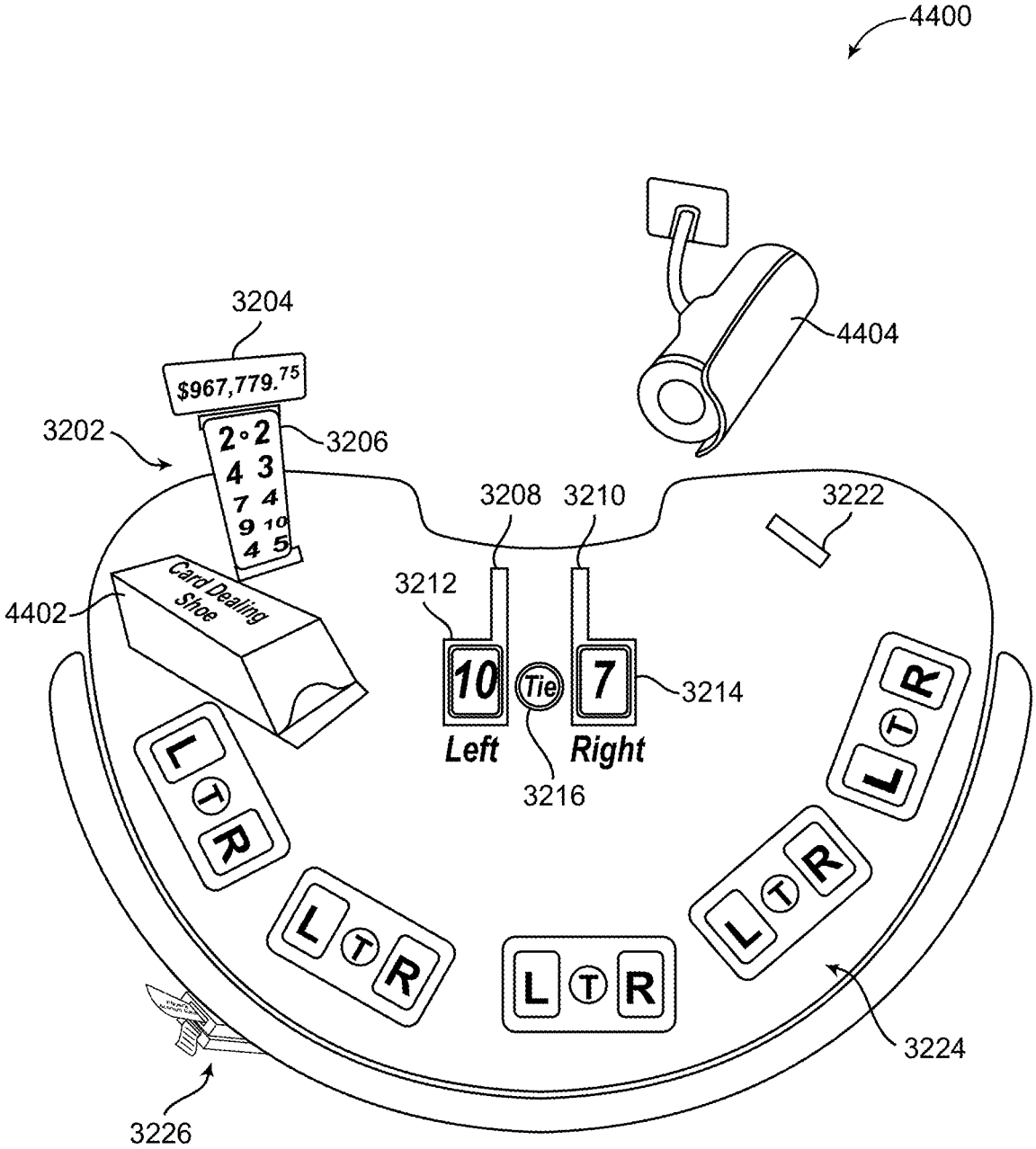
FIG. 44 is a top plan view of a game with cards dealt from a shoe.

FIG. 44 is a top plan view of a game on a game table 4400 with cards dealt from a shoe 4402, Several card decks are shuffled together and loaded into the card dealing shoe 4402. The dealer deals two cards from the shoe 4402, with the first card placed on the section of the table designated Right. The second card is placed on the section designated Left. After the bets are placed, dealer signals "No more bets" and turns over the cards, first the left card 3212, then the right card 3214. After the bets are collected and paid to players, the right card 3214 is placed in the discard slot 3222 that has a card reader, then the left card 3212 is placed in the discard slot 3222. The outcome list 3206 is updated by the card reader associated with the discard slot 3222. Alternatively, an optical recognition video camera 4404 can capture the images of the cards 3212, 3214 after they are turned over, and a signal is sent to update the outcome list 3206. A record of each transaction is sent to the game server 330, which may store data in the database 322, or alternatively in the cloud.

The present invention may be embodied in other specific forms without departing from its spirit or essential characteristics. The described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

What is claimed is:

1. A table for conducting a card game, comprising:

a plurality of positions for a plurality of players, each position having a printed area for receiving bets, an area designated on a selected left side, an area designated on a selected right side, and an area designated for a tie, for respectively receiving the bets that a left card has a higher number than a right card, that the right card will have a higher number than the left card, and/or that both cards show the same number when both cards are turned over, wherein types of bets are further selected from the group consisting of a side bet, an exacta bet and a lucky number bet;

a left paddle for receiving a left two-sided card; and a right paddle for receiving a right two-sided card;

a discard slot for discarding the left and right two-sided cards;

a card reader for reading and recognizing the left and right two-sided cards;

wherein the left two-sided card and the right two-sided card have a pair of sides hidden from the plurality of players;

wherein display of the hidden pair of sides of the left two-sided card and the right two-sided card to the plurality of players determines a winning state; and wherein after the winning state is determined the left and right two-sided cards are discarded and stored in the discard slot and the card reader communicates with an outcome list to display the discarded left and right two-sided cards.

2. The table of claim 1, further comprising a card dealing slot for a dealer to receive at least one of the left two-sided card and the right two-sided card.

3. The table of claim 1, further comprising a display presenting a jackpot amount.

4. The table of claim 1, wherein winning odds are determined and displayed based on previous winning states.

5. The table of claim 1, further comprising an electronic device with a display representing a left pad, a right pad, and a tie pad, with the electronic device receiving a bet on a selected one of the left pad, the right pad, and the tie pad.

6. The table of claim 1, further comprising an account card reader for reading a physical account card associated with one of the plurality of players.

7. The table of claim 1, further comprising a receipt printer for printing a physical receipt of bets and winnings of one of the plurality of players.

8. The table of claim 1, further comprising an optical recognition video camera for capturing images of the left two-sided card and the right two-sided card before and after the hidden pair of sides of the left two-sided card and the right two-sided card are displayed.

* * * * *